US005424753A

United States Patent [19]

Kitagawa et al.

[11] Patent Number: 5,424,753

[45] Date of Patent: Jun. 13, 1995

[54] METHOD OF DRIVING LIQUID-CRYSTAL DISPLAY ELEMENTS

[75] Inventors: Katsumi Kitagawa, Fussa; Hiroyuki Okimoto, Hino; Shyunichi Sato, Kawagoe, all of Japan

[73] Assignee: Casio Computer Co., Ltd., Tokyo, Japan

[21] Appl. No.: 164,678

[22] Filed: Dec. 9, 1993

Related U.S. Application Data

[63] Continuation of Ser. No. 813,799, Dec. 26, 1991, abandoned.

[30] Foreign Application Priority Data

| | | | |
|---|---|---|---|
| Dec. 31, 1990 | [JP] | Japan | 2-417468 |
| Mar. 28, 1991 | [JP] | Japan | 3-089865 |
| Apr. 22, 1991 | [JP] | Japan | 3-090885 |
| May 31, 1991 | [JP] | Japan | 3-129749 |
| Jun. 27, 1991 | [JP] | Japan | 3-156944 |
| Sep. 5, 1991 | [JP] | Japan | 3-225967 |

[51] Int. Cl.[6] ..... G09G 3/36

[52] U.S. Cl. ..... 345/94; 345/91; 345/58

[58] Field of Search ..... 345/87, 89, 94, 99, 345/91, 58, 208; 359/60, 55

[56] References Cited

U.S. PATENT DOCUMENTS

| | | | |
|---|---|---|---|
| 4,625,204 | 11/1986 | Clerc | 340/765 |
| 4,731,610 | 3/1988 | Baron et al. | 340/765 |
| 4,743,096 | 5/1988 | Wakai et al. | 340/784 |
| 4,945,352 | 7/1990 | Ejiri | 340/784 |
| 5,010,327 | 4/1991 | Wakita et al. | 340/805 |
| 5,095,377 | 3/1992 | Kobayashi et al. | 340/784 |
| 5,117,298 | 5/1992 | Hirai | 340/784 |

*Primary Examiner*—Tommy P. Chin
*Assistant Examiner*—A. Au
*Attorney, Agent, or Firm*—Frishauf, Holtz, Goodman & Woodward

[57] ABSTRACT

A display device has first and second substrates, a liquid-crystal layer, pixel electrodes arranged on the first substrate, a plurality of semiconductor active elements connected to the pixel electrodes, signal lines for supplying drive signals to the active elements, and a plurality of opposing electrodes arranged on the second substrate. Each pixel electrode, that portion of each opposing electrode which overlaps the pixel electrode, and that portion of the liquid-crystal layer which is sandwiched between the pixel electrode and said that portion of the opposing electrode form a pixel. A voltage having a positive or negative value according to the image data is applied between the input terminal of the semiconductor active element and said at least one of the opposing electrode, for a selecting period. Also, a voltage having such a waveform that at least two components thereof which are positive and negative with respect to a non-selecting potential which the scan signal has during the non-selecting period, said at least two component having substantially the same area, is applied between the input terminal of the semiconductor active element connected to said at least one of the pixel electrodes and said at least one of the opposing electrode, for the non-selecting period.

21 Claims, 49 Drawing Sheets

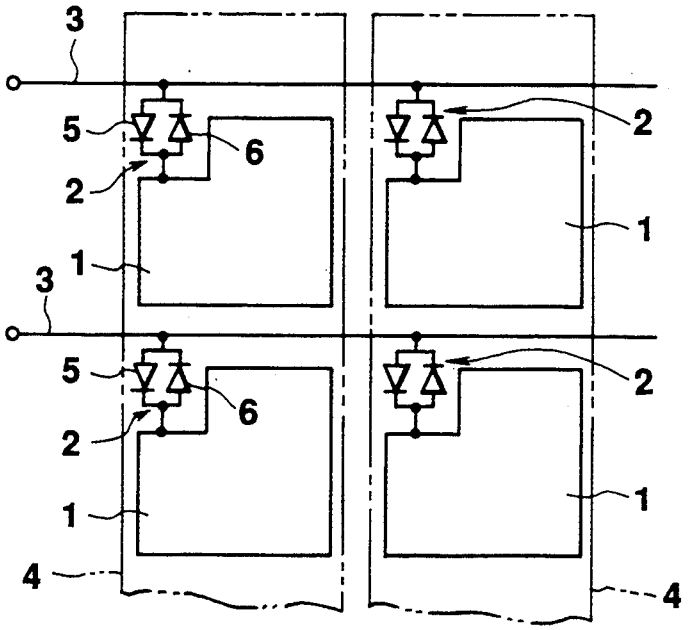
FIG. 1
(PRIOR ART)
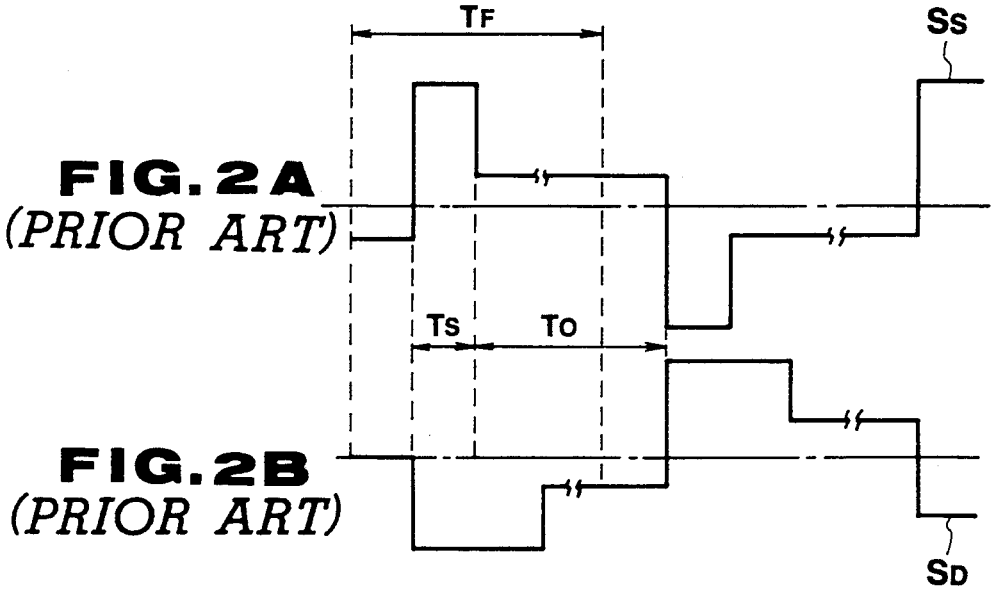
FIG. 2A
(PRIOR ART)
FIG. 2B
(PRIOR ART)

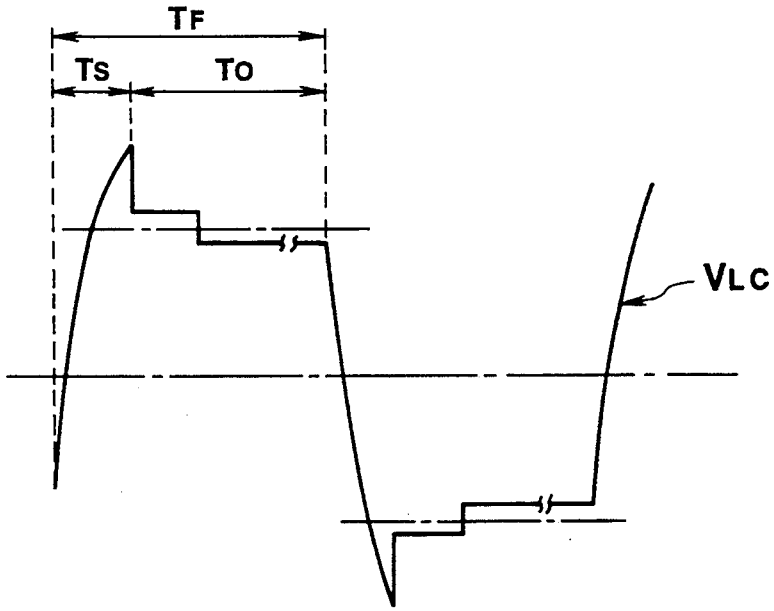
FIG. 5
(PRIOR ART)
FIG. 6A
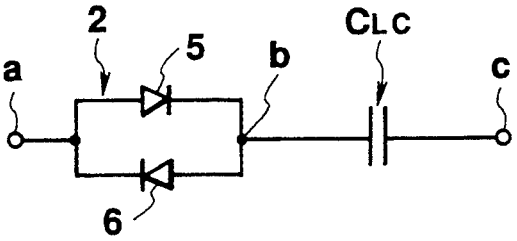
FIG. 6B
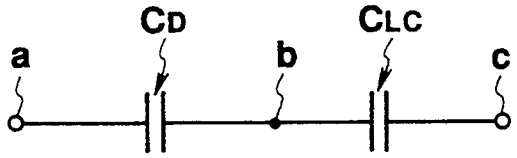

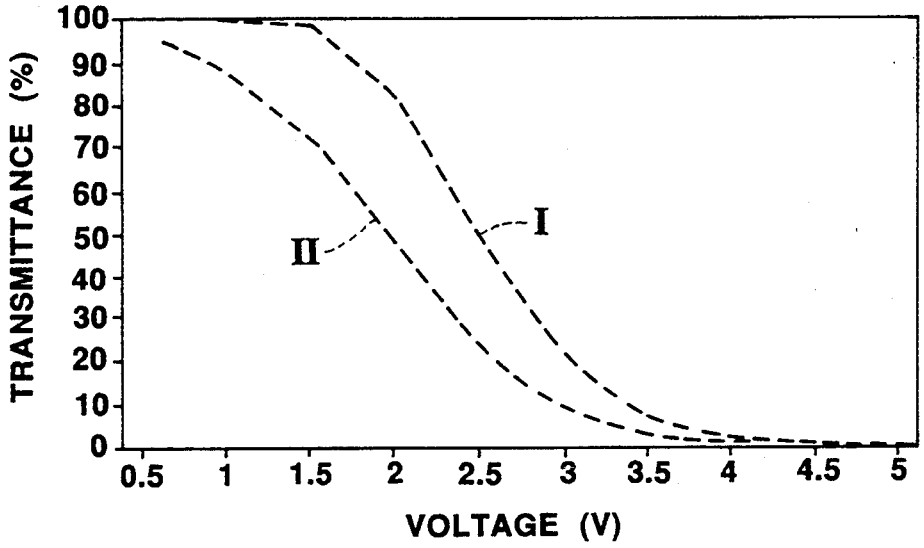
FIG. 7 *(PRIOR ART)*
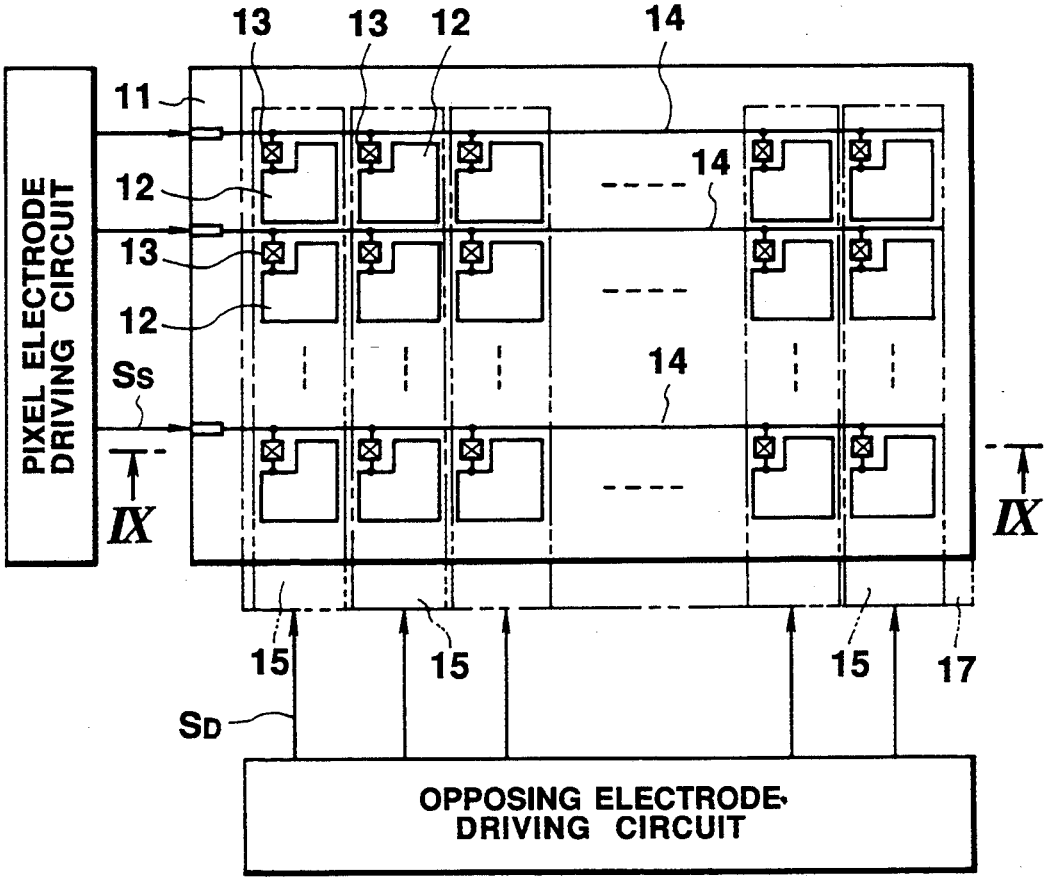
FIG. 8

TF
TS
TO
VC1
VC2
VG
-VC2
SS5
-VC1

TS1 TS2 TS3
A7

VS
VG
-VS
1/2 TS
B7
SD5
VC1+VS
VC1
VC1-VS
A8
Va-c
VC2+VS
-(VC2-VS)

VC2
VG
-(VC2-VS)
-VC2
B8
-(VC1-VS)
-(VC2+VS)
-VC1
-(VC1+VS)
A9
Vb-c

V2
VG
B9

TF
TS
TO
VC1
VC2
0
-VC2
-VC1
SS7

SD7

TS1
TS2
TS3
VS1
VS2
-VS1
-VS2
W1
W2
W3
VC1+VS1
VC1
VC2
Va-c

-(VC1+VS1)
Vb-c

V1

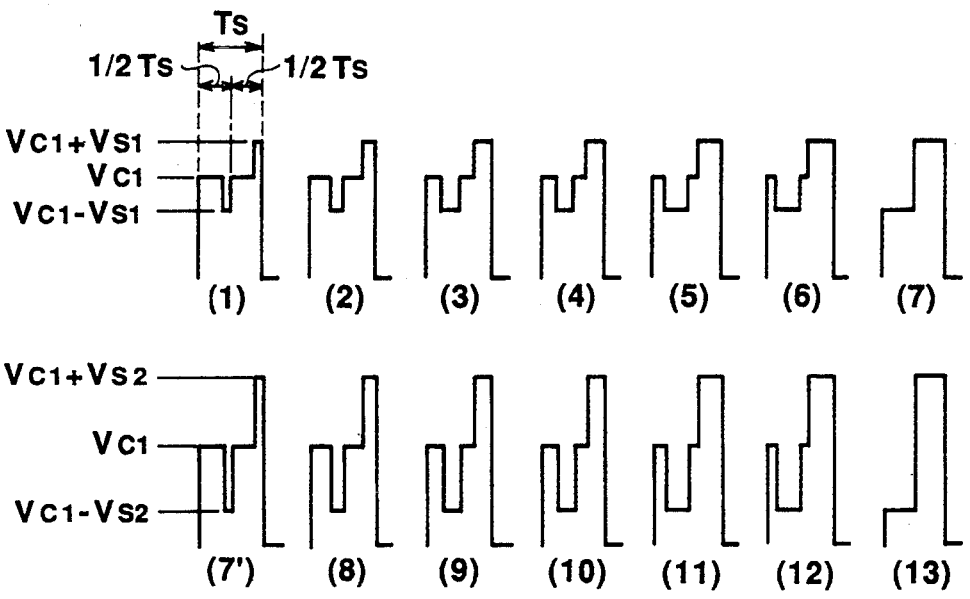
FIG. 51
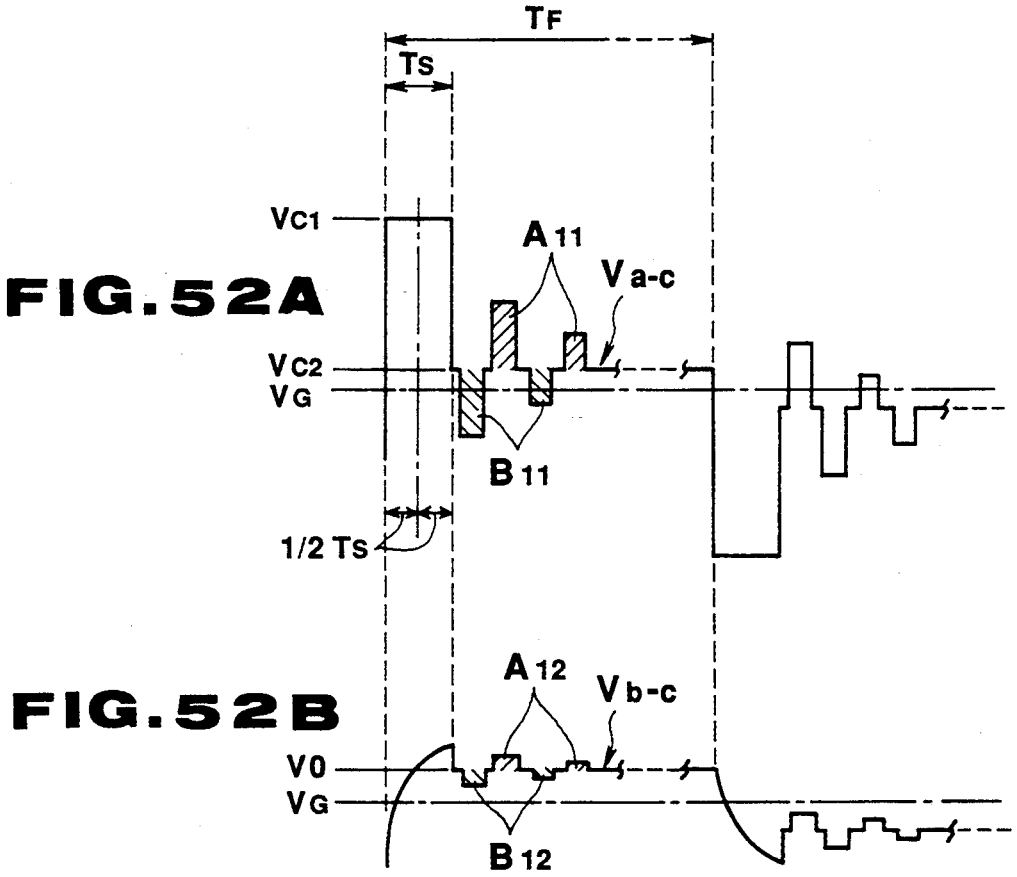
FIG. 52A
FIG. 52B

METHOD OF DRIVING LIQUID-CRYSTAL DISPLAY ELEMENTS

This application is a Continuation of application Ser. No. 07/813,799, filed Dec. 26, 1991, now abandoned.

BACKGROUND OF THE INVENTION

1. Field of the Invention

The present invention relates to a method of multiplex-driving active matrix liquid-crystal display (LCD) elements.

2. Description of the Related Art

LCD elements are used in television sets, personal computers, and the like.

Each of these displays comprises a plurality of active matrix LCD elements. These active matrix LCD elements are arranged in rows and columns, each comprising a pixel and an active element. The active elements can drive the pixels in high time-division fashion, without causing crosstalk among the pixels.

Active matrix LCD elements are classified into two types. The first type comprises a pixel and a two-terminal active element, e.g., a nonlinear resistive element (more specifically, a thin-film diode (TFD), for example). The second type comprises a pixel and a three-terminal active element, e.g., a thin-film transistor (TFT).

Active matrix LCD elements of the first type (hereinafter referred to as "TFD LCD elements"), whose active elements are thin-film diodes, are classified into two types. The first-type TFD LCD elements have so-called "diode-ring structure." The second-type TFD LCD elements have so-called "back-to-back structure."

FIG. 1 is a plan view of a liquid-crystal display comprising TFD LCD elements having the diode-ring structure. More precisely, it shows only four of the TFD LCD elements incorporated in the display and arranged in rows and columns. The liquid-crystal display has a pair of transparent substrates (not shown), a liquid-crystal layer (not shown) sandwiched between the substrates, a plurality of pixel electrodes 1, a plurality of active elements 2 (i.e., thin-film diodes), a plurality of signal lines 3, and a plurality of opposing electrodes 4. The pixel electrodes 1 are formed on the first substrate and arranged in rows and columns. The active elements 2 are mounted on the first substrate and arranged in rows and columns. The signal lines 3 extend parallel to the rows of the TFD LCD elements, for supplying drive signals to the rows of active elements 2. The opposing electrodes 4 are formed on the second transparent substrate and oppose the pixel electrodes 1.

The opposing electrodes 4 extend parallel to the columns of pixel electrodes 1, respectively. Hence, each pixel of the liquid-crystal display shown in FIG. 1 comprises a pixel electrode 1, that portion of an opposing electrode 4 which overlaps the pixel electrode 1, and that portion of the liquid-crystal layer (not shown) which is interposed between the pixel electrode 1 and said portion of the opposing electrode 4.

Each active element 2 is a so-called "diode ring" comprising two diodes 5 and 6 which are connected in parallel and orientated in the opposite directions. As is evident from FIG. 1, the active element 2 is connected at one end to the pixel electrode 1, and at the other end to the signal line 3.

Any TFD LCD element of the liquid-crystal display is driven in time-division fashion. A scan signal is supplied to the signal lines 3, and the data signal is supplied to the opposing electrodes 4.

More specifically, the diode ring 2 (i.e., the active element) is turned on or off by the voltage applied between its input terminal and the opposing electrode 4. (The input terminal of the active element 2 is the node where the element 2 is connected to the signal line 3, and said voltage is the potential difference between the scan signal and the data signal.) When the active element 2 is turned on, an electric charge is accumulated between the pixel electrode 1 and the opposing electrode 4 which opposes the pixel electrode 1. The charge, thus accumulated, drives that portion of the liquid-crystal layer which is interposed between the pixel electrode 1 and the opposing electrode 4, whereby the pixel displays the data corresponding to the data signal.

With reference to FIG. 2A, it will now be explain how to drive one of the pixels of, for example, the second row (hereinafter called "selected pixel"). FIG. 2B shows the waveform of a scan signal $S_S$ to be supplied to the signal line 3 to which the pixel is connected, and that of a data signal $S_D$ to be supplied to the opposing electrode 4 which is part of the selected pixel. In this figure, $T_S$ is a-selecting period during which the row of pixels, including the selected pixel, is selected, and $T_O$ is a non-selecting period during which the other rows of pixels are selected. The selecting period $T_S$ is obtained by dividing a one-field time $T_F$ by the number of pixel rows provided (i.e., the number of signal lines 3).

When the scan signal $S_S$ is supplied to the signal line 3 to which the pixels of the second row are connected, and the data signal $S_D$ is supplied to the opposing electrode 4 which is part of the selected pixel, a voltage Va, which changes as is shown in FIG. 3, is applied between the pixel electrode 1 of the selected pixel and that portion of the opposing electrode 4 which overlaps this pixel electrode 1. As is evident from FIG. 3, this voltage Va is a difference between the voltages of the scan signals $S_S$ and $S_D$. The value V1 which the voltage Va has during the selecting period $T_S$ is higher than the threshold voltage of the diode ring 2. The value V3 which the voltage Va has during the non-selecting period $T_O$ is lower than the threshold voltage of the diode ring 2.

The selected pixel, which is formed of a pixel electrode 1, that portion of an opposing electrode 4 which overlaps the pixel electrode 1, and that portion of the liquid-crystal layer which is interposed between the electrode 1 and said portion of the opposing electrode 4, is equivalent to a capacitor. The diode ring 2 remains off during the non-selecting period $T_O$. Hence, the voltage V1 between the input of the diode ring 2 and the opposing electrode 4 is applied across the diode ring 2 during the selecting period $T_S$.

The diode ring 2 has the current-voltage (I-V) characteristic illustrated in FIG. 4. As is evident from FIG. 4, when the voltage applied to the diode ring 2 rises above the threshold voltage of the diode ring 2 at the start of the selecting period $T_S$, the diode ring 2 is turned on. As a result, a current flows through the ring 2, whereby an electric charge is accumulated in the equivalent capacitor, i.e., the selected pixel. As the pixel is charged more and more, the voltage Va across the diode ring 2 decreases gradually. At the end of the selecting period $T_S$, or at the start of the non-selecting period $T_O$, the voltage Va falls to V2 which is lower than the threshold voltage of the diode ring 2. Hence, the diode ring 2 is turned off. The selected pixel holds the electric charge accumulated during the selecting period $T_S$.

The voltage $V_{LC}$, which is applied between the pixel electrode 1 and the opposing electrode 4 which form selected pixel, changes as is illustrated in FIG. 5. More precisely, the voltage $V_{LC}$ gradually increases during the selecting period $T_S$ as the pixel is increasingly charged. It falls at the end of the selecting period $T_S$, and remains unchanged during the non-selecting period $T_O$ by virtue of the charge accumulated during the selecting period $T_S$.

Thus far it has been described how the selected pixel of the second row is driven. Any other pixel of any other row of the liquid-crystal display shown in FIG. 1 is driven in the same way, whenever it is selected. As scan signals $S_S$ are sequentially supplied to the signal lines 3, and data signals $S_D$ are sequentially supplied to the opposing electrodes 4, the pixels are sequentially selected and driven, accumulating charges corresponding to the data signals. Due to the electric charges they have accumulated, the pixels have their transmittances changed, thus displaying the image represented by the data signals.

Described above is how TFD LCD elements having the diode-ring structure are selected and driven in time-division fashion, in order to display an image. The TFD LCD elements having the back-to-back structure are selected and driven in time-division fashion, by the same method as has been described above. TFD LCD elements have no crosstalk among them and can, therefore, be driven in high time-division fashion, no matter whether they have the diode-ring structure or the back-to-back structure.

A liquid-crystal display having active matrix LCD elements of the second type (hereinafter referred to as "TFT LCD elements"), whose active elements are thin-film transistors, will now be described. Though not shown in any drawing attached hereto, this liquid-crystal display has a pair of transparent substrates, a liquid-crystal layer sandwiched between the substrates, a plurality of pixel electrodes arranged on the first substrate in rows and columns, a plurality thin-film transistors (TFTs) arranged on the first substrate and having sources connected to the pixel electrodes, respectively, a plurality of scan signal lines for supplying scan signals to the gates of the TFTs, a plurality of data lines for supplying data signals to the drains of the TFTs, and a plurality of opposing electrodes arranged parallel on the second substrate. In this liquid-crystal display, each of the pixels comprises a pixel electrode, that portion of an opposing electrode which overlaps the pixel electrode, and that portion of the liquid-crystal layer which is interposed between the pixel electrode and said portion of the opposing electrode.

The TFT LCD elements are sequentially driven in time-division fashion as scan signals are sequentially supplied to the rows of TFTs and data signals are supplied to the columns of TFTs in synchronism with the scan signals, while a reference voltage is being applied to the opposing electrodes.

Each of the TFTs is turned on when a scan signal is supplied to its gate. Then, a current proportional to the voltage of the data signal supplied to the drain of the TFT flows to the pixel electrode. An electric charge is thereby accumulated between the pixel electrode and the opposing electrode which overlaps the pixel electrode. Due to the charge, thus accumulated, that portion of the liquid-crystal layer which is interposed between the pixel electrode and the opposing electrode has its transmittance changed. As a result, the pixel displays a dot represented by the data signal.

The electric charge is held between the pixel electrode and the opposing electrode during the non-selecting period. In other words, the charge is held there while any other row of pixels is being selected. When the next data signal is supplied to the drain of the TFT whose source is connected to the pixel electrode, the charge corresponding to this data signal is accumulated between the pixel electrode and the opposing electrode.

Hence, as the TFT LCD elements are sequentially driven in time-division fashion as described above, they display, in cooperation, an image consisting of the dots represented by the data signals supplied to the drains of the TFTs.

Like the TFD LCD elements, the TFT LCD elements have no crosstalk among them, Therefore, they can be driven in high time-division fashion.

The active matrix LCD elements described above have an active element each, which is a thin-film semiconductor elements, such as a TFD or a TFT. A great capacitance is built up between the electrodes of the semiconductor element (i.e., the two electrodes of a TFD, or the gate electrode and source or drain electrode of a TFT).

Each active matrix LCD element is represented by the equivalent circuit of FIG. 6(*a*), which comprises a pixel capacitor $C_{LC}$ (i.e., the capacitance of a pixel) and an active element 2 connected in series to the capacitor $C_{LC}$. Once the active element 2 is turned off, the active matrix LCD element is represented by the equivalent circuit of FIG. 6(*b*), which comprises the pixel capacitor $C_{LC}$ and an element capacitor $C_D$ (i.e., the capacitance of the active element 2). The element capacitor $C_D$ is connected in series to the pixel capacitor $C_{LC}$.

Therefore, as is shown in FIG. 5, the inter-electrode voltage $V_{LC}$ of the active matrix LCD element increases to the voltage applied between the signal line 3 and the opposing electrode 4 during the selecting period $T_S$ when the active element 2 remains on. When the active element 2 is turned off at the start of the non-selecting period $T_O$, the voltage $V_{LC}$ decreases since it is divided into two parts which correspond to the pixel capacitance $C_{LC}$ and the element capacitance $C_D$, respectively. How much the voltage $V_{LC}$ falls depends on the ratio of the element capacitance $C_D$ to the pixel capacitance $C_{LC}$.

More specifically, the voltage $V_{LC}$ applied between points b and c in FIG. 6(*b*) is given:

$$V_{LC} = Va \cdot C_D / (C_{LC} + C_D)$$

where Va is the voltage applied between points a and c. Obviously, the voltage $V_{LC}$ decreases greatly during the non-selecting period $T_O$, if the element capacitance $C_D$ is greater than the pixel capacitance $C_{LC}$.

In each active matrix LCD element, that portion of the liquid-crystal layer which is sandwiched between the electrodes 1 and 4 is driven actually by the voltage applied between these electrodes during the non-selecting period $T_O$ which is much longer than the selecting period $T_S$. Hence, the voltage for driving said portion of the liquid-crystal layer will inevitably decrease if the voltage $V_{LC}$ falls greatly at the start of the non-selecting period $T_O$.

In order to apply a sufficiently high voltage to the liquid-crystal layer, it is necessary to increase the voltage applied between the signal line 3 and the opposing electrode 4. To this end, a high-voltage drive circuit must be used, which consumes much electric power.

The reduction of the inter-electrode voltage of each pixel can be minimized if the ratio of the element capacitance $C_D$ to the the pixel capacitance $C_{LC}$ is small. To decrease the capacitance $C_D$, thereby to make the ratio $C_D/C_{LC}$ sufficiently small, it would suffice to use a pair of thin-film diodes or a thin-film transistor as active element 2, which has a small area. If the thin-film diodes or the thin-film transistor, used as active element 2, has so small an area that the ratio $C_D/C_{LC}$ is about 0.1 or less, the voltage $V_{LC}$, which is applied between points b and c shown in FIG. 6(*b*), will decrease, but not so much. As a result, the voltage applied to the liquid-crystal layer is high enough to drive the pixel. Hence, the active matrix LCD element can be driven with a relatively small amount of electric power.

In order to manufacture a thin-film diode or transistor having a small area, however, high-precision patterning needs to be accomplished. It is difficult to achieve such high-precision patterning, making it hard to form a thin-film diode or transistor having an small area and, hence, a negligibly small capacitance. Inevitably, the inter-electrode voltage $V_{LC}$ of the pixel will decrease due to the capacitance $C_D$ of the active element 2 at the start of the non-selecting period $T_O$. Even if the capacitance $C_D$ is somewhat small, a voltage must be applied between the input of the active element 2 and the opposing electrode 4, which is high enough to compensate for the reduction in the inter-electrode voltage $V_{LC}$ which occurs at the beginning of the non-selecting period $T_O$.

The conventional method of driving active matrix LCD elements has another problem. The pixel of each LCD element has its transmittance changed too much even if the drive voltage applied between the input of the active element 2 and the opposing electrode 4 is as high as the inter-electrode voltage $V_{LC}$ of the pixel. The problem will be detailed, with reference to FIG. 7.

FIG. 7 represents the voltage-transmittance (V-T) characteristic of the pixel of an active matrix LCD element, which has a diode-ring used as active element, when driven in time-division fashion by the conventional method. In this figure, curve I indicates the V-T characteristic the pixel has when all other pixels of the same column (i.e., all other pixels opposing the same opposing electrode 4) are driven to allow light to pass through them. Curve II in FIG. 7 indicates the V-T characteristic the pixel has when all other pixels of the same column are driven to inhibit light from passing through them. Both V-T characteristics illustrated in FIG. 7 are inherent in the pixels of LCD elements incorporated in a liquid-crystal display which has two polarizing plates arranged with their polarization axes crossing at right angles.

As is evident from FIG. 7, the transmittance of the pixel of each active matrix LCD element changes in accordance with whether the other pixels of the same column are driven to allow or inhibit the passage of light, even though the drive voltage applied to the active matrix LCD element remains unchanged. This is because the inter-electrode voltage $V_{LC}$ of the pixel is changed by the data signal supplied to all other pixels of the same column during the non-selecting period $T_O$. In other words, the data signal applied to the other pixels of the same column imposes a great influence on the V-T characteristic of the pixel, greatly changing the transmittance of the pixel.

With the conventional method of driving active matrix LCD elements, it would be difficult to control vary the brightnesses of the individual pixels, thereby to accomplish gray-level control. The conventional method can hardly help to display gray-scale images.

SUMMARY OF THE INVENTION

The object of the present invention is to provide a method of driving liquid-crystal display (LCD) elements, wherein measures are taken to minimize the change in the transmittance of the pixel of each LCD element, which results from the image data supplied to the pixels of the other LCD elements during non-selecting period of the LCD element, thereby to set the pixel at any desired gray-level.

To achieve the object, according to the invention there is provided a method of multiplex-driving active matrix LCD elements of a liquid-crystal display which comprises first and second substrates spaced apart from each other and opposing to each other; a liquid-crystal layer interposed between the substrate; a plurality of pixel electrodes arranged in rows and columns on an inner surface of the first substrate; a plurality of semiconductor active elements formed on the inner surface of the first substrate and connected to the pixel electrodes, respectively; a plurality of signal lines arranged on the inner surface of the first substrate and extending parallel to the rows of pixel electrodes, for supplying drive signals to the active elements; and a plurality of opposing electrodes arranged on an inner surface of the second substrate and extending parallel to the columns of pixel electrodes, and in which each pixel electrode, that portion of each opposing electrode which overlaps the pixel electrode, and that portion of the liquid-crystal layer which is sandwiched between the pixel electrode and said portion of the opposing electrode form a pixel.

The method of the invention comprises the steps of: applying a selecting voltage between at least one of the pixel electrodes and the opposing electrode overlapping the at least one pixel electrode for a selecting period during which image data is supplied to the pixel, said selecting voltage being of either positive or negative polarity in accordance with the value of the image data; and applying a non-selecting voltage between the pixel electrode and the opposing electrode for a non-selecting period during which image data is supplied to the other pixels, said non-selecting voltage having such a waveform that a component positive with respect to a voltage held between the pixel electrode and the opposing electrode at the end of the selecting period, has substantially the same area as a component negative with respect to said hold voltage.

In the method, a scan signal is supplied to any active element or the opposing electrode opposing this active element, and a data signal is supplied to the active element if the scan signal is supplied to the opposing electrode, or to the opposing electrode if the scan signal is supplied to the active element. During the selecting period, a selecting voltage whose polarity is determined by the value of the data signal is applied between the input terminal of the active element and the opposing electrode. By contrast, during the non-selecting period, a non-selecting voltage is applied between the input terminal of the active element and the opposing electrode. This non-selecting voltage has such a waveform in which a component positive and a component negative with respect to the hold voltage, have substantially the same area each other.

The scan signal has one potential during the selecting period, and another potential during the non-selecting period, and has its polarity unchanged during the selecting period. On the other hand, the data signal has its potential changed several times during each selecting period, and has such a waveform that the components which are positive with respect to a predetermined reference potential have substantially the same total area as that of the components which are negative with respect to this reference potential.

The data signal is a signal whose potential changes at an even number of regular intervals in every selecting period, and whose waveform is such that that every two adjacent components are respectively positive and negative with respect to a reference potential and have substantially the same absolute potential. Alternatively, the data signal is a signal whose potential changes at any number of irregular intervals in every selecting period, whose waveform is such that the the components which are positive with respect to the reference potential have a total area substantially equal to that of the components which are negative with respect to the reference potential.

Further, in the method of the invention, the amplitude of the data signal (i.e., the difference between the potential of the signal and the reference potential), the pulse width thereof, and/or the number of pulses thereof is changed, thereby to set each pixel at a desired gray-level.

Since the selecting voltage, either positive or negative according to the image data, is applied between the pixel electrode and the opposing electrode during the selecting period, electric charge of one polarity is continuously accumulated between the pixel electrode and the opposing electrode. Hence, the pixel is electrically charged throughout the selecting period. A sufficient electric charge can therefore be accumulated between the electrodes, not restricted by the limited current-flowing ability of the active element.

In the method of the invention, the non-selecting voltage is applied between the pixel electrode and the opposing electrode for a non-selecting period during which image data is supplied to the other pixels. As has been described, the non-selecting voltage has such a waveform that a component positive with respect to a voltage held between the pixel electrode and the opposing electrode at the end of the selecting period, has substantially the same area as a component negative with respect to said hold voltage. Therefore, the actual value of the non-selecting voltage (i.e., the hold voltage) remains unchanged during the non-selecting period. That is, the positive changes in the non-selecting voltage, which inevitably occur due to the data signals supplied to the other pixels, cancel out the negative changes in the non-selecting voltage, which inevitably occur due to the image data. As a result, the voltage-transmittance characteristic of the pixel scarcely change during the non-selecting period.

Hence, the transmittance of the pixel, which depends on the hold voltage determined by the selecting voltage applied during the selecting period, can be correctly controlled by the selecting voltage, whereby the pixel is set at any desired gray-level.

Since the gray-level of each pixel is controlled by changing the pulse width of the data signal or the number of pulses thereof, the method of the invention can be performed by means of a simple drive circuit. Alternatively, the gray-level of the pixel can be controlled by changing the pulse width or number of pulses of the data signal and also by changing the potentials of the pulses. If so, not only the pixel, but also the other pixels can easily be set at the respective desired gray-levels.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a plan view schematically showing some of the active matrix LCD elements of a conventional liquid-crystal display;

FIGS. 2A and 2B are a diagram showing the waveform of a data signal and a scan signal used in a conventional method of driving the active matrix LCD elements of the liquid-crystal display shown in FIG. 1;

FIG. 5 is a diagram illustrating how the voltage applied between the pixel electrode of any pixel and any opposing electrode overlapping the pixel electrode does change when the voltage changing as is shown in FIG. 3 is applied;

FIG. 6A is an equivalent circuit diagram showing one of the diode rings shown in FIG. 1;

FIG. 6B is an equivalent circuit diagram showing one of the diode rings shown in FIG. 1 which is turned off, and the pixel which that diode ring is connected;

FIG. 7 is a graph representing the voltage-transmittance signal characteristic which each pixel of the display shown in FIG. 1 exhibits when the active matrix LCD elements are driven by the conventional method;

FIG. 8 is a plan view schematically showing active matrix LCD elements which are driven by a method according to the present invention;

FIG. 51 is a diagram showing the waveforms of various selecting voltages used in the ninth method to set each pixel at various gray-levels;

FIGS. 52A and 52B are diagrams showing the waveforms of two voltages applied between the input of the active element and the opposing electrode and between the pixel electrode and the opposing electrode, respectively, thereby to set the pixel at the 0-th gray-level in the eighth method according to the invention;

DETAILED DESCRIPTION OF THE PREFERRED EMBODIMENTS

First Embodiment

The first embodiment of the present will now be described, with reference to FIGS. 8 to 16. This embodiment is a method of driving active matrix LCD elements, each having a 2-terminal active semiconductor element.

Before describing the first embodiment, a liquid-crystal display, to which the embodiment is applied, will be described.

Figure 3:
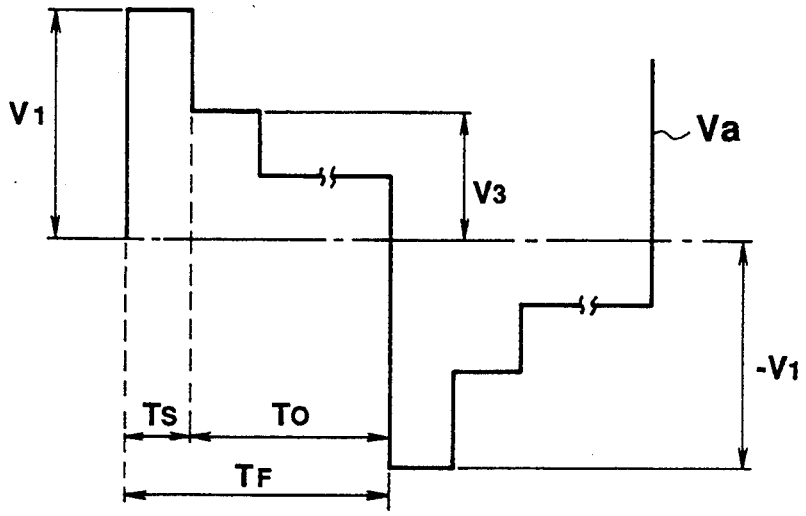
FIG. 3 (PRIOR ART)
FIG. 3 is a diagram representing how the voltage applied between the input of the active element of one of the LCD elements and one of the opposing electrodes of the liquid-crystal display does change when a scan signal and a data signal are supplied to the input of the active element and the opposing electrode, respectively.
Figure 4:
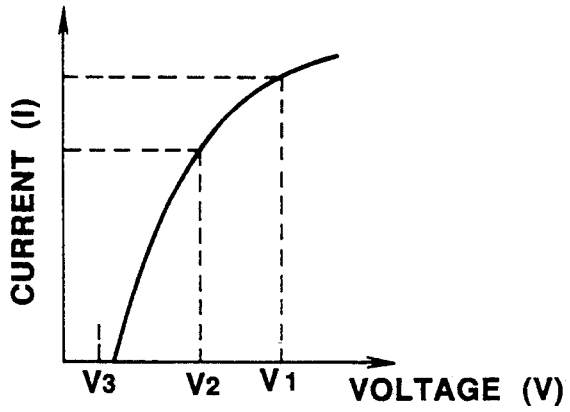
FIG. 4 (PRIOR ART)
FIG. 4 is a graph representing the voltage-current characteristic of the diode rings used as active elements in the liquid-crystal display shown in FIG. 1.
Figure 9:
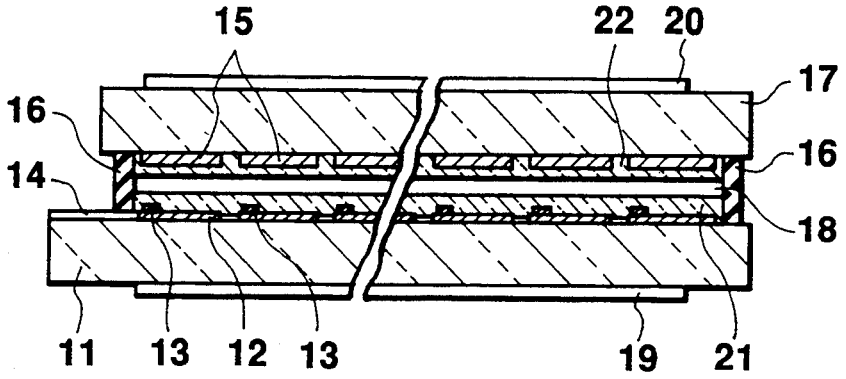
FIG. 9 is a cross-sectional view taken along line IX—IX in FIG. 8.

As is shown in FIGS. 8 and 9, the liquid-crystal display has a plurality of active matrix LCD elements, each having a 2-terminal active semiconductor element. The display comprises two substrates 11 and 17, a frame-shaped sealing member 16, a liquid-crystal layer 18, and two polarizing plates 19 and 20. The substrates 11 and 17, both made of transparent material such as glass, are located parallel to, and spaced apart from, each other. The sealing member 16 is interposed between these substrates 11 and 17 and connects them together. The liquid-crystal layer 18 is sealed within the space defined by the substrates 11 and 17 and the sealing member 16. The polarizing plates 19 and 20 are mounted on the outer surfaces of the substrates 11 and 17, respectively, with their polarization axes extending at substantially right angles.

The liquid-crystal display further comprises pixel electrodes 12, active elements 13, and signal lines 14. The pixel electrodes 12 are formed on the inner surface of the first substrate 11 and arranged in rows and columns. The active elements 13 are mounted on the inner surface of the first substrate 11. The signal lines 14 extend parallel to the rows of pixel electrodes 12 (or in the horizontal direction in FIG. 8). The active elements 13 are 2-terminal active semiconductor elements. The two terminals of each active element 13 are connected to a pixel electrode 12 and a signal line 14, respectively. Drive signals can be supplied to the active elements 13 through the signal lines 14.

The liquid-crystal display further comprises a plurality of opposing electrodes 15 which are formed on the inner surface of the second substrate 17 and which extend in parallel to the columns of pixel electrodes 12 (or in the vertical direction in FIG. 8). Each of these electrodes 15 is provided for one column of pixel electrodes 12.

The display has two aligning films 21 and 22. The first aligning film 21 is formed on the inner surface of the first substrate 11 and covers the pixel electrodes 12, the active elements 13, and the signal lines 14. The second aligning film 22 is formed on the inner surface of the second substrate 11 and covers the opposing electrodes 15. The films 21 and 22 are subjected to aligning treatment, such that they have aligning axes which cross each other at substantially right angles. Hence, the moleculars of the liquid-crystal layer 18 are twisted at about 90° in accordance with the directions of the aligning treatments of the first and second aligning films 21 and 22.

As has been described, the active matrix LCD elements of the liquid-crystal display have an active element 13 each. Each active matrix LCD element also has a pixel which comprises a pixel electrode 12, that portion of an opposing electrode 15 which overlaps the pixel electrode 12, and that portion of the liquid-crystal layer 18 which is sandwiched between the pixel electrode 12 and said portion of the opposing electrode 15.

Figure 10:
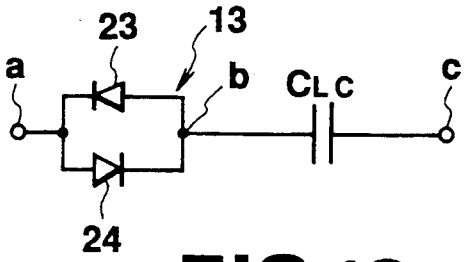
FIG. 10 is an equivalent circuit diagram showing one of the diode rings shown in FIG. 8 and the pixel connected to the diode ring.

As is shown in FIG. 10, each of the active elements 13 is a diode ring which consists of two diodes 23 and 24 connected in parallel. (As explained above, the pixel comprises the pixel electrode 12, said portion of the opposing electrode 15, and said portion of the liquid-crystal layer 18.) The diode 23 has its anode connected the capacitor $C_{LC}$, whereas the diode 24 has its cathode connected thereto. The diode ring shown in FIG. 10 can be replaced by a diode ring of another type which comprises two groups of diodes, each group consisting of the same number of diodes.

Figure 11:
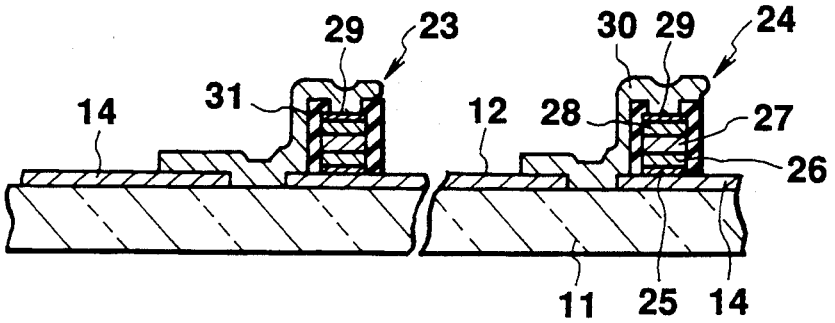
FIG. 11 is a cross-sectional view showing one of the thin-film diode rings shown in FIG. 8.

The diodes 23 and 24, which forms a diode ring, are made by forming thin semiconductor films, one upon another. More precisely, as is shown in FIG. 11, the diodes 23 and 24 are mounted on the pixel electrode 12 and the signal line 14, respectively. Two conductors 30 and 31 electrically connect these diodes 23 and 24. The diodes 23 and 24 are thin-film diodes, each comprising a metal layer 25, a P-type semiconductor film 26, an I-type semiconductor film 27, an N-type semiconductor film 28, and a metal film 29, which are formed, one on another, in the order shown in FIG. 11.

The signal lines 14 are connected to a pixel-electrode driving circuit, and the opposing electrodes 15 are connected an opposing-electrode driving circuit. The drive circuits comprise logic gates and designed to output drive signals, i.e., scan signals $S_S$ and data signals $S_D$.

The thin-film diode 23 has its upper metal layer 29 connected to the signal line 14 by the conductor 31, and is used to supply an electric current in forward direction from the pixel electrode 12 to the signal line 14. The thin-film diode 24 has its upper metal layer 29 connected to the pixel electrode 12 by the conductor 30, and is used to supply an electric current in forward direction from the signal line 14 to the pixel electrode 12.

In operation, the active element driving circuits outputs, for example, scan signals $S_S$ whose phase are sequentially shifted. The scan signals $S_S$ are supplied to the signal lines 14, thereby sequentially selecting the rows of pixels. The opposing electrode driving circuit outputs, for example, data signals $S_D$ which represent an image and which are synchronous with the scan signals. The data signals $S_D$ are supplied to the opposing electrodes 15. The active matrix LCD elements are thereby driven in time-division fashion. As a result, the pixel of each active matrix LCD element has its transmittance controlled by the data signal supplied to the opposing electrode 15 during the selecting period.

In the liquid-crystal display shown in FIGS. 8 and 9, the scan signals are supplied to the signal lines 14, while the data signals are supplied to the opposing electrodes 15. Nonetheless, according to the present invention, the scan signals can be supplied to the opposing electrodes 15, and the data signals can be supplied to the signal lines.

It will now be explained how the active matrix LCD elements are driven.

Figure 12A:
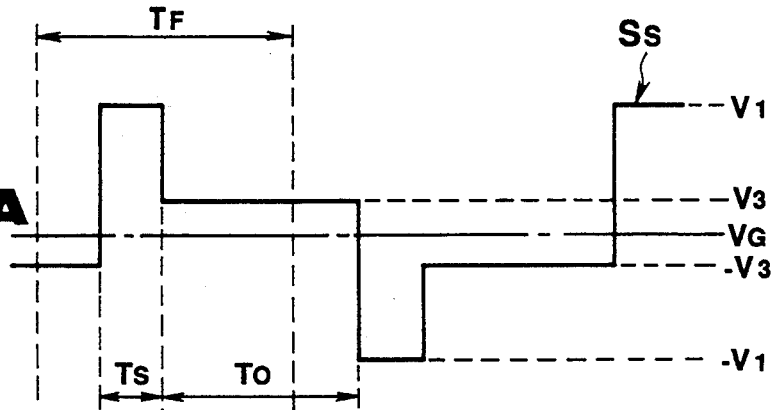
FIG. 12A is a diagram illustrating the waveform of the scan signal used in the method according to a first embodiment of the invention.
Figure 12B:
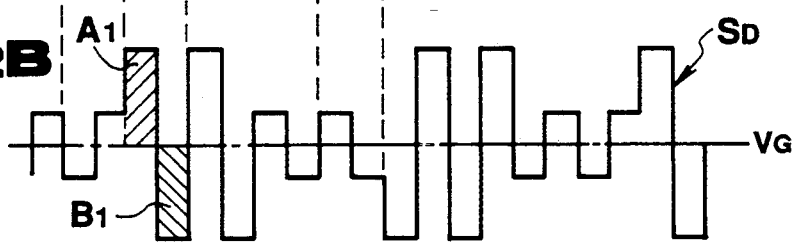
FIG. 12B is a diagram showing the waveform of the data signal used in the method according to the first embodiment of the invention.

FIG. 12A shows the waveform of the scan signal $S_S$ supplied to the second signal line 14 to which the pixels of the second row are electrically connected, and FIG. 12B shows the waveform of the data signal $S_D$ supplied to the opposing electrode 15 to which one of the pixels of the second row is electrically connected.

As is evident from FIG. 12A, the scan signal $S_S$ has a potential $V_1$ for the period $T_S$ during which to select the second row of pixels, and a different potential $V_3$ for the period $T_O$ during which to select any other row of pixels. The period $T_S$, or the selecting period, is obtained by dividing a one-field time $T_F$ by the number of pixel rows provided (i.e., the number of signal lines 14). The potential $V_1$ (selecting potential) is higher than the threshold voltage of the active element 13 (i.e., the diode ring). The potential $V_3$ (non-selecting potential) is lower than the threshold voltage of the active element 13. As can be understood from FIG. 12A, the polarity of the scan signal $S_S$ is inverted once during every one-field period, with respect to a reference potential $V_G$.

The data signal $S_D$ is a rectangle-wave voltage signal whose potential changes in accordance with the image data externally supplied to the liquid-crystal display. More precisely, the potential of the data signal $S_D$ changes once in every selecting period $T_S$, from a positive value to a negative value at the midpoint in the period $T_S$ as is illustrated in FIG. 12B; the potentials which the signal $S_D$ has during the first and second halves of the period $T_S$, respectively, have substantially the same absolute value. Hence, as is evident from FIG.

12B, the first and second halves A1 and B1 of the waveform of the data signal $S_D$ have substantially the same area.

Alternatively, the potential of the signal $S_D$ can change at any other even number of regular intervals in every selecting period $T_S$, each time from a positive value to a negative value, or vice versa, which are substantially identical in absolute value.

Figure 12C:
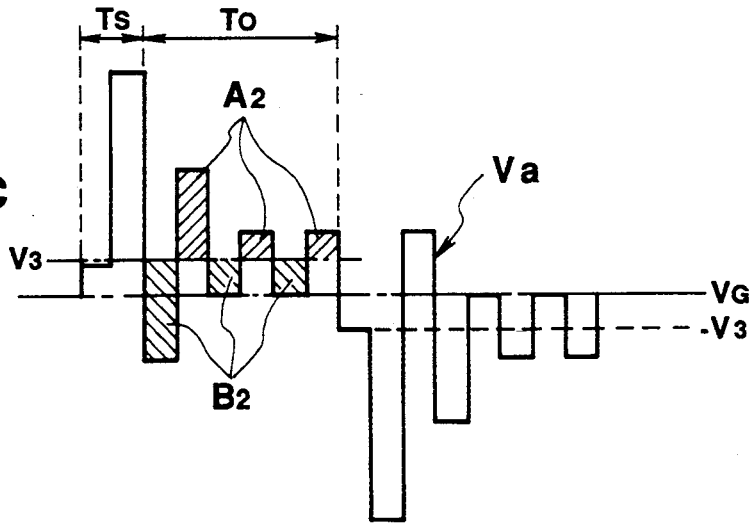
FIG. 12C is a diagram showing how the voltage applied between the input of the active element of one of the LCD elements and one of the opposing electrode of the display shown in FIG. 8 does change when a scan signal and a data signal are supplied to the input of the active element and the opposing electrode, respectively.

When the scan signal $S_S$ and the data signal $S_D$ which have the specific waveform shown in FIGS. 12A and 12B are supplied to the signal line 14 and the opposing electrode 15, respectively, a voltage Va which changes as is shown in FIG. 12C is applied between the opposing electrode 15 and the input terminal of the active element 13 (i.e., the diode ring), that is, between points a and c in the equivalent circuit of FIG. 10. As FIG. 12C suggests, the voltage Va is, so to speak, a difference between the scan signal $S_S$ and the data signal $S_D$.

The voltage Va (hereinafter referred to as "a-c voltage"), which is applied between the opposing electrode 15 and the input terminal of the diode ring, increases during the selecting period $T_S$, to a high value which is the difference between the selecting potential $V_1$ and the potential of the data signal $S_D$. During the non-selecting period $T_O$, the a-c voltage Va changes at mid-point in every period as long as the selecting period $T_S$, from a value negative with respect to the non-selecting potential $V_3$, to a value positive with respect to the non-selecting potential $V_3$. As is shown in FIGS. 12C, the negative and positive values are substantially identical in absolute value. Hence, the total area of the rectangles A2, i.e., the positive-side portions of the waveform of the a-c voltage Va, is substantially equal to that of the rectangles B2, i.e., the negative-side portions of the waveform of the a-c voltage Va.

The a-c voltage Va changes during the selecting period $T_S$, too. Nonetheless, it is lower or higher than the reference voltage $V_G$ (i.e., the reference potential for both the scan signal $S_S$ and the data signal $S_D$) by the value determined by the data signal $S_D$. This is because the scan signal $S_S$ has so high a potential as is shown in FIG. 12A during the selecting period $T_S$.

Figure 13:
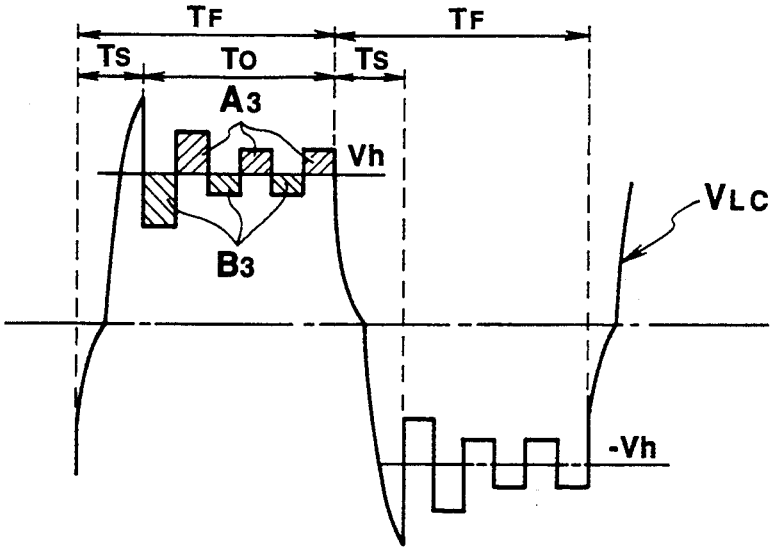
FIG. 13 is a diagram illustrating how the voltage applied between one of pixel electrodes of the display shown in FIG. 8 and the opposing electrode overlapping this pixel does change when the voltage having the waveform shown in FIGS. 12C is applied between the input of the active element and the opposing electrode.

When the a-c voltage Va is applied between the input of the active element 13 and the opposing electrode 15, a voltage $V_{LC}$ having the waveform shown in FIG. 13 is applied between the pixel electrode 12 connected to the element 13 and the opposing electrode 15—that is, between points b and c in the equivalent circuit of FIG. 10. Thus, during the first half of the selecting period $T_S$, the potential difference between the input and output terminals of the diode ring 13 (i.e., the active element 13) increases above the threshold voltage of the diode ring 13. The diode ring 13 is thereby turned on, applying a voltage between the pixel electrode 12 and the opposing electrode 15. As a result, the pixel capacitor $C_{LC}$ starts accumulating charge.

In the latter half of the selecting period $T_S$, a higher voltage is applied between points a and c (FIG. 10). As a result, the voltage applied between the pixel electrode 12 and the opposing electrode 15 rises fast, and the pixel capacitor $C_{LC}$ is charged abruptly. The potential of the pixel is thereby increased to the high value which corresponds to the data signal $S_D$. The voltage applied between the electrodes 12 and 15 during the selecting period $T_S$ is determined by three factors, i.e., the voltage $V_3$ applied between points a and c during the period $T_S$, the current the diode ring 13 can supply, and the length of the selecting period $T_S$.

At the start of the non-selecting period $T_O$, the pixel capacitor $C_{LC}$ has already reached a higher value, and the a-c voltage Va has decreased. The diode ring 13 is thereby turned off, and the charging of the pixel capacitor $C_{LC}$ stops. When the diode ring 13 is turned off, it becomes equivalent to a capacitor having capacitor $C_D$. Hence, the decrease in the a-c voltage Va is divided by the element capacitor $C_D$ (i.e., the capacitance of the diode ring 13) and the pixel capacitor $C_{LC}$. (It should be noted that the decrease in the voltage Va is the difference between the potential during the selecting period $T_S$ of the scan signal and the potential during the non-selecting period $T_O$ thereof.)

Therefore, at the start of the non-selecting period $T_O$, the voltage $V_{LC}$ applied between the electrodes 12 and 15 falls from the value it had during the selecting period $T_S$ to voltage Vh, by that decrease in the a-c voltage Va which corresponds to the pixel capacitance $C_{LC}$. This voltage Vh (hereinafter referred to as "hold voltage") is held by the pixel capacitor $C_{LC}$. (The decrease in the a-c voltage Va is one of the two voltages obtained by dividing the decrease in the voltage Va by the element capacitance $C_D$ and the pixel capacitance $C_{LC}$, which corresponds to the pixel capacitance $C_{LC}$.) How much the voltage $V_{LC}$ falls depends on the ratio of the pixel capacitance $C_{LC}$ to the element capacitance $C_D$. Hence, to reduce the decrease in the voltage $V_{LC}$, it suffices to set the element capacitance $C_D$ at about 10% of the pixel capacitance $C_{LC}$.

During the non-selecting period $T_O$, the scan signal supplied to the signal line 14 is at the non-selecting potential $V_3$. However, the a-c voltage Va changes during the non-selecting period $T_O$, too, in accordance with the data signal $S_D$ supplied to the opposing electrode 15 for driving all pixels of the same column.

Consequently, the $V_{LC}$ voltage applied between the pixel electrodes 12 and 15 during the non-selecting period $T_O$, i.e., the voltage held in the pixel capacitor $C_{LC}$, changes by that change in the a-c voltage Va which corresponds to the pixel capacitance $C_{LC}$, just as it does at the start of the non-selecting period $T_O$. (Said change in the a-c voltage Va is one of the two voltages obtained by dividing the change in the voltage Va by the element capacitance $C_D$ and the pixel capacitance $C_{LC}$, which corresponds to the pixel capacitance $C_{LC}$.)

Thus, during the non-selecting period $T_O$, there is applied to the pixel a non-selecting voltage which is a combination of the hold voltage Vh and the voltage change corresponding to the pixel capacitance $L_{LC}$. The hold voltage Vh is a reference voltage equal to a voltage applied between the electrodes 12 and 15 at the end of the selecting period $T_S$, and the voltage change referred to in the preceding paragraph is a value by which the voltage $V_{LC}$ changes due to the data signal supplied to the pixels of other rows.

Since the scan signal $S_S$ and the data signal $S_D$ have the waveforms shown in FIGS. 12*a* and 12B, respectively, the voltage applied between the input of the diode ring 13 and the opposing electrode 15 (i.e., the voltage applied between points a and c) has such a waveform as is shown in FIG. 12C. Therefore, the non-selecting voltage $V_3$ applied between the pixel electrode 2 and the opposing electrode 15 during the non-selecting period $T_O$ repeatedly changes as is shown in FIG. 13 at regular intervals of half the selecting period $T_S$, each time from a value positive to the voltage Vh, to a value negative to the voltage Vh, or vice versa.

As evident from FIG. 13, the positive and negative components of the non-selecting voltage $V_3$ have substantially the same amplitude (i.e., a value by which the voltage $V_{LC}$ changes due to the data signal supplied to the pixels of other rows).

Hence, as is evident from FIG. 13, the non-selecting voltage applied between the pixel electrode 12 and the opposing electrode 15 during the non-selecting period $T_O$ has such a waveform that the components $A_3$ positive with respect to the hold voltage Vh have a total area substantially equal to that of the components $B_3$ negative with respect to the voltage Vh.

Upon lapse of the non-selecting period $T_O$, or at the start of the next selecting period $T_S$, a voltage is applied between the input of the diode ring 13 and the opposing electrode 15, or between points a and c (FIG. 10). This voltage is higher than the threshold voltage of the diode ring 13 and has the potential opposite to that of the voltage applied during the previous selecting period T. Hence, the diode ring 13 is turned on again, whereby a voltage is applied between the pixel electrode 12 and the opposing electrode 15. An electric charge of the opposite polarity is thereby accumulated in the pixel capacitance $C_{LC}$. Thereafter, the operation sequence described above is repeated to drive any other active matrix LCD element.

In the method described above, the voltage applied between the pixel electrode 12 and the opposing electrode 15 during the selecting period $T_S$ is either a positive voltage or a negative voltage, and the voltage applied between these electrodes during the non-selecting period is a voltage which has such a waveform that the components $A_3$ positive with respect to the hold voltage Vh have a total area substantially equal to that of the components $B_3$ negative with respect to the voltage Vh. Therefore, the positive components $A_3$ cancel out the negative components $B_3$. Hence, the voltage $V_{LC}$ applied between the pixel electrode 12 and the opposing electrode 15 is virtually not changed, set at the hold voltage Vh, during the non-selecting period $T_O$. The transmittance of the pixel is maintained at the value determined by the held voltage Vh which in turn is determined by the selecting voltage applied during the selecting period $T_S$. It is therefore possible to control the transmittance of each pixel in accordance with the selecting voltage, whereby the liquid-crystal display can display a gray-scale image.

Figure 14:
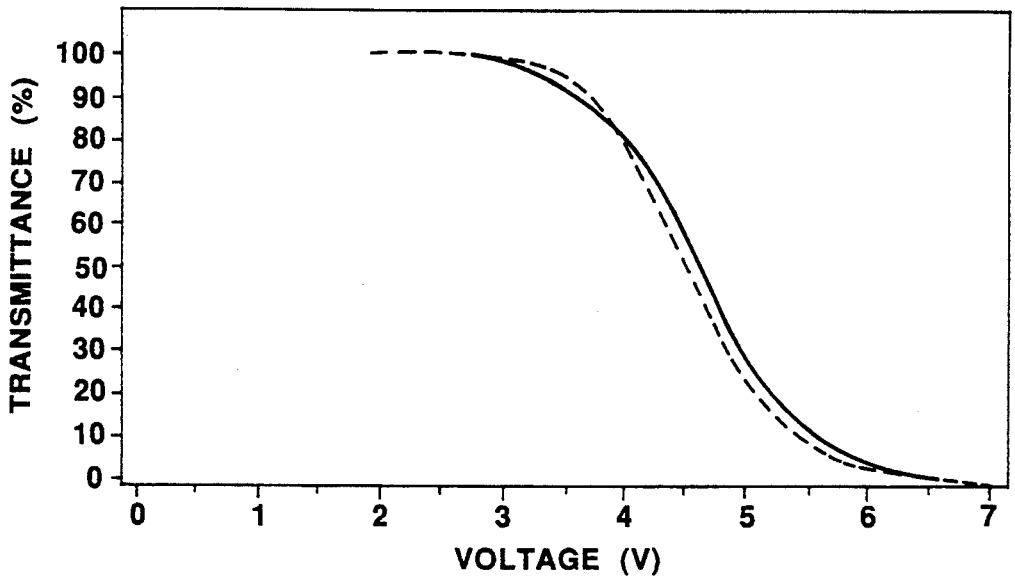
FIG. 14 is a graph showing the voltage-transmittance characteristic of any pixel driven by the method according to the first embodiment of the present invention.

FIG. 14 shows the voltage-transmittance (V-T) characteristic of any pixel driven by the first method according to the present invention. In this figure, the broken-line curve indicates the V-T characteristic each pixel has when no voltage is applied to all other pixels of the same column, whereby the other pixels transmit light. The solid curve shown in FIG. 14 represents the V-T characteristic each pixel has when a voltage is applied to all other pixels of the same column, whereby the other pixels transmit no light.

As can be understood from FIG. 14, the pixel exhibits almost the same V-T characteristic, whether a voltage is applied or not to the other pixels of the same column. A difference of only 5% is observed between the transmittance which the pixel has when a voltage is applied the other pixels of the same column and the transmittance it has when no voltage is applied to the other pixels of the same column. In other words, the V-T characteristic of each pixel is scarcely influenced by the condition in which the other pixels of the same column are driven. The transmittance of each pixel can, therefore, be correctly controlled by the selecting voltage applied during the selecting period $T_S$.

Hence, the first method of the invention, described above, is advantageous over the conventional method in which the transmittance of each pixel changes greatly in accordance with the condition of driving the other pixels of the same column, as is illustrated in the graph of FIG. 7.

In the first method of the invention, the selecting voltage applied between the pixel electrode 12 and the opposing electrode 15 during the selecting period $T_S$ is of a positive polarity or a negative polarity in accordance with the data signal $S_D$. Hence, an electric charge of the polarity determined by the value of the data signal $S_D$ is accumulated between the electrodes 12 and 15 during the selecting period $T_S$. In other words, the pixel is charged throughout the selecting period $T_S$, for a sufficiently long time. Hence, the inter-electrode voltage of the pixel can be adequately high, not restricted by the ability (i.e., the ability of flowing a current) of the active element 13 associated with the pixel.

The first method according to this invention is advantageous over the conventional method in another respect.

In the conventional method, the V-T characteristic of each pixel is much influenced by the condition in which the other pixels are driven. To minimize this change in the V-T characteristic of the pixel, it is necessary to use an active element (i.e., a diode ring) having a considerably small capacitance, thereby to reduce very much that portion of the change in the voltage applied between the input of the active element and the opposing electrode, which corresponds to the pixel capacitance. (Said change in the voltage has been caused by the data signal $S_D$ to drive the other pixels.) To this end, use is made of a diode ring which comprises two diodes having a small area and which therefore has a small capacitance, or a diode ring which comprises more diodes orientated in the opposite directions and connected in series and which therefore has a small capacitance. To manufacture diodes having a small area, high-precision patterning is required, however. If more diodes are orientated in the opposite directions, the resultant diode ring will occupy a larger area, inevitably decreasing the area allocated for the pixel electrode.

By contrast, in the first method of the present invention, it does not matter if the non-selecting voltage changes somewhat greatly. This is because the positive components of the non-selecting voltage cancel out the negative components thereof. It is therefore unnecessary to reduce very much that portion of the change in the voltage applied between the input of the active element 13 and the opposing electrode 15, which corresponds to the pixel capacitance $C_{LC}$. Thus, it suffices to set $C_D/C_{LC}$ (i.e., the ratio of the element capacitance $C_D$ to the pixel capacitance $C_{LC}$) at a value (e.g., about 1/10) great enough to limit the voltage drop which occurs when the capacitance divides the voltage at the start of the non-selecting period $T_O$. Hence, the diodes of each diode ring 13 can be those having a large area, and can therefore be made, requiring no high-precision patterning process. Also is it possible to form each diode ring 13 of less diodes orientated in the opposite directions, thereby reducing the area occupied by the diode ring 13 and proportionally increasing the area of the pixel electrode 12, whereby the active matrix LCD element has a greater aperture rate.

Second Embodiment

In the first embodiment of the invention, i.e., the first method of driving the active matrix LCD elements of a liquid-crystal display, the non-selecting voltage applied between the pixel electrode 12 and the opposing electrode 15 during the non-selecting period $T_O$ changes at regular intervals and has such a waveform that the components positive with respect to the hold voltage Vh have a total area substantially equal to that of the components negative with respect to the voltage Vh. The regular intervals are equal to those at which the voltage applied between the electrodes 12 and 15 changes during the selecting period $T_S$ at any even number of times, and the hold voltage Vh is the value which said voltage has at the end of the selecting period $T_S$. Nonetheless, according to the present invention, the non-selecting voltage can have any other waveform, provided that the components positive with respect to the hold voltage Vh have a total area substantially equal to that of the components negative with respect to the hold voltage Vh.

Figures 15A, 15B, 15C:
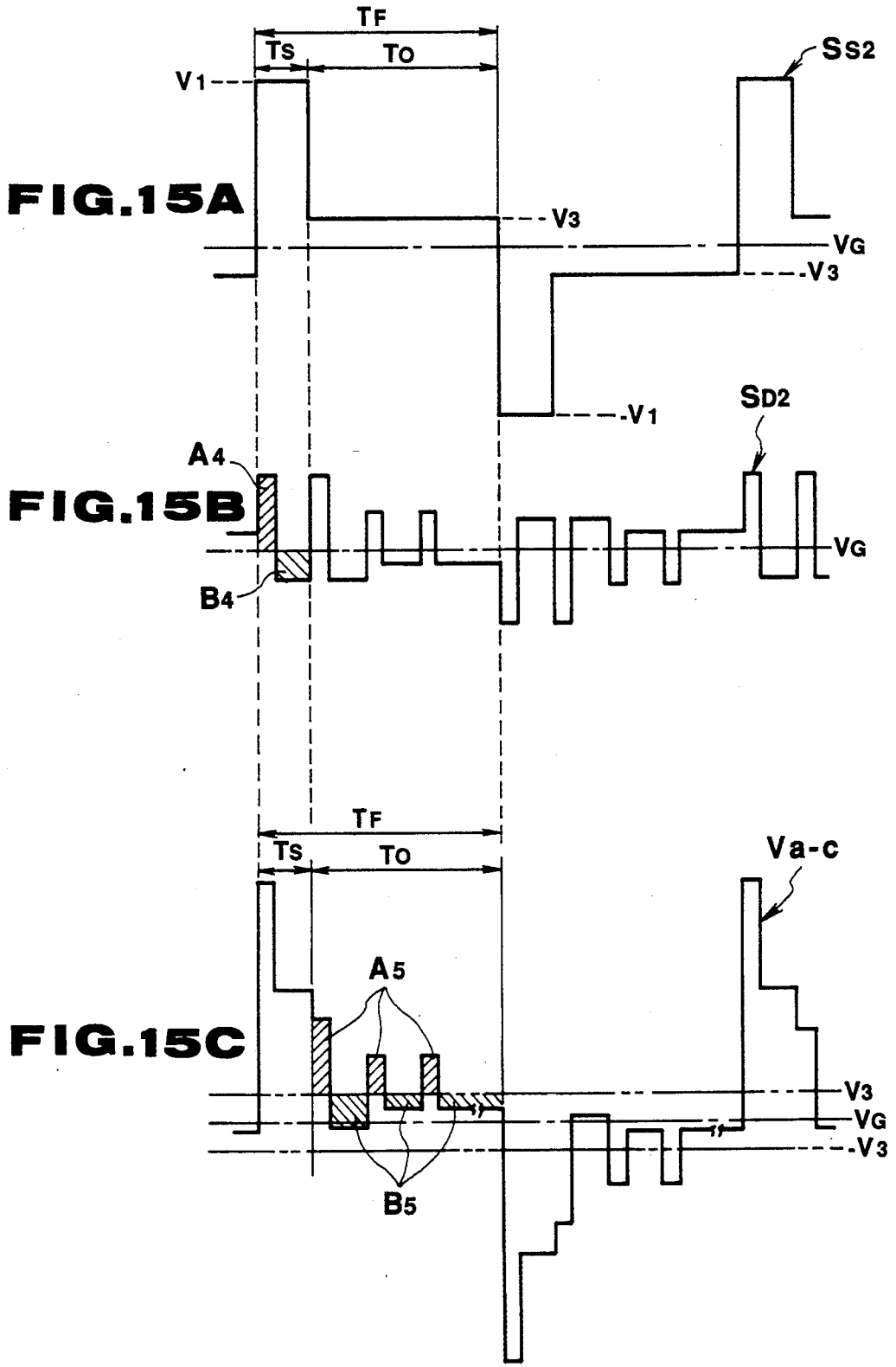
FIG. 15A is a diagram showing the waveform of a scan signal used in the method according to a second embodiment of the invention.
FIG. 15B is a diagram showing the waveform of a data signal used in the method according to the second embodiment of the invention.
FIG. 15C is a diagram showing how the voltage applied between the input of the active element of one of the LCD elements and one of the opposing electrode of the display shown in FIG. 8 does change when a scan signal and a data signal are supplied to the input of the active element and the opposing electrode, respectively.

In the method according to a second embodiment of the invention (to be referred as "second method"), scan signals $S_{S2}$ having the waveform shown in FIG. 15A are supplied to the signal lines 14 of the liquid-crystal display shown in FIG. 8, and data signals $S_{D2}$ having the waveform shown in FIG. 15B are supplied to the opposing electrodes 15 of the liquid-crystal display. As can be understood from FIG. 15B, the scan signal $S_{S2}$ is identical to the scan signal $S_S$ shown in FIG. 12A, which is used in the first embodiment of the invention.

As is evident from FIG. 15B, the data signal $S_{D2}$ is a rectangle-wave voltage signal whose potential changes in accordance with the image data externally supplied to the liquid-crystal display. More precisely, the potential of the data signal $S_{D2}$ changes once in every selecting period $T_S$. The signal $S_{D2}$ is at a value positive to the reference potential $V_G$ for the initial short part of the selecting period $T_S$, and then at a value negative to the potential $V_G$ for the remaining longer part of the period $T_S$. The positive and negative parts of the data signal $S_{D2}$ are different in absolute potential value.

The positive potential at which the data signal $S_{D2}$ remains during the initial short part of the selecting period $T_S$ is controlled by the image data externally supplied. This positive potential (hereinafter referred to as "data potential") has a waveform having an area $A_4$ and is determined by the image data. The negative potential at which the signal $S_{D2}$ remains during the remaining longer part of the period $T_S$ (hereinafter referred to as "non-data potential") is controlled such that it has a waveform having an area $B_4$ substantially the same as the area $A_4$ of the waveform of the data potential.

When the scan signal $S_{S2}$ and the data signal $S_{D2}$ which have the waveforms shown in FIGS. 15A and 15B are supplied to the signal line 14 and the opposing electrode 15, respectively, a voltage Va which changes as is shown in FIG. 15C is applied between the opposing electrode 15 and the input terminal of the active element 13 (i.e., the diode ring), that is, between points a and c in the equivalent circuit of FIG. 10. As FIG. 15C suggests, the voltage Va-c is a combination of the scan signal $S_{S2}$ and the data signal $S_{D2}$.

As is shown in FIG. 15C, the voltage Va-c (hereinafter referred to as "a-c voltage") increases, at the start of the selecting period $T_S$, to a high value which is the difference between the selecting potential $V_1$ of the scan signal $S_{S2}$ and the data potential of the data signal $S_{D2}$. The a-c voltage Va-c remains at the high value for the initial short part of the period $T_S$, Then, the a-c voltage Va-c decreases to a low value and remains at this low value for the remaining part of the period $T_S$ which is longer than the initial part. The low value is the difference between the selecting potential V1 of the scan signal $S_{S2}$ and the non-data potential of the data signal $S_{D2}$ (i.e., the negative potential which the data signal $S_{D2}$ has during the second part of the period $T_S$).

During the non-selecting period $T_O$, the a-c voltage Va-c changes several times at the same irregular intervals as in the selecting period $T_S$, each time from a value positive with respect to the non-selecting potential $V_3$ of the scan signal $S_{S2}$, to a value negative with respect to the non-selecting potential $V_3$. As is shown in FIG. 15C, in every sub-period of the non-selecting period $T_O$, which is equal to the selecting period $T_S$, the positive component of the a-c voltage Va-c has a greater absolute value than the negative component of the a-c voltage Va-c. However, since the first part of the sub-period is shorter than the second part thereof, the total area of the rectangles A5, i.e., the positive-side portions of the waveform of the a-c voltage Va-c, is substantially equal to that of the rectangles B5, i.e., the negative-side portions of the waveform of the a-c voltage Va-c.

The a-c voltage Va-c changes during the selecting period $T_S$, too. Nonetheless, it has one polarity with respect to the reference voltage $V_G$ (i.e., the reference potential for both the scan signal $S_{S2}$ and the data signal $S_{D2}$), and has the values determined by the data potential and non-data potential of the data signal $S_{D2}$.

Figure 16:
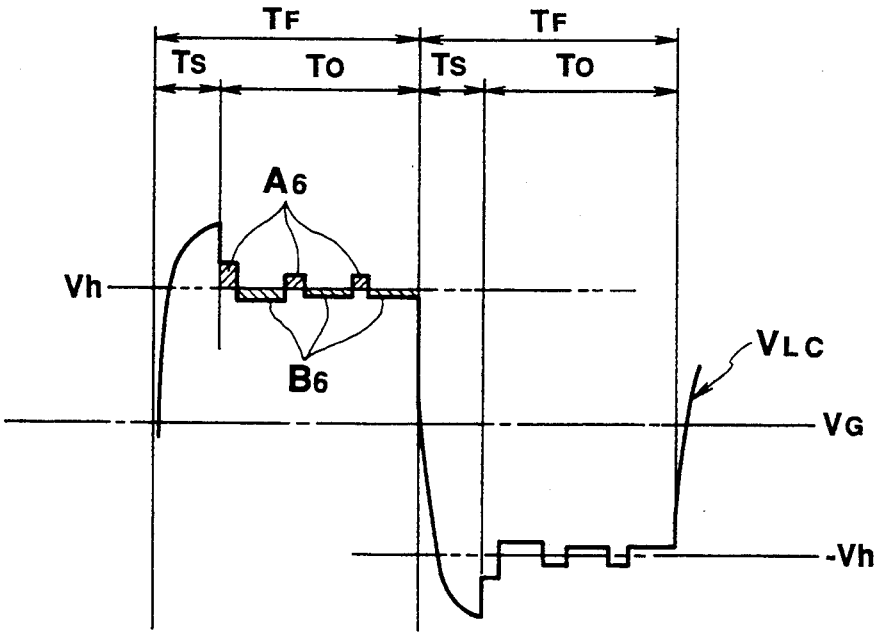
FIG. 16 is a diagram illustrating how the voltage applied between one of pixel electrodes of the display shown in FIG. 8 and the opposing electrode overlapping this pixel does change when the voltage having the waveform shown in FIGS. 15C is applied between the input of the active element and the opposing electrode.

When the a-c voltage Va-c is applied between the input of the active element 13 and the opposing electrode 15, a voltage $V_{LC}$ having the waveform shown in FIG. 16 is applied between the pixel electrode 12 connected to the element 13 and the opposing electrode 15—that is, between points b and c in the equivalent circuit of FIG. 10. The diode ring 13 is thereby turned on, applying a voltage between the pixel electrode 12 and the opposing electrode 15. As a result, the pixel capacitor $C_{LC}$ starts accumulating charge.

Since the a-c voltage Va-c has the waveform shown in FIG. 15C, the voltage applied between the pixel electrode 12 and the opposing electrode 15 rises fast during the first (or initial) part of the selecting period $T_S$, and the pixel capacitor $C_{LC}$ is charged abruptly. The potential of the pixel is thereby increased to the high value which corresponds to the data signal $S_{D2}$. During the remaining part of the selecting period $T_S$, the a-c voltage Va-c decreases, whereby the pixel capacitor $C_{LC}$ is charged slowly.

At the start of the non-selecting period $T_O$, the pixel capacitor $C_{LC}$ has already reached a higher value, and the a-c voltage Va-c has decreased. The diode ring 13 is thereby turned off. When the diode ring 13 is turned off, it becomes equivalent to a capacitor having capacitor $C_D$. Hence, the decrease in the a-c voltage Va-c is divided by the element capacitance $C_D$ and the pixel capacitor $C_{LC}$. Therefore, at the start of the non-selecting period $T_O$, the voltage $V_{LC}$ applied between the electrodes 12 and 15 falls to voltage Vh, by the that part of the decrease in the a-c voltage Va-c which corresponds to the pixel capacitance $C_{LC}$. This voltage Vh (hereinafter referred to as "hold voltage") is held in the pixel capacitor $C_{LC}$.

In this embodiment, too, the voltage Va-c changes during the non-selecting period $T_O$ in accordance with the image data supplied to the other pixels. The non-selecting voltage applied between the pixel electrodes 12 and 15 during the non-selecting period $T_O$, therefore, changes by the value equivalent to that decrease in the a-c voltage Va-c which corresponds to the pixel capacitance $C_{LC}$ and which is determined by the ratio of the pixel capacitance $C_{LC}$ to the element capacitor $C_D$.

Hence, as is evident from FIG. 16, the non-selecting voltage applied between the pixel electrode 12 and the opposing electrode 15 during the non-selecting period $T_O$ has such a waveform that the components $A_6$ positive with respect to the hold voltage Vh have a total area substantially equal to that of the components $B_6$ negative with respect to the voltage Vh.

In the second method described above, even if the non-selecting voltage, which is applied between the pixel electrode 12 and the opposing electrode 15 during the non-selecting period $T_O$ to drive the pixel, changes due to the data signal supplied to the other pixels, the positive components A6 cancel out the negative components B6. Hence, the voltage $V_{LC}$ applied between the pixel electrode 12 and the opposing electrode 15 during the non-selecting period $T_O$ is virtually not changed, set at the hold voltage Vh. Therefore, the transmittance of the pixel is maintained at the value determined by the hold voltage Vh which in turn is determined by the selecting voltage applied during the selecting period $T_S$. It is therefore possible to control the transmittance of each pixel in accordance with the selecting voltage, whereby the liquid-crystal display can display a multi-gray-scale image.

Applications of First and Second Methods

Figure 17:
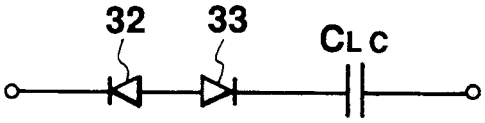
FIG. 17 is an equivalent circuit diagram showing an active element and any pixel of the liquid-crystal display, which can be driven by the method according to the second embodiment of the invention.

The first and second methods of the invention can be applied to drive not only active matrix LCD elements whose active elements are diode rings, but also active matrix LCD elements whose active elements are of so-called "back-to-back structure," each comprising two thin-film diodes 32 and 33 connected in series and orientated in the opposite directions as is shown in FIG. 17.

Figure 18:
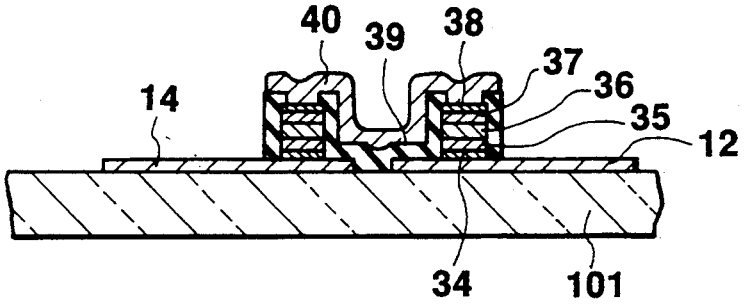
FIG. 18 is a cross-sectional view showing one of the thin-film diode rings shown in FIG. 17.

The thin-film diodes 32 and 33, which forms a back-to-back structure, have the structure shown in FIG. 18. As is evident from FIG. 18, the diodes 32 and 33 are mounted on the pixel electrode 12 and the signal line 14, respectively. Either thin-film diode comprises a metal film 34, a P-type semiconductor film 35, an I-type semiconductor film 36, an N-type semiconductor film 37, and a metal film 38, which are formed, one on another, in the order shown in FIG. 18. All these films, except for the upper metal film 38, are covered with an insulating film 39. The metal films 38 of the diodes 32 and 33 are connected by a conductor film 40, whereby the diodes 32 and 33 are connected in series, forming the back-to-back structure.

The first and second methods of the invention can also be applied to drive active matrix LCD elements whose active elements are thin-film transistors (TFTs), each being a three-terminal semiconductor element.

Figure 19:
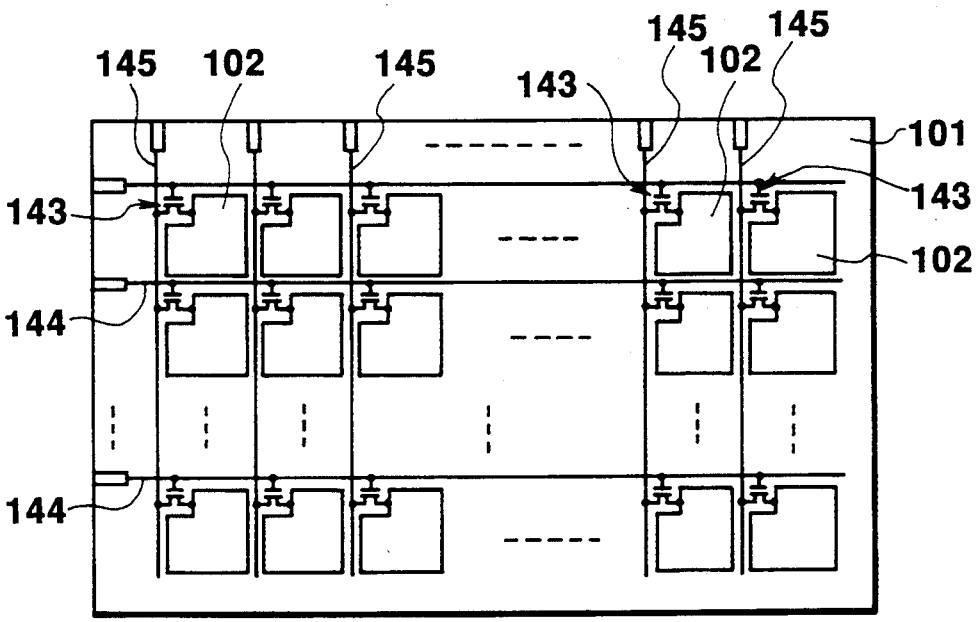
FIG. 19 is a plan view schematically showing active matrix LCD elements having an active element each, which can be driven by the method according to a third embodiment of the present invention.

FIG. 19 shows part of a liquid-crystal display having active matrix LCD elements whose active elements are thin-film transistors. As is shown in FIG. 19, this display comprises a pair of transparent substrates, a liquid-crystal layer (not shown) interposed between the substrates, scan-signal lines 144 extending parallel in row direction, data-signal lines 145 extending parallel in column direction, and opposing electrodes (not shown) formed on the inner surface of the second transparent substrate (not shown) and extending parallel in the column direction. The liquid-crystal display further comprises pixel electrodes 102 formed on the inner surface of the first substrate 101 and arranged in rows and columns, and active elements 143 formed on the inner surface of the first substrate 102 and arranged in rows and columns. The active elements 143 are thin-film transistors (TFTs), each associated with one pixel electrode 102. The source, gate and drain of each TFT are connected to the associated pixel electrode 102, the associated scan-signal line 144, and the associated data-signal line 145, respectively. The pixel of each active matrix LCD element is formed of a pixel electrode 102, that portion of an opposing electrode which is overlapping the pixel electrode 102, and that portion of the liquid-crystal layer which is sandwiched between the pixel electrode 102 and said portion of the opposing electrode.

In operation, a predetermined reference voltage is applied to the opposing electrodes at all times. Scan signals, which are phase-shifted sequentially, are supplied via the scan-signal lines 143 to the rows of TFTs, thereby selecting the rows of pixels sequentially. Meanwhile, data signals, which are synchronous with the scan signals, are supplied through the data-signal liens 14 to the columns of TFTs. As a result, the active matrix LCD elements of the display shown in FIG. 19 are driven in time-division fashion. Hence, a selecting voltage, which has a positive or negative polarity according to the data signal, is applied between the pixel electrode 102 and the opposing electrode which form any pixel during a selecting period during which this pixel is selected. During a non-selecting period during which the other pixels are selected, the hold voltage is maintained between the pixel electrode 102 and the opposing electrode. The non-selecting voltage has such a waveform that the two components positive and negative with respect to the voltage applied between the electrodes at the end of the selecting period have substantially the same area. Thus, the transmittance change of each pixel, which occurs due to the data signals supplied to the other pixels during the non-selecting period, can be minimized as in the first and second methods. It is therefore possible to control the transmittance of each pixel in accordance with the selecting voltage, whereby the liquid-crystal display can display a gray-scale image.

Third Embodiment

The method according to a third embodiment of the invention (to be referred as "third method") will now be described. The third method is designed to drive active matrix LCD elements of the liquid-crystal display shown in FIGS. 8 and 9, thereby to display a multi-gray-scale image. The third method is characterized in that the widths of pulses of a data signal are changed in accordance with externally supplied image data.

With reference to FIGS. 8 and 9, FIGS. 20A to 20D, FIGS. 21A and 21B, and FIGS. 22A and 22B, it will be explained how the LCD elements are driven to display a multi-gray scale image.

FIGS. 20A to 20D, FIGS. 21A and 21B, and FIGS. 22A and 22B are diagram showing the waveforms of the various drive signals used in the third method, wherein the pulse widths of data signals are changed in accordance with externally supplied image data, thereby to control the gray-levels of the pixels.

Figures 20A, 20B, 20C, 20D:
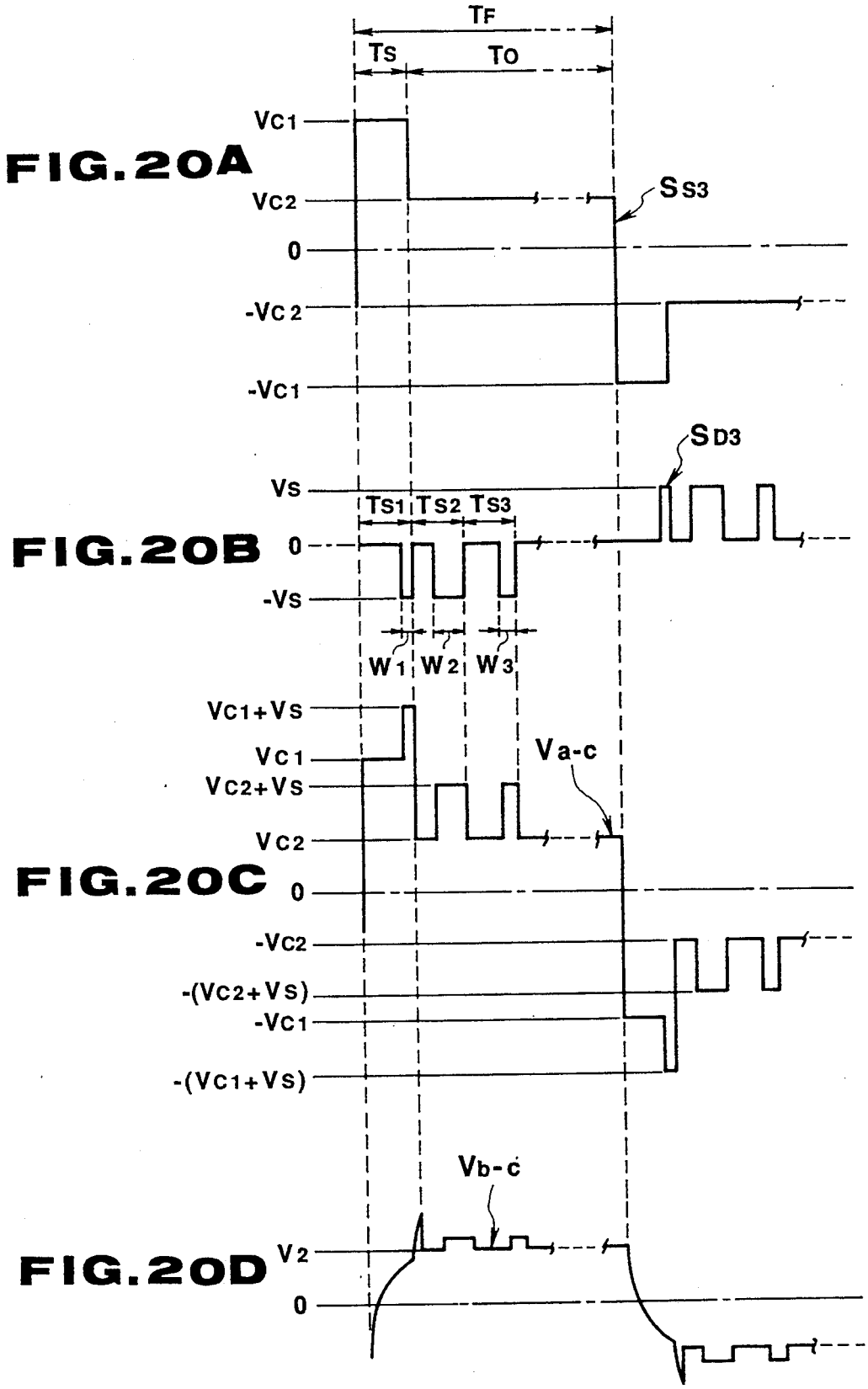
FIG. 20A is a diagram showing the waveform of a scan signal used in the third method of the present invention.
FIG. 20B is a diagram representing the waveform of a data signal used in the third embodiment of the present invention.
FIG. 20C is a diagram showing how the voltage applied between the input of an active element and an opposing electrode changes when the scan signal of FIG. 20A and the data signal of FIG. 20B are supplied to the opposing electrode and a signal line and the opposing electrode, respectively.
FIG. 20D is a diagram indicating how the voltage applied between a pixel electrode and the opposing electrode changes when the voltage having the waveform of FIG. 20C is applied between the input of the active element and the opposing electrode.

FIG. 20A shows the waveform of a scan signal $S_{S3}$ supplied to one of the opposing electrode 15. FIG. 20A illustrates the waveform of a data signal $S_{D3}$ supplied to one of the signal lines 14. FIG. 20C shows the waveform of a voltage Va-c applied between the input of one of the active elements 13 (i.e., the node of the element 13 and the signal line 14) and the opposing electrode 15—that is, between points a and c in the equivalent circuit shown in FIG. 10. In FIGS. 20A to 20C, $T_S$ is a selecting period, obtained by dividing a one-field period $T_F$ by the number of signal lines 14 provided.

As is clearly seen from FIG. 20A, the scan signal $S_{S3}$ remains at a selecting potential $V_{C1}$ during the selecting period $T_S$ and at a non-selecting potential $V_{C2}$ during a non-selecting period $T_O$. The scan signal $S_{S3}$ has its polarity altered at the end of every one-field period $T_F$.

As is evident from FIG. 20B, the data signal $S_{D3}$ has pulses whose widths change in accordance with the image data externally supplied. The data signal $S_{D3}$ has the polarity which is opposite to that of the scan signal $S_{S3}$ supplied to the opposing electrode 15. The pulses of the data signal $S_{D2}$ have the same absolute potential value $V_S$, and their polarities alter every one-field period $T_F$. The first data pulse for selecting the first opposing electrode 15 for a period $T_{S1}$ has a width W1 which is 2/10 of the selecting period $T_S$. The second data pulse for selecting the second opposing electrode 15 for a period $T_{S2}$ has a width W2 which is 6/10 of the selecting period $T_S$. The third data pulse for selecting the third opposing electrode 15 for a period $T_{S3}$ has a width W3 which is 3/10 of the selecting period $T_S$. These pulse widths W1, W2, and W3 change over a range from 0 (i.e., no pulse) to $T_S$ (i.e., the value equal to the period $T_S$).

When the scan signal $S_{S3}$ and the data signal $S_{D3}$, which have the waveform shown in FIGS. 15A and 15B, are supplied to the opposing electrode 15 and the signal line 14, respectively, a voltage Va-c having the waveform shown in FIG. 20C is applied between the input of the active element 13 connected to the first signal line 14 and the opposing electrode 15. As can be understood from FIG. 20C, the voltage Va-c is corresponds to the potential difference between these signals $S_{S3}$ and $S_{D3}$.

Of the the voltage Va-c applied between the input of the active element 13 and the opposing electrode 15, that part applied during the selecting period $T_S$, i.e., the selecting voltage, is at the selecting potential $V_{C1}$ of the scan signal $S_{S3}$ while the data signal $S_{D3}$ remains at zero potential, and is at the voltage of $V_{C1}+V_S$ (i.e., the sum of the selecting voltage $V_{C1}$ of the scan signal $S_{S3}$ and the potential $V_S$ of the data pulse) while the data signal $S_{D3}$ remains at the data-pulse potential $-V_S$. The selecting voltage $V_{C1}$ (hereinafter referred to as "ON-selecting voltage"), which is applied while the data signal $S_{S3}$ is at zero potential, is higher than the threshold voltage of the diodes 23 and 24 forming the active element 13 (i.e., the diode ring). Needless to say, the selecting voltage $V_{C1}+V_S$, which is applied while the data signal $S_{D3}$ is at the data-pulse potential $-V_S$, is higher than the ON-selecting voltage $V_{C1}$.

The voltage (i.e., the non-selecting voltage), which is applied between the input of the active element 13 and the opposing electrode 15 during the non-selecting period $T_O$, is at the non-selecting potential $V_{C2}$ of the scan signal $S_{S3}$ while the data signal $S_{D3}$ remains at zero potential, and is at the voltage of $V_{C2}+V_S$ (i.e., the sum of the non-selecting voltage $V_{C2}$ of the scan signal $S_{S3}$ and the potential $V_S$ of the data pulse) while the data signal $S_{D3}$ remains at the data-pulse potential $-V_S$. This voltage, $V_{C2}+V_S$, is lower than the ON-selecting voltage $V_{C1}$ which is applied during the selecting period $T_S$.

When the composite voltage having the waveform of FIG. 20C is applied between the input of the element 13 and the opposing electrode 15, the voltage Vb-c applied between the pixel electrode 12 and the opposing electrode 15 changes as is shown in FIG. 20D. More specifically, the voltage Vb-c gradually rises during the greater part of the selecting period $T_S$, and then abruptly increases during the remaining part of the selecting period $T_S$ due to the selecting voltage $V_{C1}+V_S$ applied between the input of the element 13 and the opposing electrode 15 during the remaining part of the selecting period $T_S$.

Upon lapse of the non-selecting period $T_O$, or at the start of the next selecting period $T_S$, the voltage across the pixel capacitance $C_{LC}$ decreases to a voltage $V_2$. This voltage $V_2$ is sustained between the pixel electrode 12 and the opposing electrode 15.

Figures 21A, 21B:
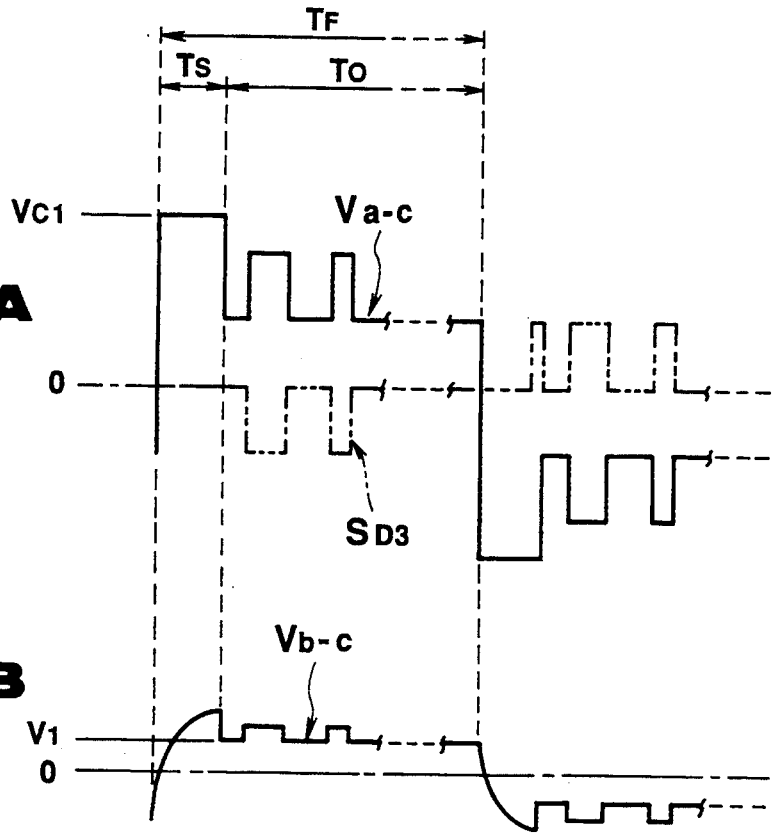
FIGS. 21A and 21B are diagrams showing the waveforms of two voltages applied between the input of the active element and the opposing electrode and between the pixel electrode and the opposing electrode, thereby to drive, by the third method, the active matrix LCD element at 0/10 gray-level.

In order to drive the active matrix LCD element at 0/10 gray-level, a composite voltage having the waveform shown in FIG. 21A is applied between the input of the active element 13 and the opposing electrode 15. In this case, as is shown in FIG. 21B, the voltage Vb-c applied between the pixel electrode 12 and the opposing electrode 15 gradually rises throughout the selecting period $T_S$ in accordance with the ON-selecting voltage $V_{C1}$.

Upon lapse of the selecting period $T_S$, or at the start of the non-selecting period $T_O$, the active element 13 is turned off. The voltage across the pixel capacitor $C_{LC}$ decreases from the voltage charged the period $T_S$, to a voltage V1, by that decrease in the voltage Va-c which corresponds to the element capacitance $C_D$ (i.e., one of the two voltages obtained by dividing the change in the voltage Va-c by the element capacitance $C_D$ and the pixel capacitance $C_{LC}$). This voltage V1 is held between the pixel electrode 12 and the opposing electrode 15.

Figures 22A, 22B:
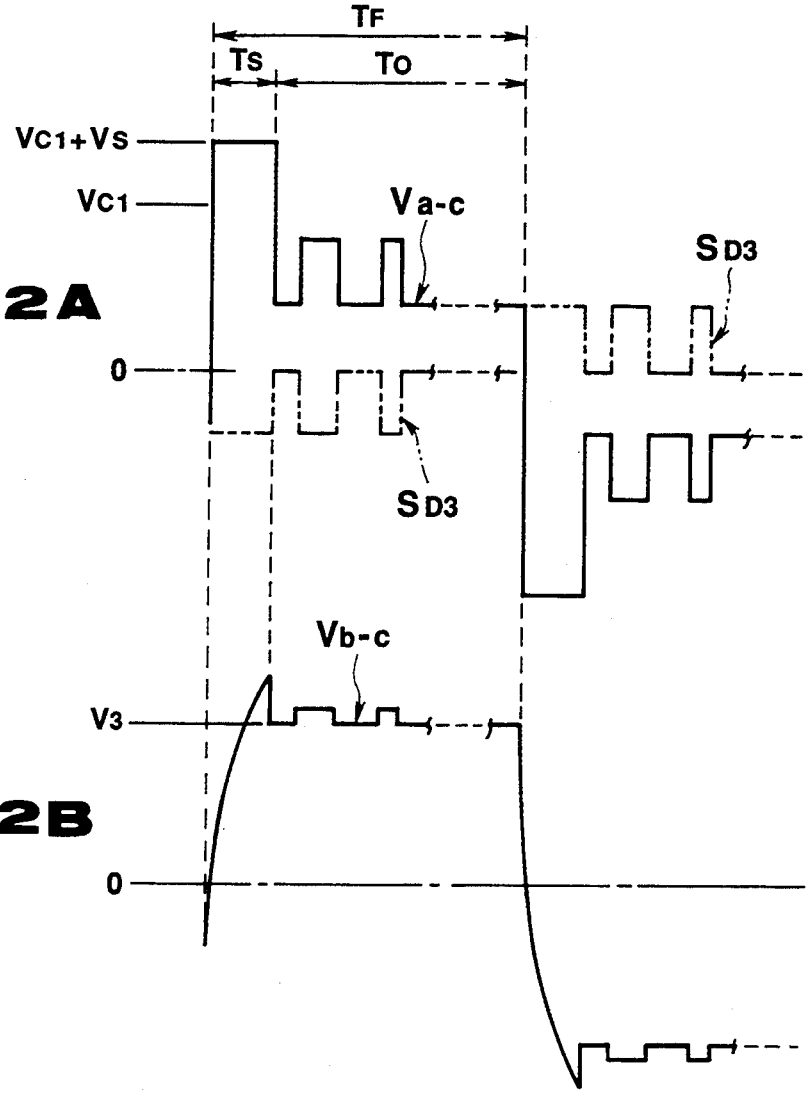
FIGS. 22A and 22B are diagrams showing the waveforms of two voltages applied between the input of the active element and the opposing electrode and between the pixel electrode and the opposing electrode, respectively, thereby to drive, in the third method, the active matrix LCD element at 10/10 gray-level.

In order to drive the active matrix LCD element at 10/10 gray-level, a composite voltage having the waveform shown in FIG. 22A is applied between the input of the active element 13 and the opposing electrode 15. In this case, as is shown in FIG. 22B, the voltage Vb-c applied between the pixel electrode 12 and the opposing electrode 15 fast rises throughout the selecting period $T_S$ as a high voltage $V_{C1}+V_S$ (i.e., the sum of the ON-selecting voltage $V_{C1}$ and the data pulse voltage $V_S$).

Upon lapse of the selecting period $T_S$, or at the start of the non-selecting period $T_O$, the voltage across the pixel capacitor $C_{LC}$ decreases by a certain value to a voltage V3. This voltage V3 is held between the pixel electrode 12 and the opposing electrode 15.

The voltage Vb-c shown in FIGS. 20D, 21B, and 22B, which is applied between the pixel electrode 12 and the opposing electrode 15 during the selecting period $T_S$, has a peak value at the end of the selecting period $T_S$. The peak value of the voltage Vb-c is determined by the composite voltage applied between the input of the active element 13 and the opposing electrode 15, the I-V characteristic of the element 13 (i.e., a diode ring), and the time during which the high voltage $V_{C1}+V_S$ is applied (i.e., the pulse width W of the data signal). In other words, the voltage Vb-c, which is applied between the electrodes 12 and 15 during the selecting period $T_S$, increases in accordance with the voltage Va-c applied between the input of the element 13 and the opposing electrode 15, along the rising curve representing the I-V characteristic of the active element 13, and stops increasing the moment the high voltage $V_{C1}+V_S$ abruptly decreases.

The composite voltage applied between the input of the active element 13 and the opposing electrode 15 can have two levels, the first level being determined by the ON-selecting voltage $V_{C1}$ and the second level being determined by the high voltage $V_{C1}+V_S$, as can be understood from FIG. 20C. Hence, the voltage Vb-c, which is applied between the pixel electrode 12 and the opposing electrode 15, gradually increases along the curve determined by the ON-selecting voltage $V_{C1}$ when the composite voltage is at the first level, and abruptly increases along the curve determined by the high voltage $V_{C1}+V_S$ when the composite voltage is at the second level as shown in FIG. 20D.

The value by which the voltage Vb-c increases in accordance with the ON-selecting voltage $V_{C1}$ is proportional to the time of applying the voltage $V_{C1}$. Likewise, the value by which the voltage Vb-c increases in accordance with the high voltage $V_{C1}+V_S$ is proportional to the time of applying the voltage $V_{C1}+V_S$. The peak value of the voltage Vb-c therefore changes in accordance with the ratio of the time of applying the ON-selecting voltage $V_{C1}$ to the time of applying the voltage $V_{C1}+V_S$. Hence, the voltage Vb-c which the pixel capacitor $C_{LC}$ holds at the end of the selecting period $T_S$, or at the start of the non-selecting period $T_O$, is controlled by the data pulse superposed on the selecting voltage applied between the input of the active element 13 and the opposing electrode 15. (The voltage Vb-c is lower than the voltage applied during the period $T_S$ by that decrease in the voltage Va-c corresponding to the pixel capacitance $V_{LC}$.)

If the selecting voltage is one superposed with no data pulse as is shown in FIG. 21A, the voltage Vb-c held in the pixel capacitor $C_{LC}$ will have the least value V1. If the selecting voltage is one entirely superposed with a data pulse having the width equal to the selecting period $T_S$ as is shown in FIG. 22A, the voltage Vb-c will have the greatest value V3. Further, if the selecting voltage is one partly superposed with no data pulse as is shown in FIG. 20C, the voltage Vb-c held in the pixel capacitor $C_{LC}$ will have a value V2 greater than the value V1 and less than the value V3, as is illustrated in FIG. 20D. This voltage V2 is determined by the width of the pulse superposed on the selecting voltage, i.e., the period during which the high voltage $V_{C1}+V_S$ is applied.

The transmittance of the pixel changes in accordance with the rising angle of the liquid crystal used. This angle depends on the voltage Vb-c applied between the pixel electrode 12 and the opposing electrode 15 (i.e., the voltage across the pixel capacitor $C_{LC}$). Thus, a selecting voltage having a pulse width corresponding to the data signal is applied between the input of the active element 13 and the opposing electrode 15 during the selecting period $T_S$, and a voltage corresponding to the data-pulse width of the selecting voltage is applied between the pixel electrode 12 connected to the active element 13 and the opposing electrode 15, thereby to control the transmittance of the pixel. As a result, the liquid-crystal display can display a multi-gray-scale image.

Figures 23A, 23B:
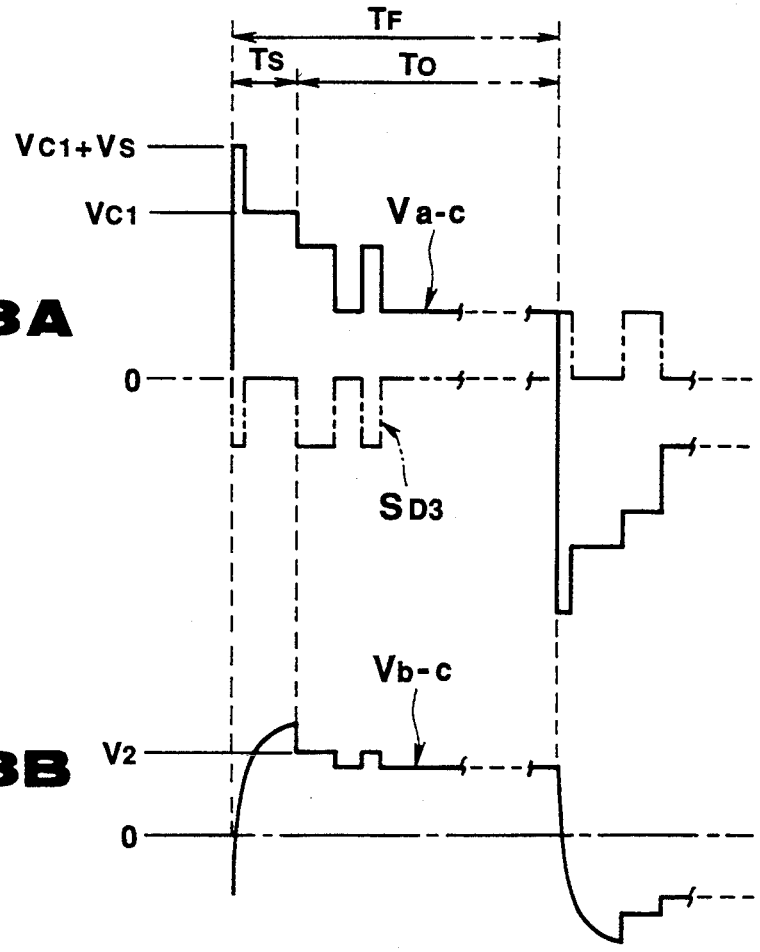
FIGS. 23A and 23B are diagrams showing other waveforms of two voltages applied between the input of the active element and the opposing electrode and between the pixel electrode and the opposing electrode, respectively, thereby to drive, by the third method, the pixel at a desired gray-level.

As is shown in FIGS. 20A and 20B, a data pulse $S_{D3}$ is superposed on the the scan signal $S_{S3}$ during the last part of the selecting period $T_S$, thereby applying a 10 selecting voltage of the waveform shown in FIG. 20C during the period $T_S$. Instead, as is shown in FIG. 23A, a data pulse can be superposed on the scan signal $S_{S3}$ during the initial part of the period $T_S$, thereby applying a selecting voltage of the waveform shown in FIG. 23B during the period $T_S$. Alternatively, as is shown in FIG. 24A, a data pulse can be superposed on the scan signal $S_{S3}$ during the intermediate part of the period $T_S$, thereby applying a selecting voltage of the waveform shown in FIG. 24B during the period $T_S$.

Figures 24A, 24B:
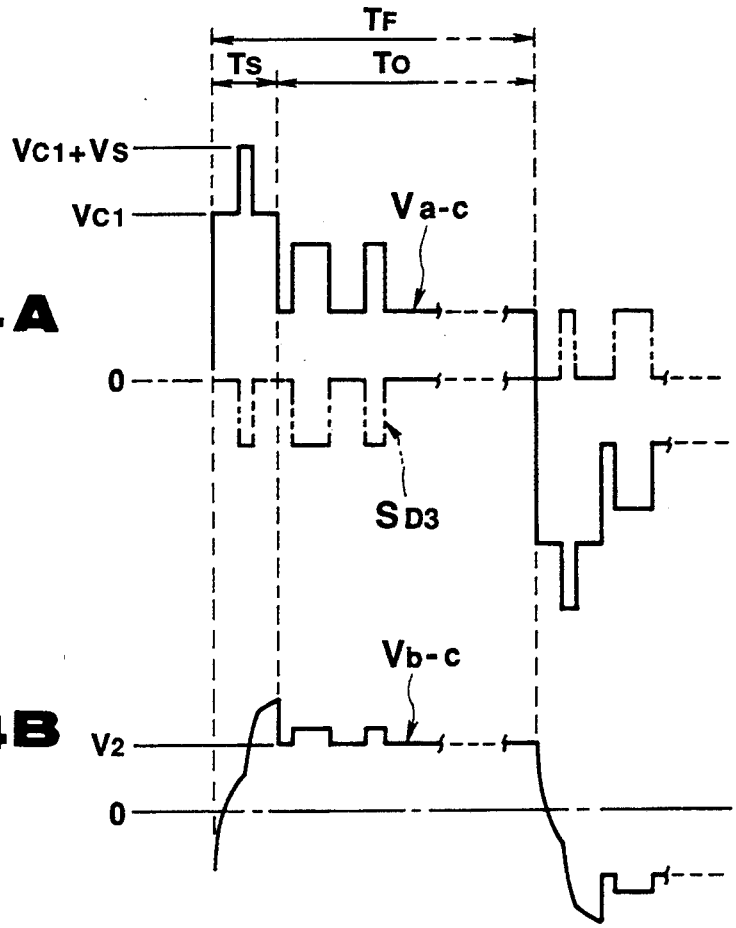
FIGS. 24A and 24B are diagrams showing still other waveforms of two voltages applied between the input of the active element and the opposing electrode and between the pixel electrode and the opposing electrode, respectively, thereby to drive, by the third method, the pixel at a desired gray-level.

In each alternative case, too, as is shown in FIGS. 23B and 24B, the voltage Vb-c applied between the pixel electrode 12 and the opposing electrode 15 increases along the curve determined by the ON-selecting voltage $V_{C1}$ while the ON-selecting voltage $V_{C1}$ is being applied, and along the curve determined the high voltage $V_{C1}+V_S$ while this high $V_{C1}+V_S$ voltage is being applied. As a result, the voltage Vb-c held in the pixel capacitor $C_{LC}$ will have a value which corresponds to the data-pulse width of the selecting voltage. The voltage Vb-c controls the transmittance of the pixel, whereby the liquid-crystal display displays a gray-scale image.

The number of gray-levels, at which the transmittance of each pixel can be set, is determined by the number of values which the voltage Vb-c sustained in the pixel capacitor $C_{LC}$ during the limited selecting period $T_S$ can have.

The gray-scale displaying described above is achieved by means of pulse-width modulation of the voltage applied between the pixel electrode 12 and the opposing electrode 15. The changes in this voltage is determined by the I-V characteristic of the active element 13. The active element 13, which is a diode ring, an I-V characteristic represented by a steep curve and has good response. Hence, the active element 13 can greatly change the voltage applied between the pixel electrode 12 and the opposing electrode 15.

Figure 25:
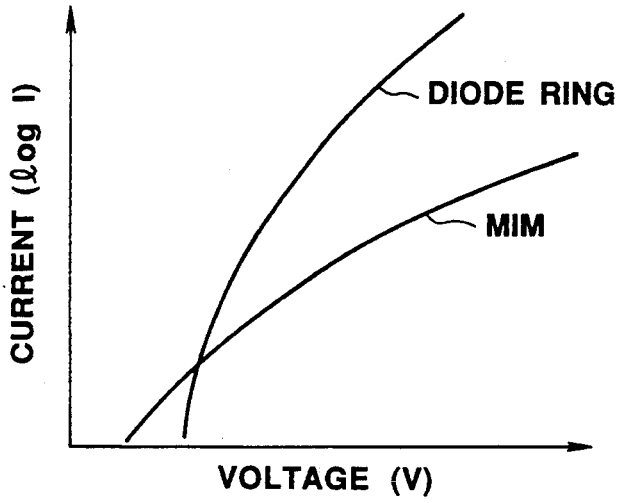
FIG. 25 is a graph which illustrating the I-V characteristic of the diode ring used in the invention, and also the I-V characteristic of an MIM element.

FIG. 25 is a graph illustrating the I-V characteristic of the diode ring used as active element 13, and also the I-V characteristic of a MIM (Metal-Insulator-Metal) using tunnel effect. As is evident from FIG. 25, the diode ring has an I-V characteristic curve steeper than that of the MIM, and a response better than that of the MIM. The active matrix LCD elements, whose active elements 13 are diode rings, can be driven in high time-division fashion to display an image in various gray-levels, even if the voltage applied between the pixel electrode 12 and the opposing electrode 15 is not so high as is applied in an active matrix LCD element whose active element is a MIM.

An appropriate I-V characteristic of the diode ring can be selected for the diode ring, by changing the thickness of the I-type semiconductor film of each thin-film diode. Alternatively, an I-V characteristic of the diode ring can be selected, by changing the number of thin-film diodes connected in parallel between points a and b in the equivalent circuit shown in FIG. 10. The thinner the I-type semiconductor film of each thin-film diode, the steeper the I-V characteristic curve of the diode ring. The less thin-film diodes are used, the steeper the I-V characteristic curve of the diode ring.

Figure 26A:
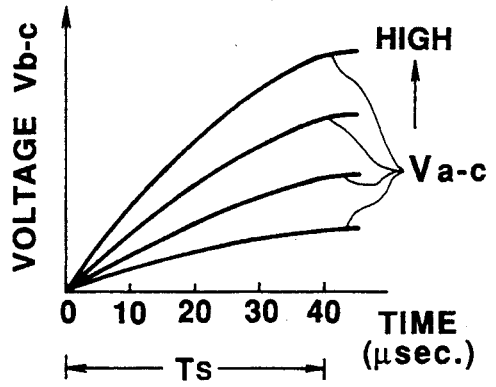
FIG. 26A is a graph representing the pixel-capacitor charging characteristic an active matrix LCD element exhibits, whose active element is a diode ring of one type.

FIG. 26A is a graph representing the pixel-capacitor charging characteristic which an active matrix LCD element, whose active element is a diode ring having an ordinary I-V characteristic, exhibits when various Va-c are applied, one at a time, between the input of the active element 13 and the opposing electrode 15. As is shown in FIG. 26A, the voltage across the pixel capacitor $C_{LC}$ rises to a peak value upon lapse of about 40 μsec. of charging. Because of the specific pixel-capacitor charging characteristic, the active matrix LCD element is well driven by high time-division fashion, wherein the selecting period $T_S$ is about 40 μsec.

Hence, to drive this active matrix LCD element, thereby to display a gray-scale image, it suffices to set the pulse width of the selecting voltage at 0 to 40 μsec. Assuming that the liquid crystal used is a negative-type one which transmits light when a voltage is applied between the pixel electrode 12 and the opposing electrode 15, the pixel looks the darkest when the selecting voltage has a pulse width of 0 μsec. (or has no pulses), and looks the brightest when the selecting voltage has a pulse with of about 40 μsec. The gray-level of the pixel thus changes in accordance with the pulse width of the selecting voltage applied between the pixel electrode 12 and the opposing electrode 15.

As has been described, the number of gray-levels is determined by the number of values which the voltage Vb-c held in the pixel capacitor $C_{LC}$ during the limited selecting period $T_S$ can have. To display pixels at distinct gray-levels, it is necessary to differentiates, by a sufficient amount, any two immediate values for the voltage Vb-c held in the pixel capacitor $C_{LC}$, i.e., the voltage applied between the pixel electrode 12 and the opposing electrode 15. Hence, in the third method according to the invention, any two immediate values for the voltage Vb-c are differentiated sufficiently.

Figure 26B:
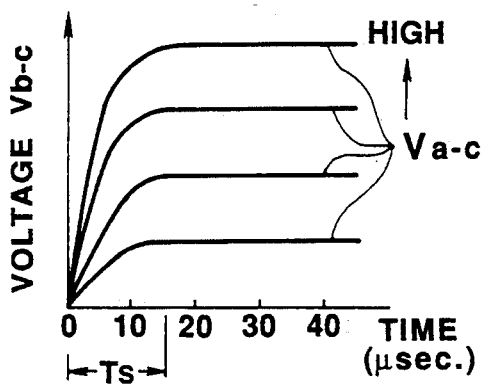
FIG. 26B is a graph representing the pixel-capacitor charging characteristic an active matrix LCD element exhibits, whose active element is a diode ring of another type.

FIG. 26B is a graph representing the pixel-capacitor charging characteristic in which the voltage across the pixel capacitor $C_{LC}$ rises to a peak value upon lapse of about 10 to 15 μsec. of charging. Therefore, the selecting period $T_S$ can be as short as 10 to 15 μsec., and the active matrix LCD elements can be driven in higher time-division fashion, thereby to display an image at more various gray-levels.

The third method of the invention resides in driving active matrix LCD elements, each having a diode ring used as semiconductor active element 13, by means of pulse-width modulation. Thus, it is unnecessary to use multi-level drive signals to drive the LCD elements as is required in the conventional method in which voltage modulation is performed. The third method can, therefore, be carried out by means of a relatively simple drive circuit to cause the LCD elements to display pixels at many different gray-levels.

Fourth Embodiment

The method according to a fourth embodiment of the invention (to be referred as "fourth method") will now be described, with reference to FIGS. 27A to 27D, FIGS. 28A and 28B, and FIGS. 29A to 29C. Some of the features of the fourth method are identical to those of the first method, and therefore will not be described.

The fourth method is designed to drive active matrix LCD elements of the liquid-crystal display shown in FIGS. 8 and 9, thereby to display a gray-scale image. This method is characterized in that the number of pulses of a data signal is changed in accordance with externally supplied image data.

Figures 27A, 27B, 27C, 27D:
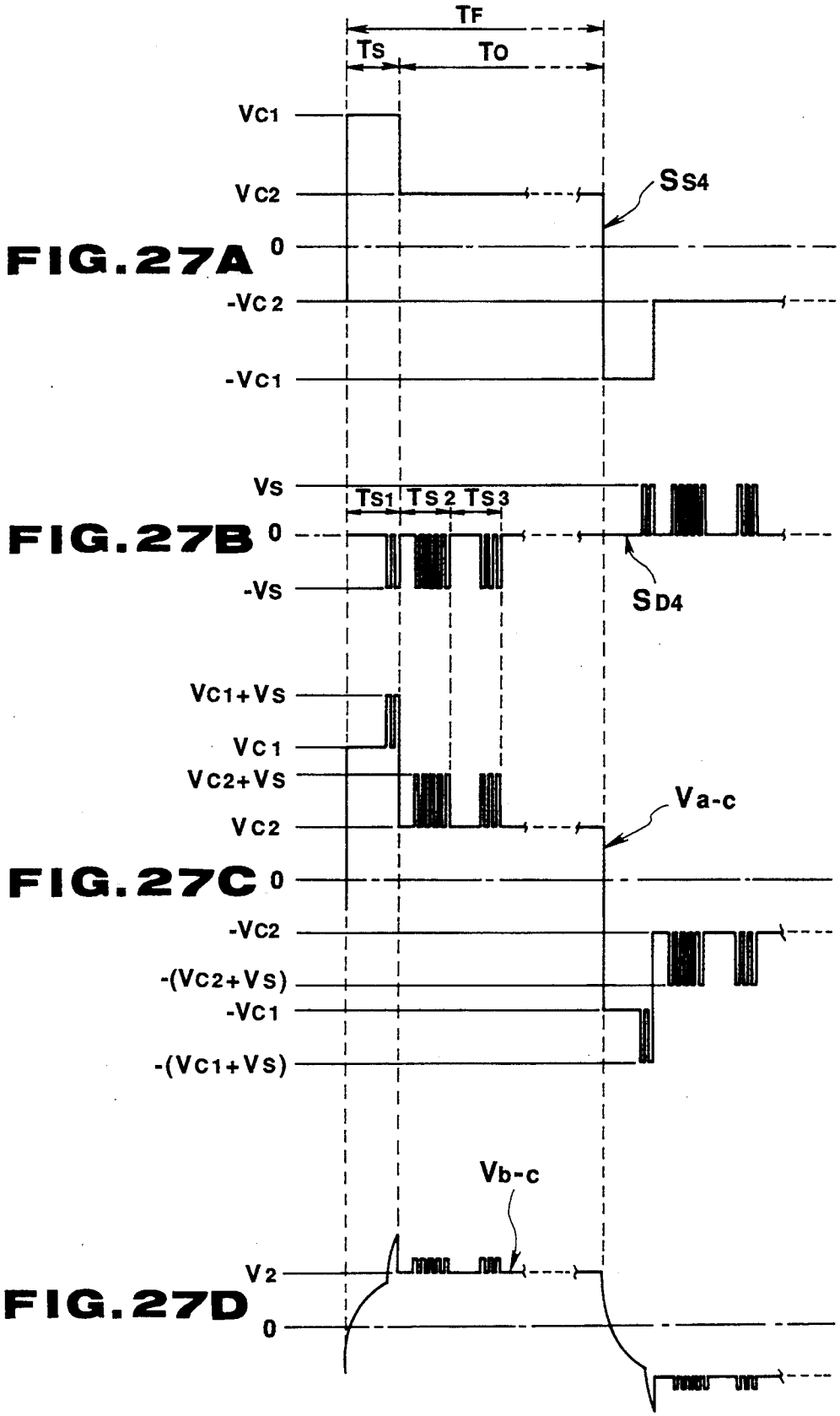
FIG. 27A is a diagram showing the waveform of the scan signal used in the fourth method according to the present invention.
FIG. 27B is a diagram showing the waveform of the data signal used in the fourth method of the invention.
FIG. 27C is a diagram illustrating the waveform of the voltage applied between the input of the active element and the opposing electrode when the scan signal and the data signal, shown in FIGS. 27A and 27B, are supplied to the signal line and the opposing electrode, respectively.
FIG. 27D is a diagram representing how the voltage applied between the pixel electrode and the opposing electrode changes when the voltage shown in FIG. 27C is applied between the input of the active element and the opposing electrode.

FIG. 27A is a diagram showing the waveform of a scan signal $S_{S4}$ supplied between the first opposing electrode 15 of the liquid-crystal display shown in FIGS. 8 and 9. FIG. 27B is a diagram illustrating a data signal $S_{D4}$ supplied to one of the signal lines 14 shown in FIG. 8. FIG. 27C is a diagram showing the waveform of a voltage Va-c applied between the opposing electrode 15 and the input of the active element 13 connected to the signal line 14, or between points a and c in the equivalent circuit shown in FIG. 10. FIG. 27D is a diagram representing the waveform of a voltage Vb-c applied between the pixel electrode 12 connected to the active element 13 and the opposing electrode 15, or between points b and c in the equivalent circuit shown in FIG. 10.

As shown FIG. 27A, the scan signal $S_{S4}$ is identical to the scan signal $S_{S3}$ illustrated in FIG. 20A. The signal $S_{S4}$ remains at a selecting potential $V_{C1}$ during the selecting period $T_S$ and at a non-selecting potential $V_{C2}$ during a non-selecting period $T_O$. The scan signal $S_{S4}$ has its polarity altered at the end of every one-field period $T_F$.

As is evident from FIG. 27B, the data signal $S_{D4}$ has pulses the number of which changes in accordance with the image data externally supplied. The signal $S_{D4}$ has the polarity which is opposite to that of the scan signal $S_{S4}$ supplied to the opposing electrode 15. The pulses of the data signal $S_{D2}$ have the same potential $V_S$. The widths of these data pulses are the same and constant, and the polarity thereof alters at the end of every one-field period $T_F$.

As is shown in FIG. 27B, the data signal $S_{D4}$ has 2 pulses during the selecting period $T_{S1}$ for the first opposing electrode 15, 5 pulses during the selecting period $T_{S2}$ for the second opposing electrode 15, and 3 pulses during the selecting period $T_{S3}$ for the third opposing electrode. The number of pulses which the signal $S_{D4}$ has during each of the selecting periods $T_{S1}$, $T_{S2}$, and $T_{S3}$ changes in accordance with the externally supplied image data, from 0 (no pulses) to n. Here, "n" is is greatest number of pulses that can be applied during the selecting period $T_S$, depending on the width of each pulse.

When the scan signal $S_{S4}$ and the data signal $S_{D4}$, which have the waveform shown in FIGS. 27A and 27B, are supplied to the opposing electrode 15 and the signal line 14, respectively, a voltage Va-c having the waveform shown in FIG. 27C is applied between the input of the active element 13 connected to the first signal line 14 and the opposing electrode 15. As can be understood from FIG. 27C, the voltage Va-c corresponds to the potential difference between these signals $S_{S4}$ and $S_{D4}$.

The voltage Va-c applied between the input of the active element 13 and the opposing electrode 15 is at the value of $V_{C1}$ and then the value $V_{C1}+V_S$ during the selecting period $T_S$, and alternately at the value of $V_{C2}$ and $V_{C2}+V_S$ during the non-selecting period $T_O$, as in the case of the first method according to the present invention.

When the selecting voltage having the waveform of FIG. 27C is applied between the input of the element 13 and the opposing electrode 15, a voltage is applied between the pixel electrode 12 connected to the active element 13 and the opposing electrode 15. As a result, the pixel capacitor $C_{LC}$, which is formed of the pixel electrode 12 and the opposing electrode 15 and that part of the liquid-crystal layer sandwiched between these electrodes 12 and 15, begins to be electrically charged.

Upon lapse of the selecting period $T_S$, or at the the start of the next non-selecting period $T_O$, the voltage Va-c falls from $V_{C1}+V_S$ to $V_{C2}$. The active element 13 is thereby turned off, and the pixel capacitor $C_{LC}$ is no longer charged. As a result, as is shown in FIG. 27D, the voltage Vb-c across the pixel capacitor $C_{LC}$ decreases to a voltage $V_2$ by that decrease in the voltage Va-c which corresponds to the pixel capacitance $V_{LC}$. (Said change in the voltage Va-c is one of the two voltages obtained by dividing the change in the voltage Va-c by the element capacitor $C_D$ and the pixel capacitor $C_{LC}$.)

Figures 28A, 28B:
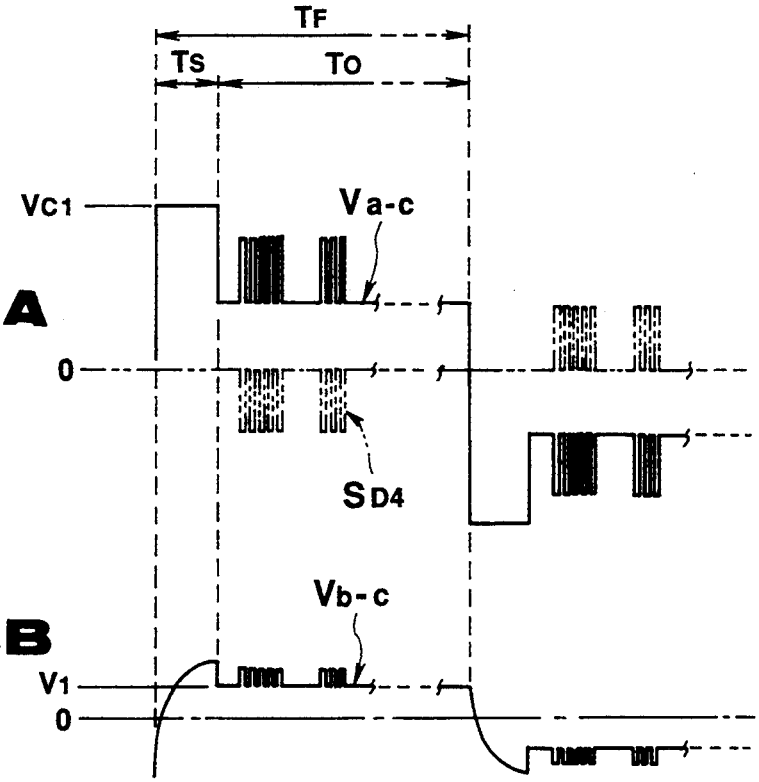
FIGS. 28A and 28B are diagrams showing the waveforms of two voltages applied between the input of the active element and the opposing electrode and between the pixel electrode and the opposing electrode, respectively, thereby to set the pixel at the 0-th gray-level in the fourth method according tot the invention.
Figures 29A, 29B:
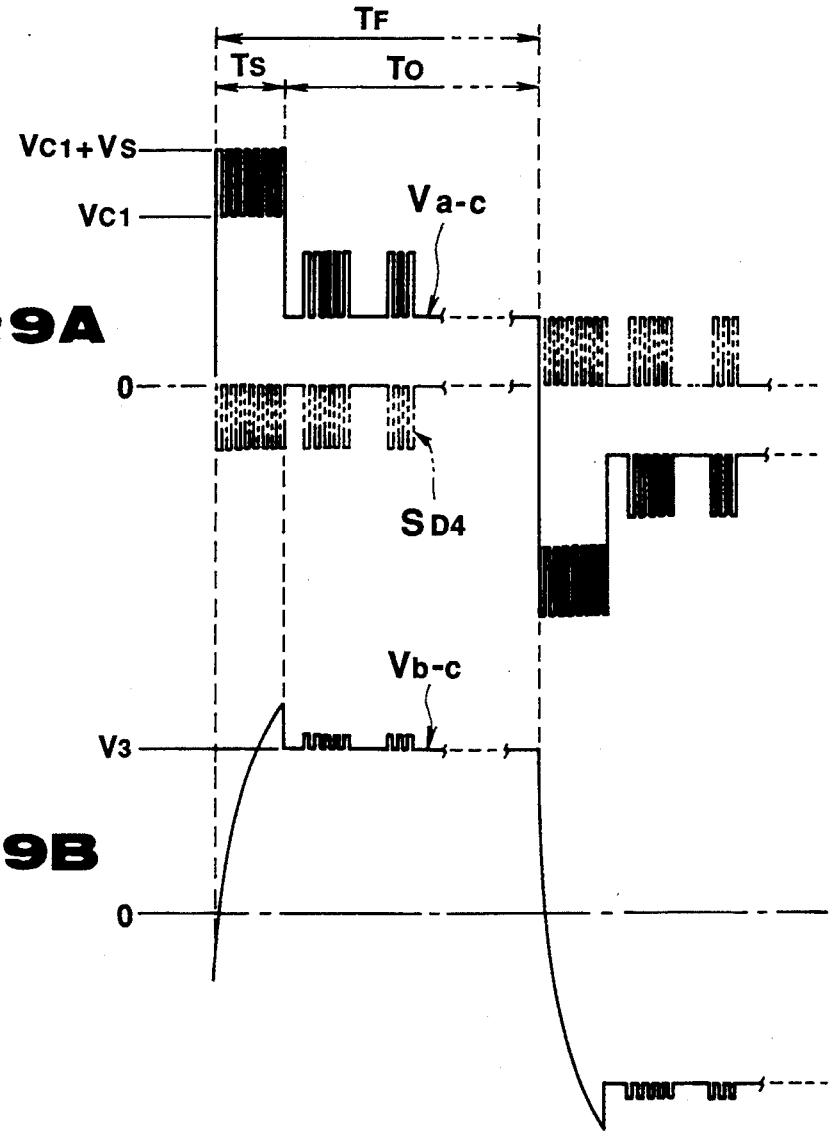
FIGS. 29A and 29B are diagrams showing the waveforms of two voltages applied between the input of the active element and the opposing electrode and between the pixel electrode and the opposing electrode, respectively, thereby to set the pixel at the n-th gray-level (i.e., the highest gray-level) in the fourth method according tot the invention.

In the fourth method of the invention, each active matrix LCD element is driven in essentially the same way as in the third method, in order to display an image at various gray-levels, as will be explained with reference to FIGS. 27C and 27D, FIGS. 28A and 28B, and FIGS. 29A and 29B. FIGS. 27C, 28A, and 29A represent the waveforms of voltages Va-c applied between the input of the active element 13 and the opposing electrode 15, and FIGS. 27D, 28B, and 28B illustrate the waveforms of voltages Vb-c applied between the pixel electrode 12 and the opposing electrode 15.

To set the pixel at the 0-th gray-level of an n-level gray scale, a data signal $S_{D4}$ having no pluses is supplied to the input of the active element 13 during the selecting period $T_S$. Further, for this purpose, a composite voltage Va-c having the waveform of FIG. 28A is applied between the input of the element 13 and the opposing electrode 15, and a voltage Vb-c having the waveform of FIG. 28B is applied between the pixel electrode 12 and the opposing electrode 15.

To set the pixel at the second gray-level of the n-level gray scale, a data signal $S_{D4}$ having 2 pluses is supplied to the input of the active element 13 during the selecting period $T_S$. Further, for this purpose, a composite voltage Va-c having the waveform of FIG. 27C is applied between the input of the element 13 and the opposing electrode 15, and a voltage Vb-c having the waveform of FIG. 27D is applied between the pixel electrode 12 and the opposing electrode 15.

To set the pixel at the n-th gray-level (i.e., the highest gray-level) of the n-level gray scale, a data signal $S_{D4}$ having n pluses is supplied to the input of the active element 13 during the selecting period $T_S$. Further, for this purpose, a composite voltage Va-c having the waveform of FIG. 29A is applied between the input of the element 13 and the opposing electrode 15, and a voltage Vb-c having the waveform of FIG. 29B is applied between the pixel electrode 12 and the opposing electrode 15.

Figure 29C:
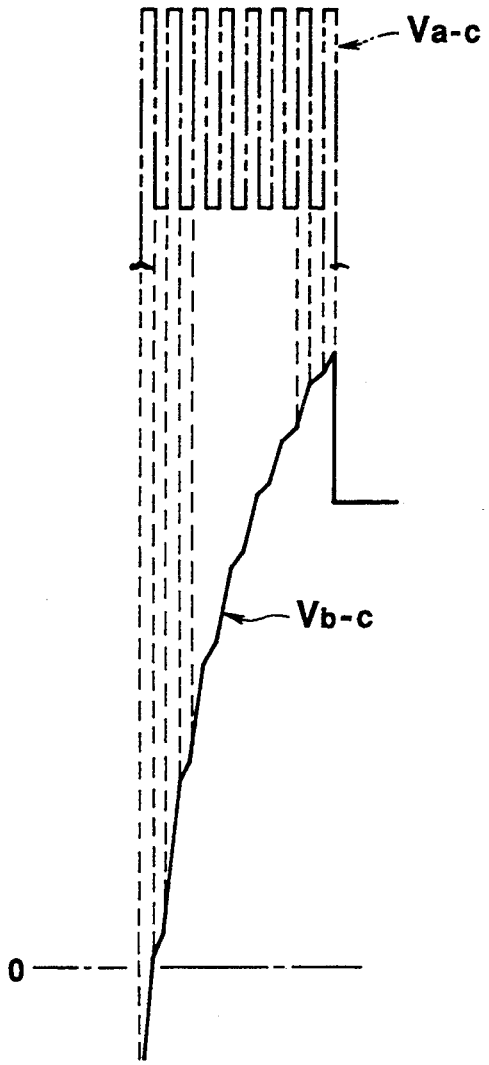
FIG. 29C is an enlarged view of a part of FIGS. 29B.

In the fourth method, too, the voltage Vb-c, which is applied between the pixel electrode 12 and the opposing electrode 15, gradually increases along the curve determined by the selecting voltage when the selecting voltage, applied between the input of the active element 13 and the opposing electrode 15 has the value of $V_{C1}$, and fast increases along the curve determined by the selecting voltage when the ON-selecting voltage has the value of $V_{C1}+V_S$, that is, when the data-pulse voltage $V_S$is superposed on the selecting voltage. Since the number of data pulses of the the selecting voltage changes in accordance with the image data, the voltage Vb-c applied between the pixel electrode 12 and the the opposing electrode 15 increases in steps the number of which is equal to that of the data pulses. More precisely, as is shown in FIG. 29C which is an enlarged part of FIG. 29B, the voltage Vb-c abruptly increases every time the selecting voltage has the value of $V_{C1}+V_S$, and gradually increases every time the selecting voltage has the reference value of $V_{C1}$ for the period corresponding to the width of a data pulse. Hence, as the selecting voltage repeatedly changes from $V_S$ to $V_{C1}+V_S$ and vice versa, the voltage Vb-c rises step by step.

Hence, the voltage Vb-c held in the pixel capacitor $C_{LC}$ upon lapse of the selecting period $T_S$, or at the start of the non-selecting period $T_O$ changes in accordance with the period during which the selecting voltage remains at the high value, which is determined by the number of the data pulses and the width thereof. (The voltage Vb-c held in the capacitor $C_{LC}$ is lower than the voltage built up in the capacitor $C_{LC}$ during the period $T_S$, by that decrease in the voltage Va-c which corresponds to the pixel capacitance $C_{LC}$).

If the selecting voltage is one superposed with no data pulses as is shown in FIG. 28A, the voltage Vb-c held in the pixel capacitor $C_{LC}$ will have the least value V1. If the selecting voltage is one entirely superposed with n data pulses as is shown in FIG. 29A, the voltage Vb-c will have the greatest value V3. Further, if the selecting voltage is one superposed with a number of data pulses which is less than n, as is shown in FIG. 27C, the voltage Vb-c held in the pixel capacitor $C_{LC}$ will have a value V2 greater than the value V1 and less than the value V3, as is illustrated in FIG. 27D. This voltage V2 is determined by the number of data pulses superposed on the selecting voltage.

In FIG. 27C, data pulses are superposed on the selecting voltage during the last part of the selecting period $T_S$. Instead, the data pulses can be superposed on the selecting voltage, either during the initial part of the period $T_S$ or during the intermediate part thereof.

The transmittance of the pixel changes in accordance with the rising angle of the liquid crystal used. This angle depends on the voltage Vb-c applied between the pixel electrode 12 and the opposing electrode 15 (i.e., the voltage across the pixel capacitor $C_{LC}$). Thus, a selecting voltage having pulse the number of which corresponds to the data signal is applied between the input of the active element 13 and the opposing electrode 15 during the selecting period $T_S$, and a voltage corresponding to the total width of the data pulses contained in the selecting voltage is applied between the pixel electrode 12 connected to the active element 13 and the opposing electrode 15, thereby to control the transmittance of the pixel. As a result, the liquid-crystal display can display a gray-scale image.

The number of gray-levels of the gray scale is determined by how many different values the voltage Vb-c held during the selecting period $T_S$ can have. Since the active element 13 is a diode ring which has, as is shown in FIG. 25, a steep I-V characteristic curve and a good response better, the voltage applied between the input of the active element 13 and the opposing electrode 15 can be changed greatly by changing the number of the pulses contained in the selecting voltage applied between the pixel electrode 12 and the opposing electrode 15.

The fourth method of the invention resides in driving active matrix LCD elements, each having a diode ring used as semiconductor active element 13, by changing the number of data pulses contained in the selecting voltage in accordance with the externally supplied image data. Thus, It is unnecessary to use multi-level drive signals to drive the LCD elements as is required in the conventional method in which voltage modulation is performed. The fourth method can, therefore, be performed by means of a relatively simple drive circuit to cause the LCD elements to display pixels at many different gray-levels.

In the fourth method, too, the selecting period $T_S$ can be shortened, thereby to achieve higher time-division driving of the active matrix LCD elements, by using diode rings which has a steep I-V characteristic curve. The I-V characteristic curve of the diode ring can be rendered steeper by changing the thickness of the I-type semiconductor film of each thin-film diode. Alternatively, an I-V characteristic of the diode ring can be selected for the diode ring, either by connecting less thin-film diodes in parallel between points a and b in the equivalent circuit shown in FIG. 10, or by reducing the thickness of the I-type semiconductor film of each thin-film diode.

Applications of Third and Fourth Methods

The third and fourth methods of the invention can be applied to drive not only active matrix LCD elements whose active elements are diode rings, but also active matrix LCD elements whose active elements are of so-called "back-to-back structure," each comprising thin-film diodes. Further, the third and fourth methods can be applied to drive active matrix LCD elements whose active elements comprise semiconductor elements having diode characteristic (e.g., MIMs), thin-film transistors (TFTs), or any other semiconductor active elements.

Fifth Embodiment

The method according to a fifth embodiment of the invention (to be referred as "fifth method") will be described, with reference to FIGS. 30A to 30D, FIGS. 31A and 31B, and FIGS. 32A and 32B. Some of the features of the fifth method are identical to those of the third method, and therefore will not be described.

The fifth method is designed to drive active matrix LCD elements of the liquid-crystal display shown in FIGS. 8 and 9, thereby to display a multi-gray-scale image. This method is characterized in that the gray-level of each pixel is controlled, eliminating changes in the transmittance thereof which result from the influence of the condition in which the other pixels are driven.

Figures 30A, 30B, 30C, 30D:
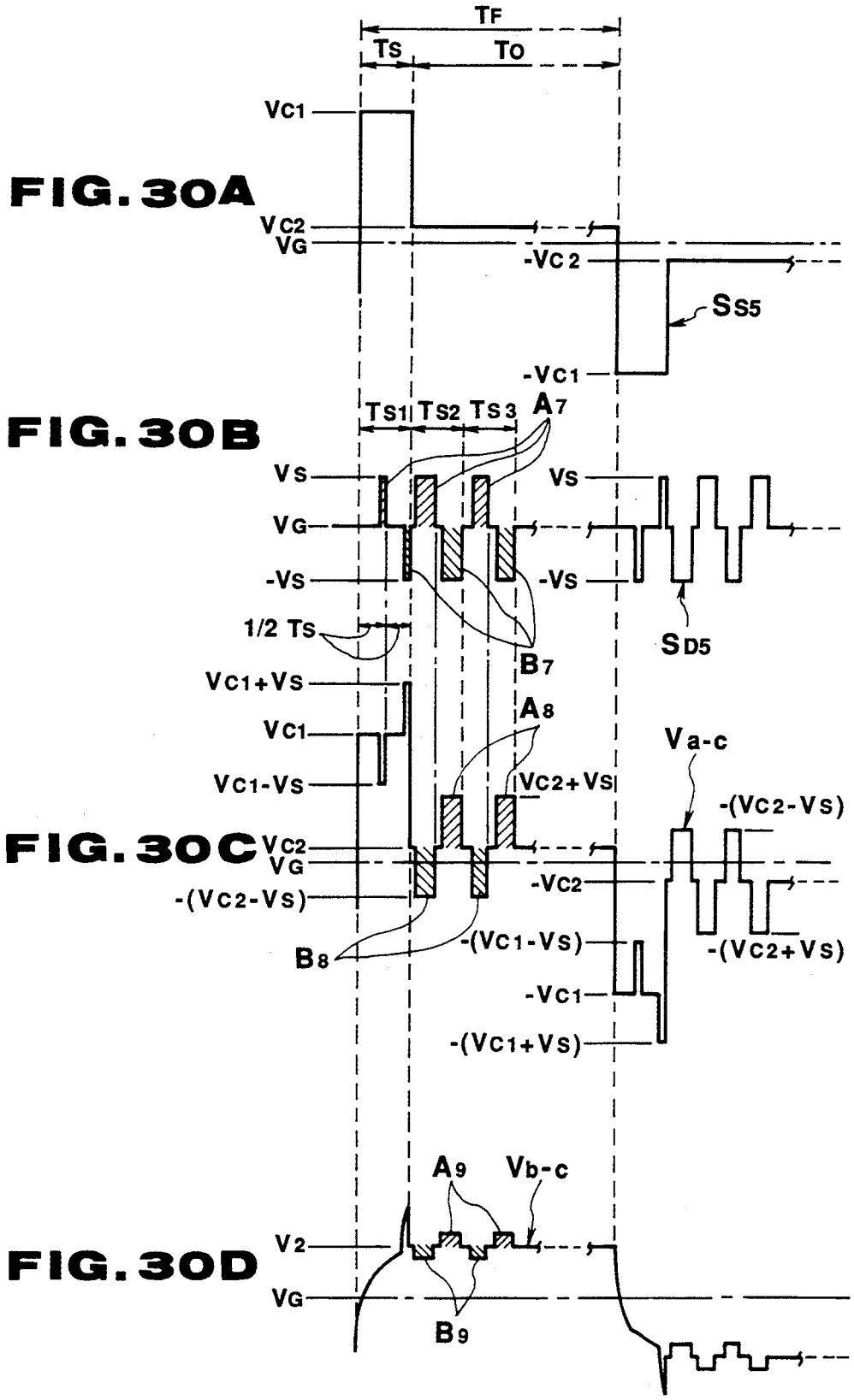
FIG. 30A is a diagram showing the waveform of the scan signal used in the method according to a fifth embodiment of the present invention.
FIG. 30B is a diagram showing the waveform of the data signal used in the fifth embodiment of the invention.
FIG. 30C is a diagram illustrating the waveform of the voltage applied between the input of the active element and the opposing electrode when the scan signal and the data signal, shown in FIGS. 30A and 30B, are supplied to the signal line and the opposing electrode, respectively.
FIG. 30D is a diagram representing how the voltage applied between the pixel electrode and the opposing electrode changes when the voltage shown in FIG. 30C is applied between the input of the active element and the opposing electrode.

FIG. 30A is a diagram showing the waveform of a scan signal $S_{S5}$ supplied between the first signal line 14 of the liquid-crystal display shown in FIGS. 8 and 9. FIG. 30B is a diagram illustrating a data signal $S_{D5}$ supplied to one of the opposing electrodes 15 shown in FIG. 8. FIG. 30C is a diagram showing the waveform of a voltage Va-c applied between the opposing electrode 15 and the input of the active element 13 connected to the signal line 14, or between points a and c in the equivalent circuit shown in FIG. 10. FIG. 30D is a diagram representing the waveform of a voltage Vb-c applied between the pixel electrode 12 and the opposing electrode 15, or between points b and c in the equivalent circuit shown in FIG. 10.

As shown FIG. 30A, the scan signal $S_{S5}$ is identical to the scan signal $S_{S3}$ used in the third method. The signal $S_{S5}$ remains at a selecting potential $V_{C1}$ during the selecting period $T_S$ and at a non-selecting potential $V_{C2}$ during a non-selecting period $T_O$. The scan signal $S_{S5}$ has its polarity altered at the end of every one-field period $T_F$.

As is evident from FIG. 30B, the data signal $S_{D5}$ is a rectangle-wave voltage signal whose potential changes in accordance with the image data externally supplied to the liquid-crystal display. More precisely, the data signal $S_{D2}$ has an even number of pulses, for example two pulses, during the selecting period $T_{S1}$, any adjacent two of which are positive and negative with respect to a predetermined reference potential $V_G$. These pulses have the same width, and their potentials are $V_S$ and $-V_S$, that is identical in absolute value. The pulses which the data signal $S_{D5}$ has during the second selecting period $T_{S2}$ have also potentials $V_S$ and $-V_S$, but their identical width may change in accordance with the image data externally supplied during the next selecting period $T_S$. The same holds true of the third selecting period $T_{S3}$. The data signal $S_{D5}$ has such a waveform during each selecting period $T_S$ that the two components A7 and B7 positive and negative with respect to the reference potential $V_G$, respectively, have substantially the same area.

As can be understood from FIG. 30B, the two pulses generated during the selecting period $T_{S1}$ for the pixels of the first row have a width which is 1/10 of the selecting period $T_S$; the two pulses generated during the selecting period $T_{S2}$ for the pixels of the second row have a width which is 4/10 of the period $T_S$; and the two pulses generated during the selecting period $T_{S3}$ for the pixels of the third row have a width which is 3/10 of the period $T_S$. The width of the pulses generated in the selecting period $T_S$ for the pixels of any row changes over the range of 0/10 of the period $T_S$ (no pulses) to 5/10 of period $T_S$ (i.e., $\frac{1}{2}$ of the period $T_S$).

When the scan signal $S_{S5}$ and the data signal $S_{D5}$ are supplied to the signal line 14 and the opposing electrode 15, respectively, a composite voltage Va-c (a combination of the signals $S_{S5}$ and $S_{D5}$) which has the waveform shown in FIG. 30C is applied between the opposing electrode 15 and the input terminal of the active element 13 (i.e., the diode ring), that is, between points a and c in the equivalent circuit of FIG. 10.

The composite voltage Va-c has a positive or negative polarity during the selecting period $T_S$, and has a negative polarity and a positive polarity alternately during the non-selecting period $T_O$, each time during every half of the period $T_S$. Of the composite voltage Va-c, the part applied during the selecting period $T_S$ is at the potential equal to the selecting potential $V_{C1}$ of the scan signal $S_{S5}$. When the data signal $S_{D5}$ increases to a potential $V_S$ of the positive data pulse, the composite voltage Va-c decreases to a potential $V_{C1}-V_S$. When the data signal $S_{D5}$ decreases to a potential $-V_S$ of the negative data pulse, the composite voltage Va-c increases to a potential $V_{C1}+V_S$.

The selecting voltage $V_{C1}$ (hereinafter referred to as "ON-selecting voltage"), which is applied while the data signal $S_{S5}$ is at zero potential, is higher than the threshold voltage of the thin-film diodes 23 and 24 forming the active element 13 (i.e., the diode ring). The selecting voltage $V_{C1}+V_S$, which is applied while the data signal $S_{D5}$ is at the data-pulse potential $V_S$, i.e., a potential positive with respect to the reference value $V_G$, is higher than the ON-selecting voltage $V_{C1}$. By contrast, the selecting voltage $V_{C1}-V_S$, which is applied while the data signal $S_{D5}$ is at the data-pulse potential $-V_S$, i.e., a potential negative with respect to the reference value $V_G$, is lower than the ON-selecting voltage $V_{C1}$.

The voltage (hereinafter referred to as "non-selecting voltage"), which is applied between the input of the active element 13 and the opposing electrode 15 during the non-selecting period $T_O$, is a combination of the scan signal $S_{S5}$ and data pulses superposed on the signal $S_{S5}$ in accordance with the image data. The non-selecting voltage remains at the non-selecting potential $V_{C2}$ of the scan signal $S_{S5}$ as long as the data signal $S_{D5}$ is at zero potential. When the potential of the data signal $S_{D5}$ increases to that of the data pulse, however, the non-selecting voltage change to either $V_{C2}+V_S$ or $V_{C2}-V_S$, i.e., a combination of the non-selecting potential $V_{C2}$ and the potential $V_S$ or $-V_S$ of the data pulse.

The voltages $V_{C2}+V_S$ and $V_{C2}-V_S$ are lower than the ON-selecting voltage $V_{C1}$ which is applied during the selecting period $T_S$. The voltage $V_{C2}+V_S$, i.e., a combination of the non-selecting potential $V_{C2}$ of the scan signal $S_{S5}$ and the data-pulse potential $V_S$ which is positive with respect to the reference potential $V_G$, is lower than the voltage $V_{C1}-V_S$ which is a combination of the selecting potential $V_{C1}$ of the scan signal $S_{S5}$ and the data-pulse potential $-V_S$ which is negative with respect to the reference potential $V_G$.

The non-selecting voltage is a voltage on which are superposed the positive and negative data pulses for driving the other pixels of the same column. Nonetheless, it has components A8 positive with respect to the the non-selecting potential $V_{C2}$ of the scan signal $S_{S5}$ and components B8 negative with respect to the non-selecting potential $V_{C2}$ of the scan signal $S_{S5}$, the total area of which is substantially equal to that of the components A8. This is because the data signal $S_{D5}$ has, during each selecting period $T_S$, two components A7 and B7 which are positive and negative to the reference potential $V_G$, respectively, and which have substantially the same area.

When the selecting voltage having the waveform of FIG. 30C is applied between the input of the element 13 and the opposing electrode 15, a voltage having the waveform shown in FIG. 30D is applied between the pixel electrode 12 and the opposing electrode 15. In other words, when the selecting voltage is applied between points a and c in the equivalent circuit of FIG. 10, the voltage across the active element 13 (i.e., the diode ring) rises above the threshold voltage of the element 13. As a result, the active element 13 is turned on, and a voltage is applied between points b and c in the equivalent circuit of FIG. 10, that is, between the pixel 12 and the opposing electrode 15. Hence, the pixel capacitor $C_{LC}$ formed of the electrodes 12 and 15 and that part of the liquid-crystal layer sandwiched between these electrodes 12 and 15, begins to be electrically charged, and is kept charged during the selecting period $T_S$.

Upon lapse of the selecting period $T_S$, or at the the start of the non-selecting period $T_O$, the voltage across the pixel capacitor $C_{LC}$ has become sufficiently high, and the voltage applied from the signal line 14 to the input of the active element 13 during the non-selecting period $T_O$ has already decreased. The voltage across the active element 13 is lower than the threshold voltage of the active element 13. The active element 13 is therefore turned off, and the pixel capacitor $C_{LC}$ is no longer charged.

Once off, the active element 13 functions as a capacitor. Thus, a voltage which is the decrease in the voltage Va-c (i.e., the voltage applied between points a and c in the equivalent circuit shown in FIG. 10) is divided by the element capacitance $C_D$ and the pixel capacitance $C_{LC}$ which are connected in series to each other. Hence, the voltage held in the pixel capacitor $C_{LC}$ during the non-selecting period $T_O$ is lower than the voltage built up in the capacitor $C_{LC}$ during the period $T_S$, by that part of decrease in the voltage Va-c which corresponds to the pixel capacitance $C_{LC}$).

That portion of the liquid-crystal layer which is sandwiched between the pixel electrode 12 and the opposing electrode 15 is driven by the voltage applied between these electrodes 12 and 13. In other words, it operates in response to the voltage held in the pixel capacitor $C_{LC}$ during the non-selecting period $T_O$. Said portion of the liquid-crystal layer is, therefore, kept driven throughout the non-selecting period $T_O$.

Since the data signal $S_{D5}$, which has the waveform of FIG. 30B, is supplied to the opposing electrode 15 to drive the pixel, the image data for driving the other pixels of the same column is supplied to the opposing electrode 15 even after the selecting period $T_S$. The potential of the electrode 15 inevitably changes. Consequently, the voltage Va-c varies, changing the voltage applied between the pixel electrode 12 and the opposing electrode 15. Like the voltage change occurring at the end of the selecting period $T_S$, the change in the voltage applied between the electrodes 12 and 15, which accompanies the change in the voltage Va-c, is corresponds to the pixel capacitance $C_{LC}$. (Said change in the voltage Va-c is one of the two voltages obtained by dividing the charge in the voltage Va-c by the element capacitance $C_D$ and the pixel capacitance $C_{LC}$.)

In the fifth method, the non-selecting voltage applied between the pixel electrode 12 and the opposing electrode 15 during the non-selecting period $T_O$ has such a waveform that the components $A_8$ positive with respect to the held reference voltage $V_G$ have a total area substantially equal to that of the components $B_8$ negative with respect to the reference voltage $V_G$. Hence, the voltage Va-c changes, due to the image data for driving the other pixels, to substantially the same extent in both regions positive and negative, respectively, with respect to the intermediate value of the non-selecting potential $V_{C2}$ of the scan signal $S_{S5}$. As a result, the voltage held in the pixel, which is the effective voltage applied during the non-selecting period $T_O$, remains unchanged.

Upon lapse of the non-selecting period $T_O$, or at the start of the next selecting period $T_S$, a voltage is applied between points a and c in the equivalent circuit shown in FIG. 10. The voltage across the active element 3 rises higher than the threshold voltage of the active element 13 and has the potential opposite to that of the voltage applied during the previous selecting period $T_S$. Hence, an electric charge of the opposite polarity is thereby accumulated in the pixel capacitance $C_{LC}$. Thereafter, the operation sequence described above is repeated to drive any other active matrix LCD element.

It will now be explained how the active matrix LCD elements shown in FIGS. 8 and 9 are driven by the fifth method to display a gray-scale image.

Figures 31A, 31B:
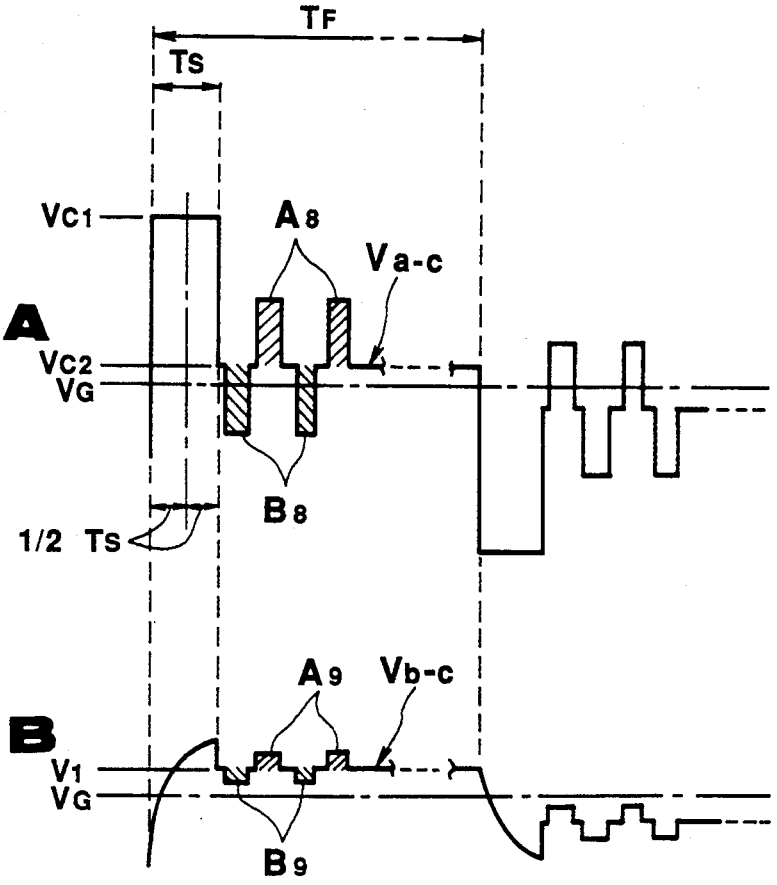
FIGS. 31A and 31B are diagrams showing the waveforms of two voltages applied between the input of the active element and the opposing electrode and between the pixel electrode and the opposing electrode, respectively, thereby to set the pixel at the 0-th gray-level in the fifth method according to the invention.

To set any pixel in the 0-th gray-level of the 5-level gray scale, a data signal $S_{D5}$, which has neither positive pulses nor negative pulses during the selecting period $T_S$, is supplied to the input of the active element 13. In this case, a composite voltage having the waveform shown in FIG. 31A is applied between the input of the active element 13 and the opposing electrode 15. As a result, the voltage Vb-c applied between the pixel electrode 12 and the opposing electrode 15 gradually increases throughout the selecting period $T_S$ along the curve defined by the ON-selecting voltage $V_{C1}$.

Upon lapse of the selecting period $T_S$, or at the start of the non-selecting period $T_O$, the active element 13 is turned off. Then, the voltage across the pixel capacitor $C_{LC}$ decreases from the value it had during the selecting period $T_S$ to the voltage V1, by the value corresponding to the pixel capacitance $C_{LC}$. (Said change in the voltage Va-c is one of the two voltages obtained by dividing the decrease in the voltage Va-c by the element capacitance $C_D$ and the pixel capacitance $C_{LC}$.) It is this voltage V1 that is held between the pixel electrode 12 and the opposing electrode 15.

As has been pointed out, the decrease of the voltage across the pixel capacitor $C_{LC}$, which occurs at the start of the non-selecting period $T_O$, depends on the ratio of the element capacitance $C_D$ to the pixel capacitance $C_{LC}$. Hence, this decrease can be minimized if the element capacitance $C_D$ is set at about 1/10 of the pixel capacitance $C_{LC}$.

To set any pixel in the first gray-level of the 5-level gray scale, a data signal $S_{D5}$, which has a positive pulse and a negative pulse during the selecting period $T_S$, each having a width which is 1/10 of the period $T_S$, is supplied to the input of the active element 13. In this instance, a composite voltage having the waveform shown in FIG. 30C is applied between the input of the active element 13 and the opposing electrode 15.

The composite voltage has the waveform of FIG. 30C when the data signal $S_{D5}$ supplied to the opposing electrode 15 has a data pulse having potential $V_D$ and the same polarity as the scan signal $S_{S5}$, at the end of the first half of the selecting period $T_S$, and a data pulse having potential $-V_D$ and the polarity opposite to that of the scan signal $S_{S5}$, at the end of the latter half of the selecting period $T_S$. Hence, in the first half of the selecting period $T_S$, the ON-selecting potential $V_{C1}$ is applied between the input of the active element 13 and the opposing electrode 15, and then a potential $V_{C1}-V_S$ lower than the ON-selecting voltage $V_{C1}$ is applied between the input of the element 13 and the opposing electrode 15 during the last part of the first half of the period $T_S$. In the latter half of the selecting period $T_S$, the ON-selecting potential $V_{C1}$ is applied between the input of the active element 13 and the opposing electrode 15, and then a potential $V_{C1}+V_S$ higher than the ON-selecting voltage $V_{C1}$ is applied between the input of the element 13 and the opposing electrode during the last part of the latter half of the period $T_S$.

When the selecting voltage having the waveform of FIG. 30C is applied between the input of the element 13 and the opposing electrode 15, a voltage Vb-c having the waveform shown in FIG. 30D is applied between the pixel electrode 12 connected to the active element 13 and the opposing electrode 15. As is evident from FIG. 30D, the voltage Vb-c increases along the curve defined by the ON-selecting voltage $V_{C1}$ during almost the entire first half of the selecting period $T_S$, then increases moderately along the curve defined by the low voltage $V_{C1}-V_S$ during the last part of the first half of the period $T_S$, next gradually increases along the curve defined by the ON-selecting voltage $V_{C1}$ during the greater part of the latter half of the period $T_S$, and finally increases greatly along the curve defined by the high voltage $V_{C1}+V_S$ during the last part of the latter half of the period $T_S$.

Upon lapse of the selecting period $T_S$, or at the the start of the non-selecting period $T_O$, the voltage across the pixel capacitor $C_{LC}$ decreases at a predetermined rate to a voltage V2. This voltage V2 is held between the pixel electrode 12 and the opposing electrode 15.

To set any pixel in the fifth gray-level, i.e., the highest level of the 5-level gray scale, a data signal SD5, which has a positive pulse and a negative pulse during the selecting period $T_S$, each having a width which is 5/10 (or $\frac{1}{2}$) of the period $T_S$, is supplied to the input of the active element 13. In this case, a composite voltage having the waveform shown in FIG. 32A is applied between the input of the active element 13 and the opposing electrode 15.

The composite voltage has the waveform of FIG. 30C when the data signal $S_{D5}$ supplied to the opposing electrode 15 has a data pulse having potential $V_D$ and the same polarity as the scan signal $S_{S5}$, during the first half of the selecting period $T_S$, and a pulse having potential $-V_D$ and the polarity opposite to that of the scan signal $S_{S5}$, during the latter half of the selecting period $T_S$. Hence, a selecting potential $V_{C1}-V_S$, which is lower than the ON-selecting voltage $V_{C1}$ is applied between the input of the active element 13 and the opposing electrode 15 during the first half of the selecting period $V_S$, and a selecting potential $V_{C1}+V_S$, which is higher than the ON-selecting voltage $V_{C1}$ is applied between the input of the active element 13 and the opposing electrode 15 during the latter half of the selecting period $V_S$.

Figures 32A, 32B:
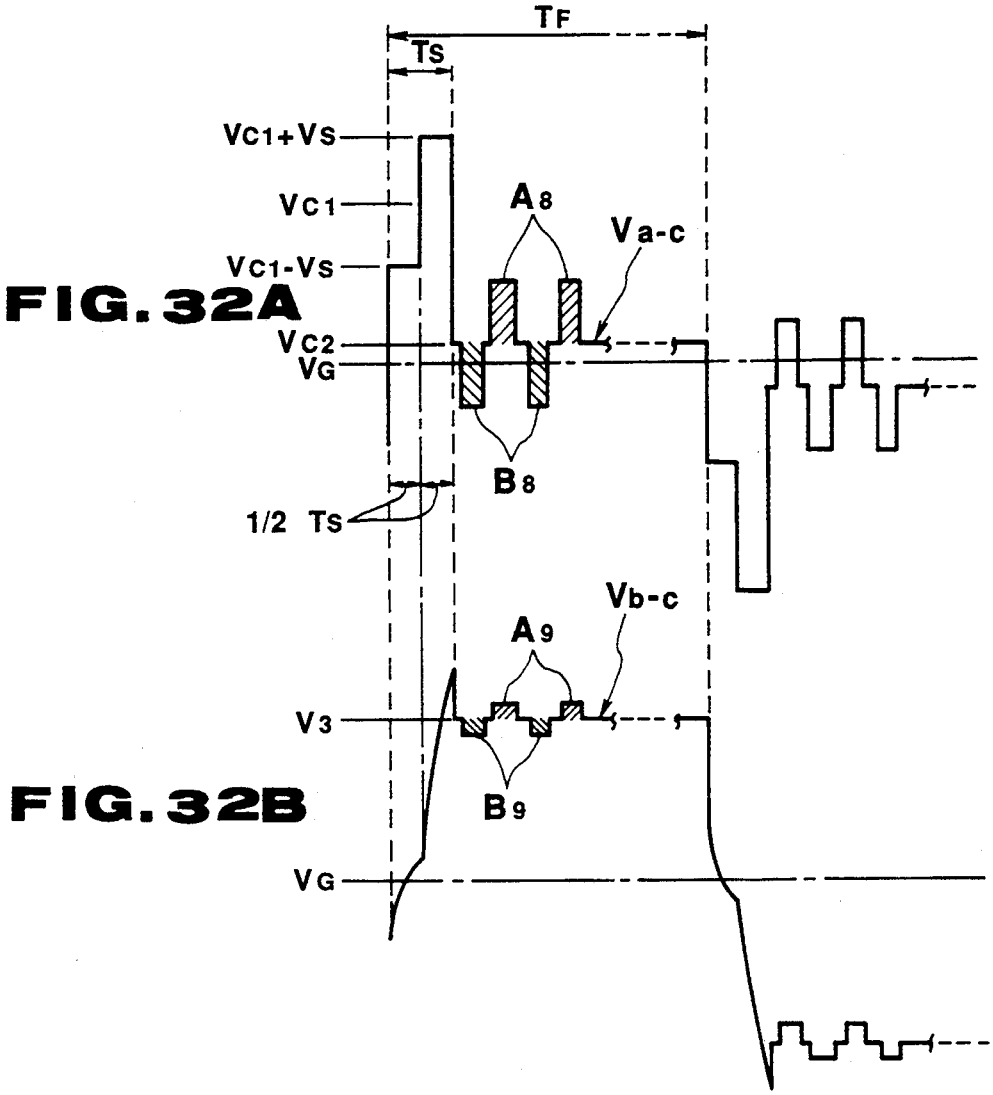
FIGS. 32A and 32B are diagrams showing the waveforms of two voltages applied between the input of the active element and the opposing electrode and between the pixel electrode and the opposing electrode, respectively, thereby to set the pixel at the fifth gray-level (i.e., the highest gray-level) in the fifth method according tot the invention.

When the composite selecting voltage having the waveform of FIG. 32A is applied between the input of the element 13 and the opposing electrode 15, a voltage Vb-c having the waveform shown in FIG. 32B is applied between the pixel electrode 12 connected to the active element 13 and the opposing electrode 15. As is clearly seen from FIG. 32B, the voltage Vb-c gradually increases along the curve defined by the low voltage $V_{C1}-V_S$ during the first half of the selecting period $T_S$, and then greatly increases along the curve defined by the high voltage $V_{C1}+V_S$ during the latter half of the period $T_S$.

Upon lapse of the selecting period $T_S$, or at the the start of the non-selecting period $T_O$, the voltage across the pixel capacitor $C_{LC}$ decreases at a predetermined rate to a voltage V3. This voltage V3 is held between the pixel electrode 12 and the opposing electrode 15.

In the fifth embodiment, as has been described, the selecting voltage applied between the input of the active element 13 and the opposing electrode 15 can have three values: the first value $V_{C1}$ (i.e., the ON-selecting voltage); the second value $V_{C1}-V_S$ lower than the first value $V_{C1}$; and the third value $V_{C1}+V_S$ higher than the first value $V_{C1}$. Hence, the voltage Vb-c applied between the pixel electrode 12 and the opposing electrode 15 increases along the curve defined by the voltage $V_{C1}$ when the ON-selecting voltage $V_{C1}$ is applied between the input of the element 13 and the opposing electrode 15. The voltage Vb-c increases more gently when the low voltage $V_{C1}-V_S$ is applied than when the ON-selecting voltage $V_{C1}$ is applied. The voltage Vb-c increases more abruptly when the high voltage $V_{C1}+V_S$ is applied than when the ON-selecting voltage $V_{C1}$ is applied.

The increase in the voltage Vb-c depends on the period of applying the voltage $V_{C1}$, the voltage $V_{C1}-V_S$, or the voltage $V_{C1}+V_S$, which is applied between the input of the element 13 and the opposing electrode 15. The peak value of the voltage Vb-c therefore changes in accordance with the ratio of the period of applying the voltage $V_{C1}$ to the period of applying the voltage $V_{C1}+V_S$. Hence, the voltage Vb-c held in the pixel capacitor $C_{LC}$ at the start of the non-selecting period $T_O$ is determined by the width of the data pulse superposed on the selecting voltage applied between in the input of the active element 13 and the opposing electrode 15.

The rising angle of the liquid crystal molecules depends on the voltage Vb-c applied between the pixel electrode 12 and the opposing electrode 15. Thus, the the transmittance of the pixel is controlled by the width of the data pulse superposed on the selecting voltage applied between in the input of the active element 13 and the opposing electrode 15.

The voltage Va-c shown in FIG. 30C contains two pulses superposed on the selecting voltage during the last parts of the halves of the selecting period $T_S$, respectively. Instead, the data pulses can be superposed, either during the initial parts or the intermediates parts of the halves of the selecting period $T_S$.

When the active matrix LCD elements are driven in time-division fashion, as described above, in order to display a gray-scale image, each scan signal $S_{S5}$ supplied to the signal line 14 is set at the non-selecting potential $V_{C2}$, and each data signal $S_{D5}$ supplied to the opposing electrode 15 to select the pixels of each row. The data signal $S_{D5}$ has pulses whose widths change in every period during which the pixels of one row are selected, in accordance with the image data externally supplied to the liquid-crystal display. Hence, the voltage Va-c applied between the input of the active element 13 and the opposing electrode 15 changes also during the non-selecting period $T_O$ in accordance with the image data for driving the other pixels of the same column.

Thus, the voltage applied between the pixel electrode 12 and the opposing electrode 15 changes during the non-selecting period $T_O$ by that part of change in the voltage Va-c which corresponds to the pixel capacitance $C_{LC}$, as it does at the start of the non-selecting period $T_O$. Hence, a non-selecting voltage having the waveform shown in FIG. 30D, 31B, or 32B is applied to the pixel during the non-selecting period $T_O$. The non-selecting voltage repeatedly changes according to the image data for driving the other pixels of the same column, from the value $V_{LC}$ (i.e., V1, V2, or V3) applied across the pixel capacitor $C_{LC}$ at the start of the non-selecting period $T_O$.

As is shown FIG. 30A, the scan signal $S_{S5}$ supplied to the signal line 14 during any one-field period $T_F$ remains at a positive or negative potential $V_{C1}$ during the selecting period $T_S$, and remains at a positive or negative lower potential $V_{C2}$ during the non-selecting period $T_O$. Further, as is shown in FIG. 30B, the data signal $S_{D5}$ supplied to the opposing electrode 15 has pulses whose widths are determined by the image data. The data signal $S_{D5}$ has components A7 positive with respect to the reference potential $V_G$, and components B7 negative with respect to the potential $V_G$ and having substantially the same total area as the components 7A. The signal $S_{D5}$ has the first positive pulse during the last part of the first half of the selecting period $T_S$, and the first negative pulse during the last part of the latter half of the period $T_S$. Hence the voltage Va-c applied during the non-selecting period $T_O$ between the input of the active element 13 and the opposing electrode 15 has components A8 positive with respect to the non-selecting potential $V_{C2}$ of the scan signal $S_{S5}$, and components B8 negative with respect to the non-selecting potential $V_{C2}$ of the scan signal $S_{S5}$, the total area of which is substantially equal to that of the components A8.

Therefore, as is evident from FIG. 30D, FIG. 31B, or FIG. 32B, the non-selecting voltage applied between the pixel electrode 12 and the opposing electrode 15 during the non-selecting period $T_O$ has components A9 positive with respect to the voltage V2, V1, or V3 held in the pixel capacitor $C_{LC}$ at the end of the selecting period $T_S$, and components B9 negative with respect to the voltage V2, V1, or V3 and having a total area substantially equal to that of the components A9. (The components A9 and B9 are at the same potential which corresponds to the changes in the non-selecting voltage Vb-c which have been caused by the image data for driving the other pixels of the same column.) Thus, the positive components A9 cancel out the negative components B9. The voltage (i.e., the hold voltage Vb-c) applied between the pixel electrode 12 and the opposing electrode 15 remains substantially unchanged, at V1, V2, or V3, during the non-selecting period $T_O$.

Since the voltage applied between the pixel electrode 12 and the opposing electrode 15 remains substantially unchanged during the non-selecting period $T_O$, the voltage-transmittance characteristic of the pixel remains substantially unchanged during the non-selecting period $T_O$. The transmittance of the pixel is maintained at the value corresponding to the hold voltage V1, V2, or V3 during the non-selecting period $T_O$. Hence, the pixel is set at the gray-level determined by the image data.

As has been described, the data signal $S_{D5}$ used in the fifth method of the invention has, during each selecting period $T_S$, two components which are positive and negative with respect to the reference potential $V_G$, respectively. It can have, instead, a greater even number of components which are alternately positive and negative with respect to the potential $V_G$. In short, the data signal $S_{D5}$ can have any waveform, provided the voltage applied between the input of the active element 13 and the opposing electrode 15 meets two requirements. First, it has a positive or negative pulse, whose width is determined by the image data, during the selecting period $T_S$. Second, during the non-selecting period $T_O$, it changes at intervals shorter than the selecting period $T_S$, such that the components positive with respect to the non-selecting potential $V_{C2}$ of the scan signal $S_{S5}$ have a total area equal to that of the components negative with respect to the non-selecting potential $V_{C2}$.

Sixth Embodiment

The method according to a sixth embodiment of the invention (to be referred as "sixth method") will be described, with reference to FIGS. 33A to 33D, FIGS. 34A and 34B, and FIGS. 35A and **35*b***. Some of the features of the sixth method are identical to those of the fourth method, and therefore will not be described.

The sixth method is designed to drive active matrix LCD elements of the liquid-crystal display shown in FIGS. 8 and 9, thereby to display a multi-gray-scale image. This method is characterized in that the gray-level of each pixel is controlled, eliminating changes in the transmittance thereof which result from the influence of the condition in which the other pixels are driven.

Figures 33A, 33B, 33C, 33D:
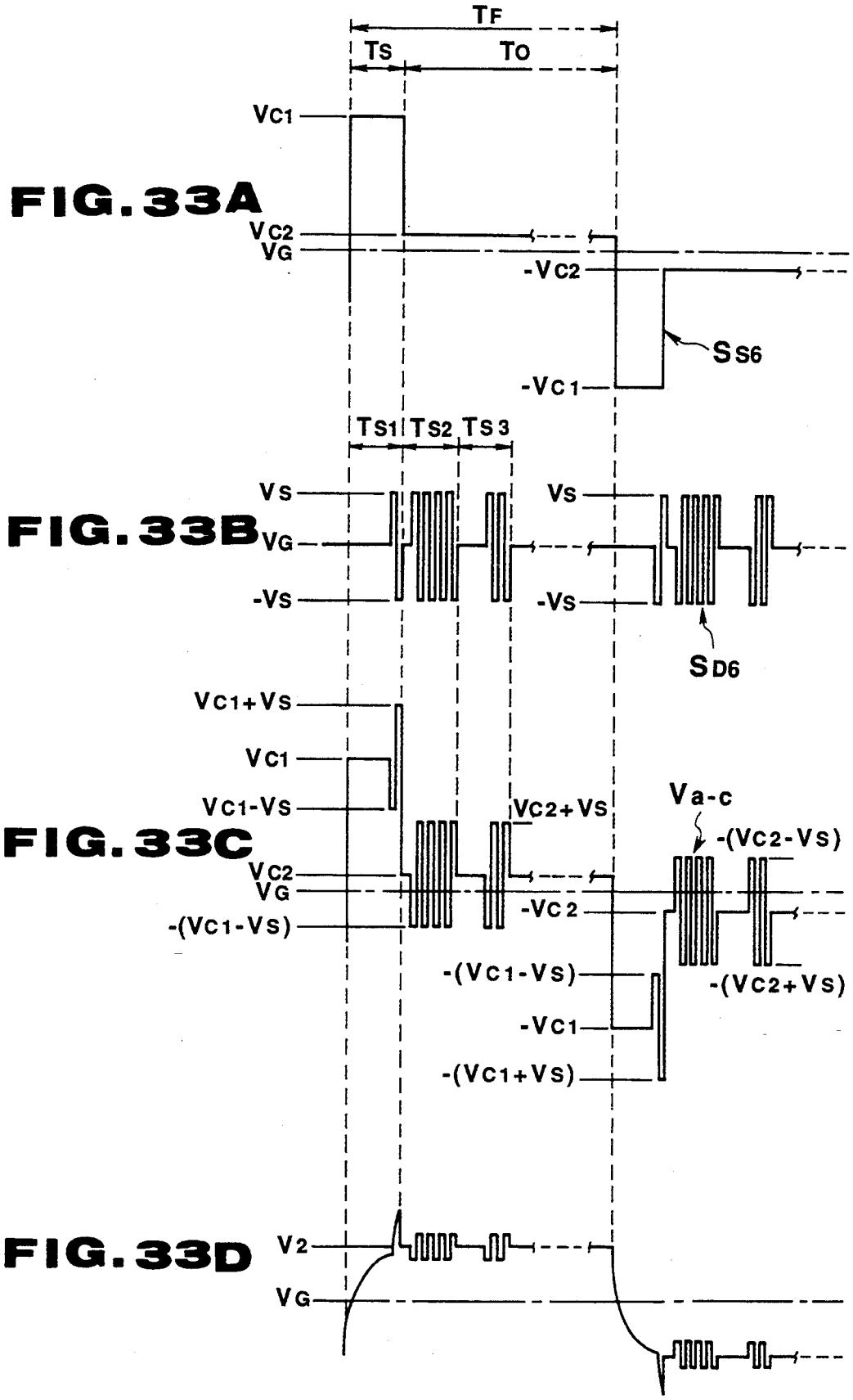
FIG. 33A is a diagram showing the waveform of the scan signal used in the method according to a sixth embodiment of the present invention.
FIG. 33B is a diagram showing the waveform of the data signal used in the sixth embodiment of the invention.
FIG. 33C is a diagram illustrating the waveform of the voltage applied between the input of the active element and the opposing electrode when the scan signal and the data signal, shown in FIGS. 33A and 33B, are supplied to the signal line and the opposing electrode, respectively.
FIG. 33D is a diagram representing how the voltage applied between the pixel electrode and the opposing electrode changes when the voltage shown in FIG. 33C is applied between the input of the active element and the opposing electrode.

FIG. 33A is a diagram showing the waveform of a scan signal $S_{S6}$ supplied between the first signal line 14 of the liquid-crystal display shown in FIGS. 8 and 9. FIG. 33B is a diagram illustrating a data signal $S_{D6}$ supplied to one of the opposing electrodes 15 shown in FIG. 8. FIG. 33C is a diagram showing the waveform of a voltage Va-c applied between the opposing electrode 15 and the input of the active element 13 connected to the signal line 14, or between points a and c in the equivalent circuit shown in FIG. 10. FIG. 33D is a diagram representing the waveform of a voltage Vb-c applied between the pixel electrode 12 connected to the active element 13 and the opposing electrode 15, or between points b and c in the equivalent circuit shown in FIG. 10.

As shown FIG. 33A, the scan signal $S_{S6}$ is identical to the scan signal $S_{S4}$ used in the fourth method. The signal $S_{S6}$ remains at a selecting potential $V_{C1}$ during the selecting period $T_S$ and at a non-selecting potential $V_{C2}$ during a non-selecting period $T_O$. The scan signal $S_{S6}$ has its polarity altered at the end of every one-field period $T_F$.

As is shown in FIG. 33B, the data signal $S_{D6}$ has data pulses the number of which accords with the image data externally supplied during a period $T_S$ during which to selects the pixels of each row. The potential of the data signal $S_{D6}$ alters with respect to a reference voltage $V_G$ at regular intervals, the length of which is obtained by dividing the selecting period $T_S$ by any even numbers. Although the period $T_S$ is divided by 10, for simplicity and clarity, in FIG. 33B, it is divided by, for example, into tens of equal intervals in practice. The length of these intervals is equal to the width of each data pulse.

During each selecting period $T_S$, the data signal $S_{D6}$ has as many data pulses having a positive potential $V_S$ as data pulses having a negative potential $-V_S$. In other words, the signal $S_{D6}$ has positive data pulses and the same number of negative pulses—all data pulses are identical in both width and absolute potential value. Hence, as can be understood from FIG. 33B, the total area of the positive pulses the signal $S_{D6}$ has during each selecting period $T_S$ is substantially equal to that of the negative pulses the signal $S_{D6}$ has during the same selecting period $T_S$.

More precisely, as is shown in FIG. 33B, the data signal $S_{D6}$ has one positive pulse and one negative pulse during the selecting period $T_{S1}$ for the first opposing electrode 15 during which to select the pixels of the first row. It has four positive pulses and four negative pulses during the second selecting period $T_{S2}$ during which to select the pixels of the second row, and two positive pulses and two negative pulses during the third selecting period $T_{S3}$ during which to select the pixels of the third row. The number of pulses which the signal $S_{D6}$ has during each of the selecting periods $T_{S1}$, $T_{S2}$, and $T_{S3}$ changes in accordance with the externally supplied image data, from 0 (no pulses) to n. Here, "n" is is greatest number of pulses that can be applied during the selecting period $T_S$, depending on the width of each pulse.

When the scan signal $S_{S6}$ and the data signal $S_{D6}$, which have the waveform shown in FIGS. 33A and 33B, are supplied to the opposing electrode 15 and the signal line 14, respectively, a voltage Va-c having the waveform shown in FIG. 33C is applied between the input of the active element 13 connected to the first signal line 14 and the opposing electrode 15. As can be understood from FIG. 33C, the voltage Va-c is a combination of the scan signal $S_{S6}$ and the data signal $S_{D6}$.

Of the voltage Va-c supplied between the input of the active element 13 and the opposing electrode 15, that part applied during the selecting period $T_S$ (hereinafter called "selecting voltage") is at a potential $V_{C1}$, i.e., the selecting potential of the scan signal $S_{S6}$, while the data signal $S_{D6}$ remains at zero potential, is at a potential $V_{C1}-V_S$ for the duration of the positive data pulse, and is at a potential $V_{C1}+V_S$ for the duration of the negative data pulse. These potentials $V_{C1}$, $V_{C1}-V_S$, and $V_{C1}+V_S$ are identical in value to those applied during each selecting period $T_S$ in the fourth method according to the invention.

Of the voltage Va-c supplied between the input of the active element 13 and the opposing electrode 15, that part applied during the non-selecting period $T_O$ (hereinafter called "non-selecting voltage") is at a potential $V_{C2}$, i.e., the non-selecting potential of the scan signal $S_{S6}$, while the data signal $S_{D6}$ remains at zero potential, is at a potential $V_{C2}+V_S$ for the duration of each positive data pulse, and is at a potential $-(V_{C1}-V_S)$ for the duration of each negative data pulse. These potentials $V_{C2}$, $V_{C2}+V_S$, and $-(V_{C1}-V_S)$ are identical in value to those applied during each non-selecting period $T_O$ in the fourth method according to the invention.

The non-selecting voltage consists of positive data pulses and negative data pulses representing the image data for driving the other pixels of the same column. The total area of its components positive with respect to the non-selecting potential $V_{C2}$ of the scan signal $S_{S6}$ is substantially equal to that of its components negative with respect to the non-selecting potential $V_{C2}$.

When the selecting voltage (FIG. 33C) is applied between the input of the element 13 and the opposing electrode 15, a voltage is applied between the pixel electrode 12 connected to the active element 13 and the opposing electrode 15. As a result, the pixel capacitor $C_{LC}$, which is formed of the pixel electrode 12 and the opposing electrode 15 and the liquid-crystal layer sandwiched between these electrodes 12 and 15, begins to be electrically charged.

Upon lapse of the selecting period $T_S$, or at the the start of the next selecting period $T_S$, the voltage Va-c the voltage falls from $V_{C1}+V_S$ to $V_{C2}$. The active element 13 is thereby turned off, and the pixel capacitor $C_{LC}$ is no longer charged. As a result, as is shown in FIG. 33D, the voltage across the pixel capacitor $C_{LC}$ decreases to a voltage $V_2$ by that portion in changed in the voltage Va-c which corresponds to the pixel capacitance $V_{LC}$.

In the sixth method of the invention, the active matrix LCD elements are driven in essentially the same way as in the fourth method, in order to display a gray-scale image. How the LCD elements are driven to display a gray-scale image will now be explained with with reference to FIGS. 33C and 33D, FIGS. 34A and 34B, and FIGS. 35A and 35B.

Figures 34A, 34B:
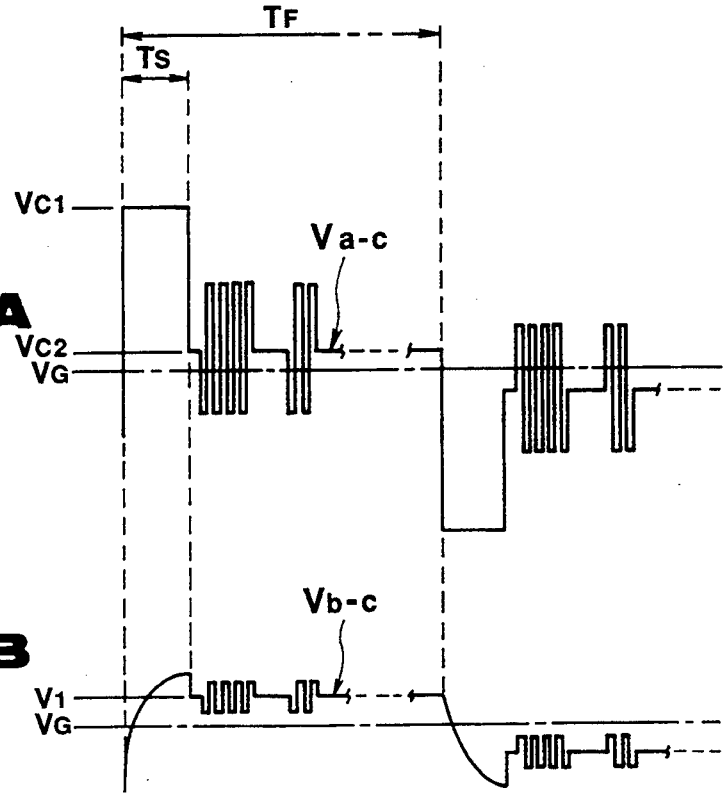
FIGS. 34A and 34B are diagrams showing the waveforms of two voltages applied between the input of the active element and the opposing electrode and between the pixel electrode and the opposing electrode, respectively, thereby to set the pixel at the 0-th gray-level in the sixth embodiment of the invention.
Figures 35A, 35B:
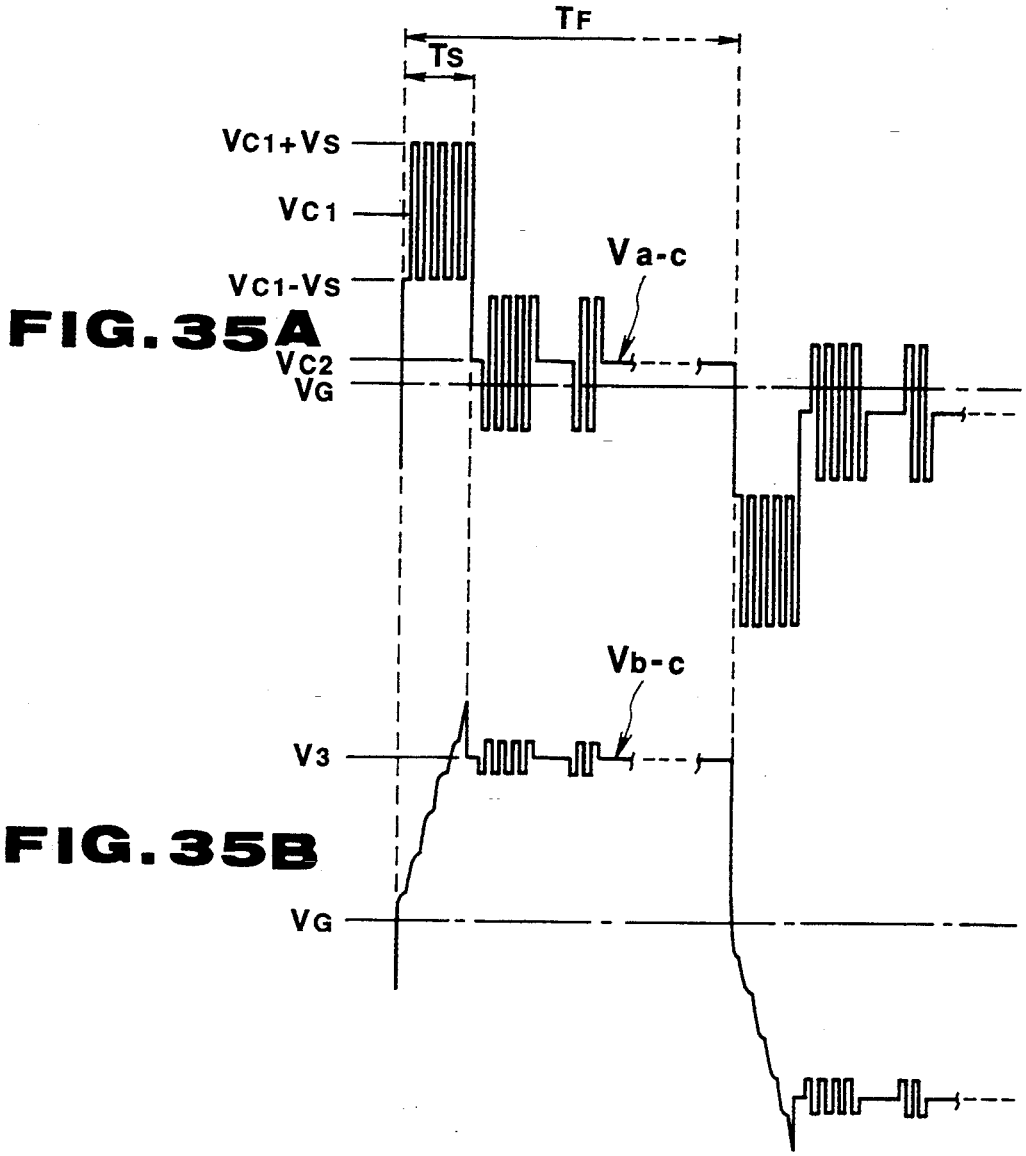
FIGS. 35A and 35B are diagrams showing the waveforms of two voltages applied between the input of the active element and the opposing electrode and between the pixel electrode and the opposing electrode, respectively, thereby to set the pixel at the n-th gray-level (i.e., the highest gray-level) in the sixth embodiment of the invention.

FIGS. 33C, 34A, and 35A represent the waveforms of voltages Va-c applied between the input of the active element 13 and the opposing electrode 15, and FIGS. 33D, 34B, and 35B illustrate the waveforms of voltages Vb-c applied between the pixel electrode 12 and the opposing electrode 15.

To set the pixel at the 0-th gray-level of an n-level gray scale, a data signal $S_{D6}$ having no pluses is supplied to the input of the active element 13 during the selecting period $T_S$. Further, for this purpose, a composite voltage Va-c having the waveform of FIG. 34A is applied between the input of the element 13 and the opposing electrode 15, and a voltage Vb-c having the waveform of FIG. 34B is applied between the pixel electrode 12 and the opposing electrode 15.

To set the pixel at the first gray-level of the n-level gray scale, a data signal $S_{D6}$ having one positive data pulse and one negative data pulse is supplied to the input of the active element 13 during the selecting period $T_S$. Further, for this purpose, a composite voltage Va-c having the waveform of FIG. 33C is applied between the input of the element 13 and the opposing electrode 15, and a voltage Vb-c having the waveform of FIG. 33D is applied between the pixel electrode 12 and the opposing electrode 15.

To set the pixel at the n-th gray-level (i.e., the highest gray-level) of the n-level gray scale, a data signal $S_{D6}$ having n positive pluses and n negative pulses is supplied to the input of the active element 13 during the selecting period $T_S$. Further, for this purpose, a composite voltage Va-c having the waveform of FIG. 35A is applied between the input of the element 13 and the opposing electrode 15, and a voltage Vb-c having the waveform of FIG. 35B is applied between the pixel electrode 12 and the opposing electrode 15.

In the sixth method, too, the voltage Vb-c, which is applied between the pixel electrode 12 and the opposing electrode 15, gradually increases along the curve determined by an ON-selecting voltage when the ON-selecting voltage, which is applied applied between the input of the active element 13 and the opposing electrode 15, remains at the potential $V_{C1}$, slowly increases along the curve defined by the ON-selecting voltage when the ON-selecting voltage remains at the potential $V_{C1}-V_S$ which is lower than the potential $V_{C1}$, and fast increases along the curve determined by the ON-selecting voltage when the ON-selecting voltage has the value of $V_{C1}+V_S$ which is higher than the potential $V_{C1}$. Since the number of data pulses of the the selecting voltage changes in accordance with the image data, the voltage Vb-c applied between the pixel electrode 12 and the the opposing electrode 15 increases in steps the number of which is equal to that of the data pulses, as can be understood from FIGS. 33D, 34B, and 35B.

Hence, the voltage Vb-c held in the pixel capacitor $C_{LC}$ upon lapse of the selecting period $T_S$, or at the start of the non-selecting period $T_O$ changes in accordance with the period during which the selecting voltage remains at the high value, which is determined by the number of the data pulses.

Thus, as in the fourth method, a selecting voltage having pulses, the number of which corresponds to the data signal, is applied between the input of the active element 13 and the opposing electrode 15 during the selecting period $T_S$, and a voltage corresponding to the total width of the data pulses contained in the selecting voltage is applied between the pixel electrode 12 connected to the active element 13 and the opposing electrode 15, thereby to control the transmittance of the pixel. As a result, the liquid-crystal display elements can display a gray-scale image.

Also in the sixth method, the scan signal $S_{S6}$ supplied to the signal line 14 is maintained at a selecting potential $V_{C1}$ or $-V_{C1}$ during each selecting period $T_S$, at a non-selecting potential $V_{C2}$ or $-V_{C2}$, the absolute value of which is less that that of the selecting potential $V_{C1}$ or $-V_{C1}$. The data signal $S_{D6}$ supplied to the opposing electrode 15 has a potential which alter from the reference value $V_G$, and hence consists of positive pulses and the same number of negative pulses—all pulses having the same amplitude and the same width obtained by dividing the selecting period $T_S$ by an odd number. Therefore, the voltage Va-c applied during the non-selecting period $T_O$ between the input of the active element 13 and the opposing electrode 15 has such a waveform that, as has been described, the components positive with respect to the non-selecting potential $V_{C2}$ of the scan signal $S_{S6}$ have a total area substantially equal to that of the components negative with respect to the non-selecting potential $V_{C2}$.

The non-selecting voltage, which has the waveform shown in FIG. 33D, 34B, or 35B and is applied between the pixel electrode 12 and the opposing electrode 15 during the non-selecting period $T_O$, alters from the value $V_{LC}$ (i.e., V1, V2, or V3) held in the pixel capacitor $C_{LC}$ at the start of the non-selecting period $T_O$, every time by that change in the voltage Va-c which results from the image data for driving the other pixels of the same column. The non-selecting voltage applied between the pixel electrode 12 and the opposing electrode 15 during the non-selecting period $T_O$ has such a waveform that its components positive to the voltage V2, V1, or V3 have a total area substantially equal to that of its components negative to the voltage V2, V1, or V3.

Thus, the positive components cancel out the negative components. The voltage applied between the pixel electrode 12 and the opposing electrode 15 remains substantially unchanged, at V1, V2, or V3, during the non-selecting period $T_O$.

Since the voltage applied between the pixel electrode 12 and the opposing electrode 15 remains substantially unchanged during the non-selecting period $T_O$, the voltage-transmittance characteristic of the pixel remains substantially unchanged during the non-selecting period $T_O$. The transmittance of the pixel is maintained at the value corresponding to the hold voltage V1, V2, or V3 during the non-selecting period $T_O$. Hence, the pixel is set at the gray-level determined by the image data.

In the sixth method, the selecting voltage is a combination of the selecting voltage and data pulses superposed on the selecting voltage during the last part of the selecting period $T_S$. Instead, the data pulses can be superposed on the selecting voltage, either during the initial part of the period $T_S$ or during the intermediate part thereof.

Seventh Embodiment

The method according to a seventh embodiment of the invention (to be referred as "seventh method") will now be described. The seventh method is designed to drive active matrix LCD elements of the liquid-crystal display shown in FIGS. 8 and 9, thereby to display a multi-gray-scale image. The seventh method is characterized in that not only the widths of pulses of a data signal, but also the potentials thereof are changed in accordance with externally supplied image data.

With reference to FIGS. 8 and 9, FIGS. 36A to 36D, FIGS. 38, FIGS. 39A and 39B, FIGS. 40A and 40B, FIGS. 41A and 41B, FIGS. 42A and 42B, FIGS. 43A and 43B, FIGS. 44A and 44B, FIG. 45, and FIG. 46, it will be explained how the LCD elements are driven in the seventh method in order to display a multi-gray scale image.

FIGS. 36A to 36D are diagram showing the waveforms of the various drive signals used in the third method, wherein the widths and potentials of data pulses are changed in accordance with externally supplied image data, thereby to control the gray-levels of the pixels of the LCD elements.

Figures 36A, 36B, 36C, 36D:
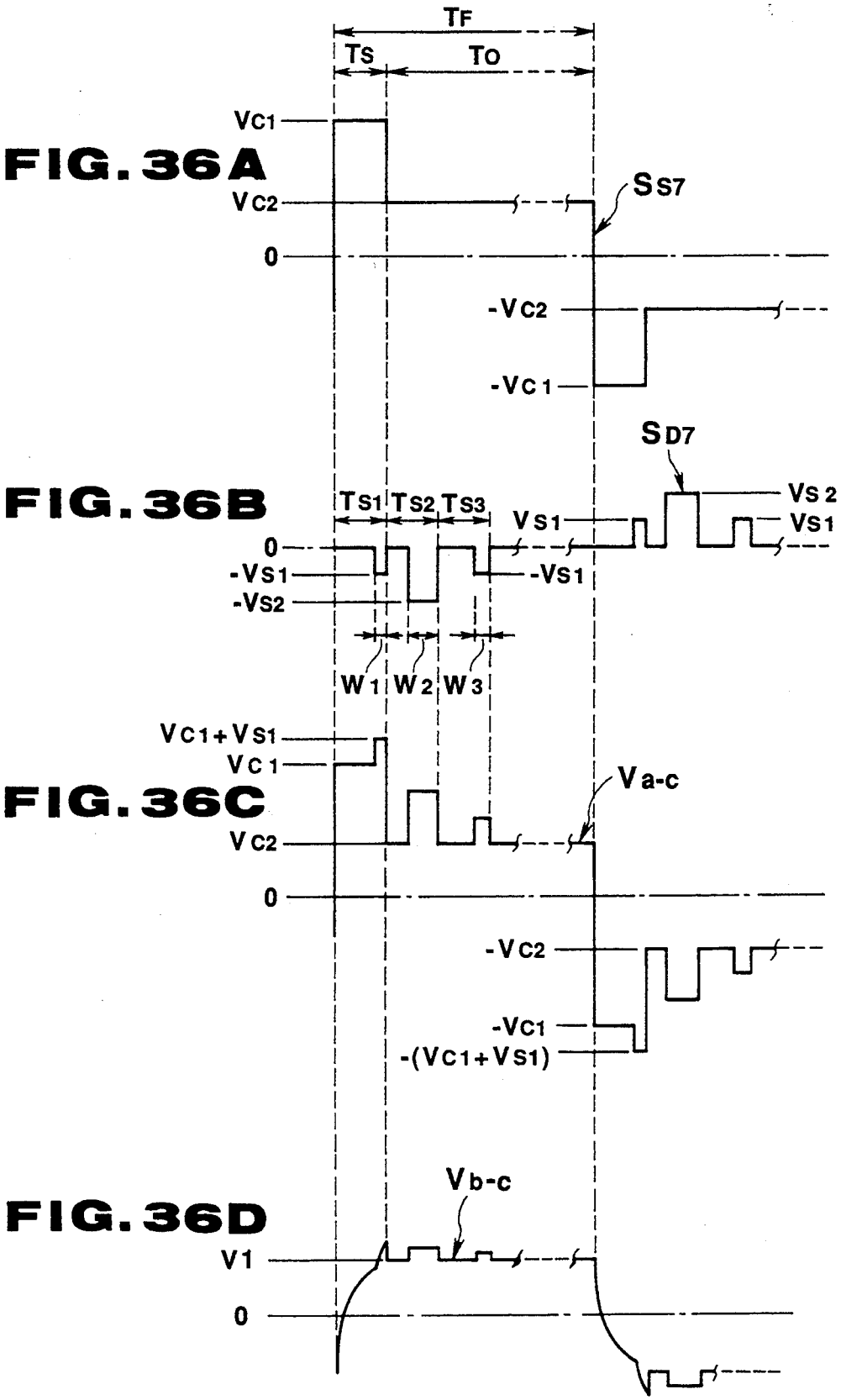
FIG. 36A is a diagram showing the waveform of the scan signal used in the method according to a seventh embodiment of the present invention.
FIG. 36B is a diagram showing the waveform of the data signal used in the seventh embodiment of the invention.
FIG. 36C is a diagram illustrating the waveform of the voltage applied between the input of the active element and the opposing electrode when the scan signal and the data signal, shown in FIGS. 36A and 36B, are supplied to the signal line and the opposing electrode, respectively.
FIG. 36D is a diagram representing how the voltage applied between the pixel electrode and the opposing electrode changes when the voltage shown in FIG. 36C is applied between the input of the active element and the opposing electrode.

FIG. 36A shows the waveform of a scan signal $S_{S7}$ supplied to the first opposing electrode 15. FIG. 36B illustrates the waveform of a data signal $S_{D7}$ supplied to one of the signal lines 14. FIG. 36C shows the waveform of a voltage Va-c applied between the input of one of the active elements 13 (i.e., the node of the element 13 and the signal line 14) and the opposing electrode 15—that is, between points a and c in the equivalent circuit shown in FIG. 10. FIG. 36D shows the waveform of a voltage Vb-c applied between the pixel electrode 12 and the opposing electrode 15—that is, between points b and c in the equivalent circuit of FIG. 10. In FIGS. 36 to 36D, $T_S$ is a selecting period, obtained by dividing a one-field period $T_F$ by the number of signal lines 14 provided.

As is clearly seen from FIG. 36A, the scan signal $S_{S7}$ remains at a selecting potential $V_{C1}$ during the selecting period $T_S$ and at a non-selecting potential $V_{C2}$ during a non-selecting period $T_O$, like the signal $S_{S3}$ used in the third method. The scan signal $S_{S7}$ has its polarity altered at the end of every one-field period $T_F$.

As is evident from FIG. 36B, the data signal $S_{D7}$ has pulses whose widths and potentials change during every selecting period $T_S$ in accordance with the image data externally supplied. The potential of each data pulse of this signal $S_{D7}$ is either $V_{S1}$ or $V_{S2}$, in accordance with the image data. In this embodiment, $V_{S1}=V_{S2}/2$. The data signal $S_{D7}$ has the polarity which is opposite to that of the scan signal $S_{S7}$ supplied to the opposing electrode 15. The polarity of each data pulse alters at the end of every one-field period $T_F$.

As can be seen from FIG. 36B, too, the pulses of the data signal $S_{D7}$ have different widths W1, W2, W3, and so on. More precisely, the first data pulse for selecting the first opposing electrode 15 for a period $T_{S1}$ has a potential of $V_{S1}$ and width W1 which is 2/10 of the selecting period $T_S$; the second data pulse for selecting the second opposing electrode 15 for a period $T_{S2}$ has a potential of $V_{S2}$ and a width W2 which is 6/10 of the selecting period $T_S$; and the third data pulse for selecting the third opposing electrode 15 for a period $T_{S3}$ has a potential of $V_{S1}$ and a width W3 which is 3/10 of the selecting period $T_S$. These pulse widths W1, W2, and W3 change over a range from 0 (i.e., no pulse) to $T_S$ (i.e., the value equal to the period $T_S$), in accordance with the image data and the potential $V_{S1}$ or $V_{S2}$ selected based on the image data.

Figure 37:
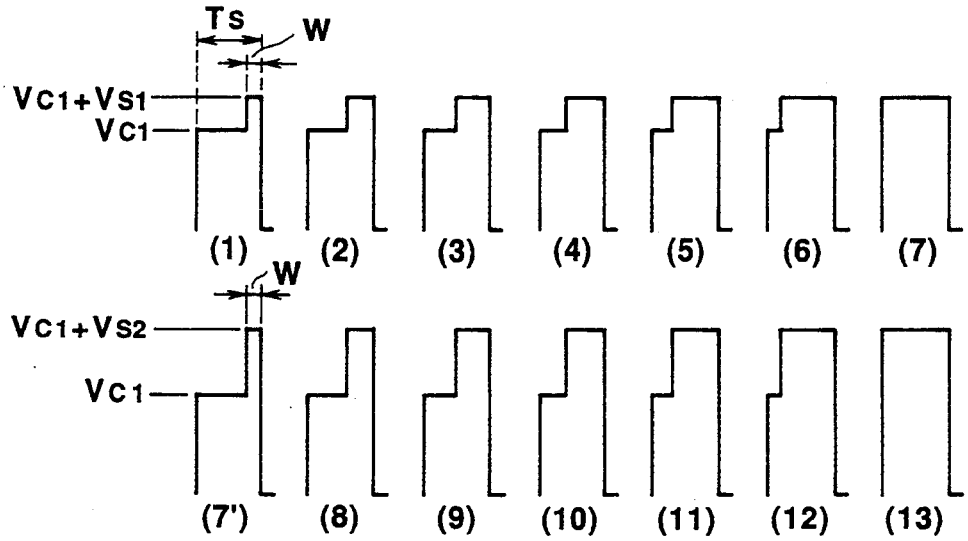
FIG. 37 is a diagram showing the waveforms of various selecting voltages used in the seventh method to set each pixel at various gray-levels.

FIG. 37 illustrates the waveforms of various selecting voltages 1 to 13 to apply between the input of the active element 13 and the opposing electrode 15 during the selecting period $T_S$. Of these selecting voltages, the voltages 7 and 7′ are used to set pixels at the same gray-level. As is evident from FIG. 37, the selecting voltages 1 to 7 have different pulse widths W (more specifically, pulse widths of the peak voltage), and are of the same peak value of $V_{C1}+V_{S1}$ which is a combination of the selecting potential $V_{C1}$ and the data-pulse potential $V_{S1}$ of the data signal $D_{S7}$. Similarly, the selecting voltages 7′ to 13 have different pulse widths W, and are of the same peak value of $V_{C1}+VS1$ which is a combination of the selecting potential $V_{C1}$ and the data-pulse potential $V_{S1}$ of the data signal $D_{S7}$. The pulse widths of the voltages 7′ to 13 are identical to those of the voltages 1 to 7, respectively. The pulse widths of the selecting voltages 7′ and 13 are equal to the selecting period $T_S$.

Figure 38:
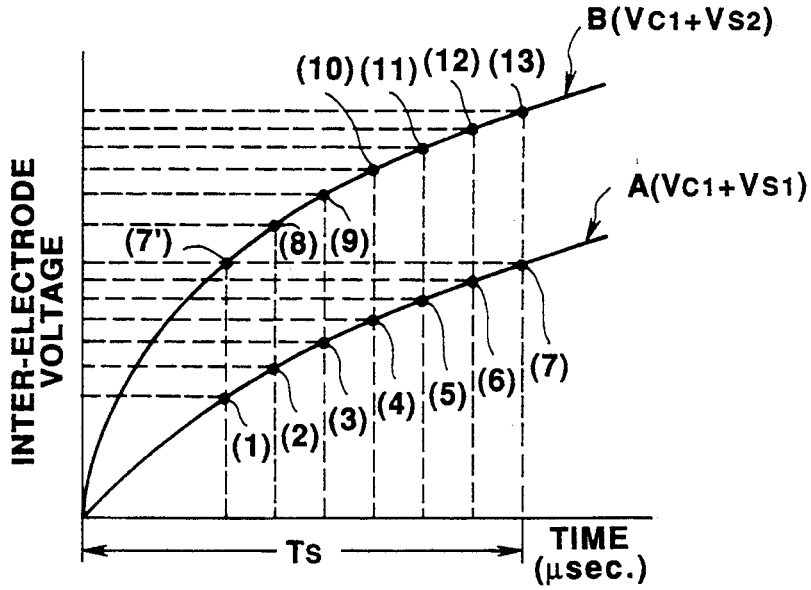
FIG. 38 is a graph illustrating how the inter-electrode voltage of each pixel changes when the selecting voltages having the waveforms shown in FIG. 37 are applied, one by one, between the input of the active element and the opposing electrode.

FIG. 38 is a graph representing how the voltage applied between the pixel electrode 12 and the opposing electrode 15 changes when the selecting voltages 1 to 7, and as the selecting voltages 7′ to 13 are applied between the input of the active element 13 and the opposing electrode 15. To be more precise, curve A shows how the inter-electrode voltage changes as the voltages 1 to 7, whose peak potential is $V_{C1}+V_{S1}$, are applied, one by one, between the input of the active element 13 and the opposing electrode 15. Curve B indicates how the inter-electrode voltage changes as the voltages 7′ to 13, whose peak potential is $V_{C1}+V_{S2}$, are applied, one by one, between the input of the active element 13 and the opposing electrode 15. As curves A and B suggest, the inter-electrode voltage increases for the time corresponding to the pulse width of any selecting voltage applied between the input of the active element 13 and the opposing electrode 15.

Since the selecting voltages 1 to 7 have the same potential but different pulse widths, the increases in the inter-electrode voltage, which results from the application of the voltages 1 to 7, are different for setting the pixel at different gray-levels. Likewise, since the selecting voltages 7′ to 13 have the same peak potential but different pulse widths, the increases in the inter-electrode voltage, which results from the application of the voltages 7′ to 13, are different for setting the pixel at different gray-levels.

As has been described, the selecting voltages 7′ to 13 have pulse widths equal to those of the voltages 1 to 7, respectively, but peak potential different from those of the voltages 1 to 7, respectively. Thus, the increase in the inter-electrode voltage, which occurs when any one of the voltages 7′ to 13 is applied, differs from that which occurs when one of the voltages 1 to 7, which has the same pulse width as said any one of the voltages 7′ to 13. The inter-electrode voltage increases when the voltage 7 is applied, by substantially the same value as when the voltage 7′ is applied.

Figures 39A, 39B:
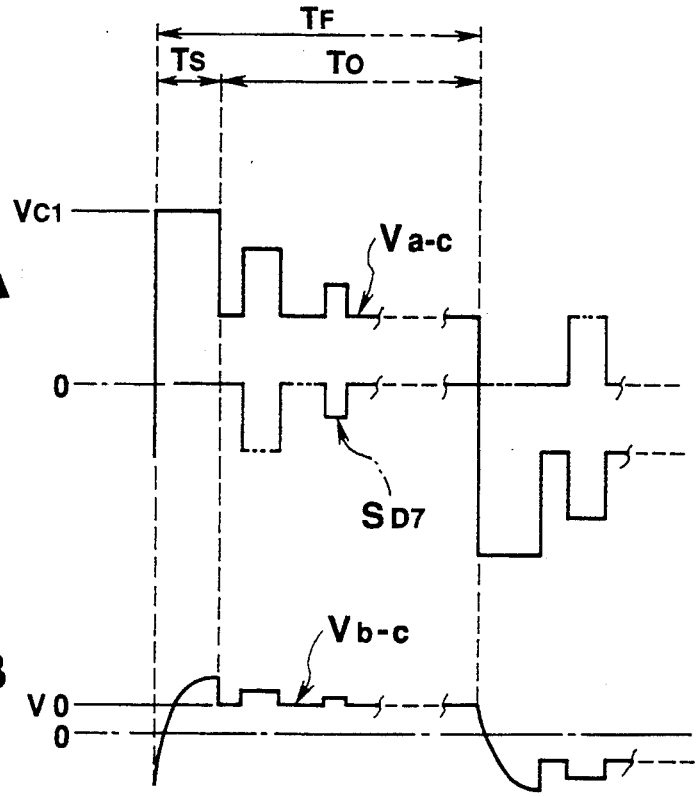
FIGS. 39A and 39B are diagrams showing the waveforms of two voltages applied between the input of the active element and the opposing electrode and between the pixel electrode and the opposing electrode, respectively, thereby to set the pixel at the 0-th gray-level in the seventh method according to the invention.

To drive the active matrix LCD element at 0-th gray-level of a 14-level gray scale, a data signal $S_{D7}$ having no data pulses during the selecting period $T_S$ is supplied to the active element 13. In this case, a composite voltage having the waveform shown in FIG. 39A is applied between the input of the active element 13 and the opposing electrode 15. As is shown in FIG. 39B, the voltage Vb-c applied between the pixel electrode 12 and the opposing electrode 15 gradually rises throughout the selecting period $T_S$ in accordance with the ON-selecting voltage $V_{C1}$.

Upon lapse of the selecting period $T_S$, or at the start of the non-selecting period $T_O$, the active element 13 is turned off. The voltage across the pixel capacitor $C_{LC}$ decreases from the voltage charged the period $T_S$, to a voltage V0, by that part in the change in the voltage Va-c which corresponds to the pixel capacitance $C_{LC}$. (Said part in the change in the voltage Va-c is one of the two voltages obtained by dividing the change in the voltage Va-c by the element capacitance $C_D$ and the pixel capacitance $C_{LC}$.) This voltage V0 is held between the pixel electrode 12 and the opposing electrode 15.

To drive the active matrix LCD element at the first gray-level of the 14-level gray scale, a data signal $S_{D7}$ having the waveform of FIG. 36B is supplied to the active element 13. This data signal $S_{D7}$ has a pulse during the selecting period $T_S$, whose width is 2/10 of the period $T_S$, and whose potential is $-V_{S1}$. In this case, a composite voltage having the waveform shown in FIG. 36C is applied between the input of the active element 13 and the opposing electrode 15. This composite voltage has a waveform identical to that of the selecting voltage 1 shown in FIG. 37. Then, as is shown in FIG. 36D, the voltage Vb-c applied between the pixel electrode 12 and the opposing electrode 15 gradually increases along the curve defined by the ON-selecting voltage $V_{C1}$, and fast increases to the potential 1 shown in FIG. 38 during the last part of the selecting period $T_S$ along the curve defined by the high voltage $V_{C1}+V_{S1}$.

Upon lapse of the selecting period $T_S$, or at the start of the non-selecting period $T_O$, the voltage across the pixel capacitor $C_{LC}$ decreases by a certain value to a voltage V1. This voltage V1 is held between the pixel electrode 12 and the opposing electrode 15.

Figures 40A, 40B:
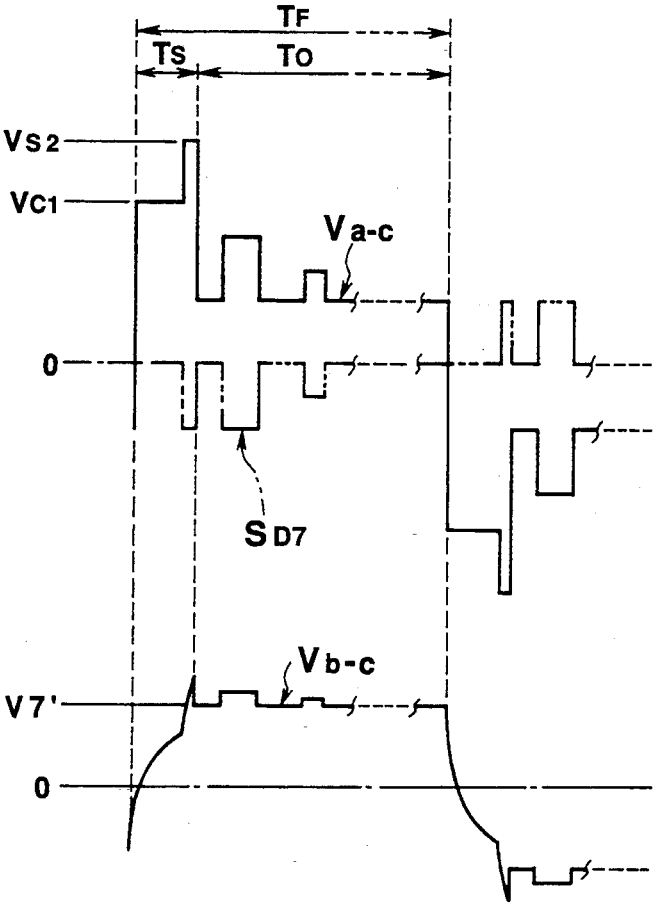
FIGS. 40A and 40B are diagrams showing the waveforms of two voltages applied between the input of the active element and the opposing electrode and between the pixel electrode and the opposing electrode, respectively, thereby to set the pixel at the seventh gray-level in the seventh method according to the invention.

To drive the active matrix LCD element at the seventh gray-level of the 14-level gray scale, a data signal $S_{D7}$ having a pulse whose width is 2/10 of the period $T_S$ and whose potential is $V_{S2}$, is supplied to the active element 13. In this case, a composite voltage having the waveform shown in FIG. 40A is applied between the input of the active element 13 and the opposing electrode 15. The composite voltage has a waveform identical to that of the selecting voltage 7' shown in FIG. 37. The data-pulse width of the selecting voltage is equal to that of the selecting voltage shown in 36D. Therefore, as is shown in FIG. 40B, the voltage Vb-c applied between the pixel electrode 12 and the opposing electrode 15 increases for the same period as the voltage Vb-c shown in FIG. 36D, but increases faster to the greater value 7' shown in FIG. 38. This is because the composite voltage has a peak value $V_{C1}+V_{S2}$ which is greater than the peak value $V_{C1}+V_{S1}$ of the composite voltage shown in FIG. 36C.

Upon lapse of the selecting period $T_S$, or at the start of the non-selecting period $T_O$, the voltage across the pixel capacitor $C_{LC}$ decreases by a certain value to a voltage V7'. This voltage V7' is held between the pixel electrode 12 and the opposing electrode 15.

Figures 41A, 41B:
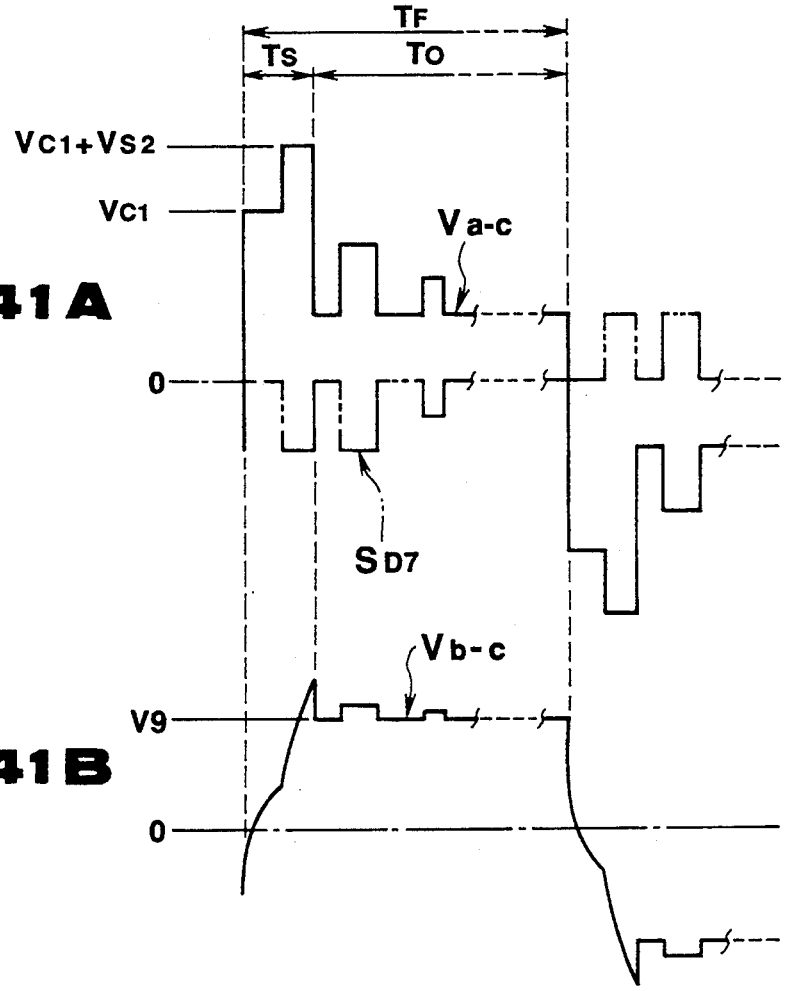
FIGS. 41A and 41B are diagrams showing the waveforms of two voltages applied between the input of the active element and the opposing electrode and between the pixel electrode and the opposing electrode, respectively, thereby to set the pixel at the ninth gray-level in the seventh method according to the invention.

To drive the active matrix LCD element at the ninth gray-level of the 14-level gray scale, a data signal $S_{D7}$ having a pulse during the selecting period $T_S$, whose width is 5/10 of the period $T_S$ and whose potential is $V_{S2}$, is supplied to the active element 13. In this case, a composite voltage having the waveform shown in FIG. 41A is applied between the input of the active element 13 and the opposing electrode 15. The composite voltage has a waveform identical to that of the selecting voltage 9 shown in FIG. 37.

Then, as is shown in FIG. 41B, the voltage Vb-c applied between the pixel electrode 12 and the opposing electrode 15 increases along the curve defined by the ON-selecting voltage $V_{C1}$ during the first half of the selecting period $T_S$, and fast increases along the curve defined by a higher voltage $V_{C1}+V_{S2}$ during the latter half of the selecting period $T_S$. Since the peak value of the composite voltage is equal to that of the composite voltage shown in FIG. 40A, the voltage Vb-c increases along the same curve as the voltage Vb-c shown in FIG. 40B. The voltage Vb-c shown in FIG. 41B, however, increases to the greater value 9 shown in FIG. 38.

Upon lapse of the selecting period $T_S$, or at the start of the non-selecting period $T_O$, the voltage across the pixel capacitor $C_{LC}$ decreases by a certain value to a voltage V9. This voltage V9 is held between the pixel electrode 12 and the opposing electrode 15.

Figures 42A, 42B:
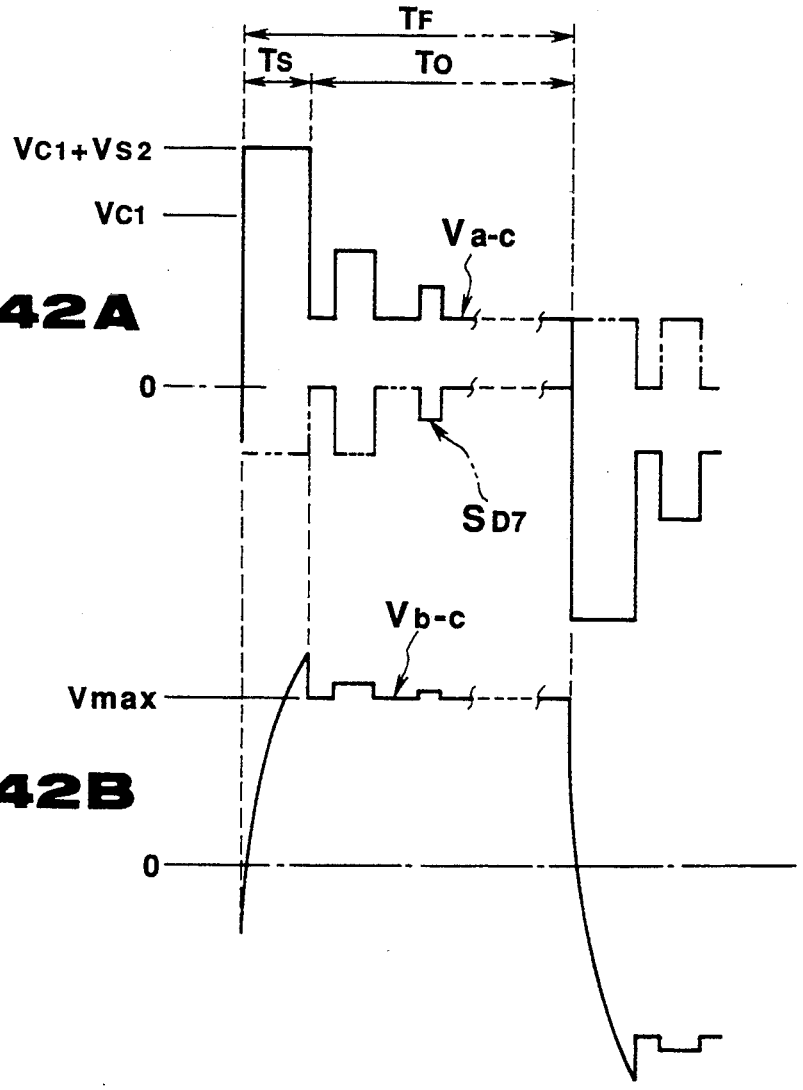
FIGS. 42A and 42B are diagrams showing the waveforms of two voltages applied between the input of the active element and the opposing electrode and between the pixel electrode and the opposing electrode, respectively, thereby to set the pixel at the thirteenth gray-level in the seventh method according to the invention.

To drive the active matrix LCD element at the thirteenth gray-level (i.e., the highest level) of the 14-level gray scale, a data signal $S_{D7}$ having a pulse during the selecting period $T_S$, whose width is 10/10 of the period $T_S$ and whose potential is $V_{S2}$, is supplied to the active element 13. In this case, a composite voltage having the waveform shown in FIG. 42A is applied between the input of the active element 13 and the opposing electrode 15. The composite voltage has a waveform identical to that of the selecting voltage 13 shown in FIG. 37. Then, as is shown in FIG. 42B, the voltage Vb-c applied between the pixel electrode 12 and the opposing electrode 15 fast increases throughout the selecting period $T_S$, along the curve defined by the the high voltage $V_{C1}+V_{S2}$.

Upon lapse of the selecting period $T_S$, or at the start of the non-selecting period $T_O$, the voltage across the pixel capacitor $C_{LC}$ decreases by a certain value to a voltage Vmax. This voltage Vmax is held between the pixel electrode 12 and the opposing electrode 15.

The voltages Vb-c shown in FIGS. 36D, 39B, 40B, and 41B, which are applied between the pixel electrode 12 and the opposing electrode 15 during the selecting period $T_S$, have a peak value at the end of the selecting period $T_S$. The peak value of the voltage Vb-c is determined by the composite voltage applied between the input of the active element 13 and the opposing electrode 15, the I-V characteristic of the element 13 (i.e., a diode ring), and the time during which the peak voltage ($V_{C1}+V_{S2}$) is applied.

In other words, the voltage Vb-c, which is applied between the electrodes 12 and 15 during the selecting period $T_S$, increases in accordance with the voltage Va-c applied between the input of the element 13 and the opposing electrode 15, along the rising curve representing the I-V characteristic of the active element 13, and stops increasing at the end of the selecting period $T_S$ when the application of the selecting voltages stopped.

The selecting voltage applied between the input of the active element 13 and the opposing electrode 15 can have three levels, the first level being the ON-selecting voltage $V_{C1}$, the second level being the high voltage $V_{C1}+V_{S1}$, and the third level being the highest voltage $V_{C1}+V_{S2}$. Hence, the voltage Vb-c, which is applied between the pixel electrode 12 and the opposing electrode 15, gradually increases along the curve defined by the ON-selecting voltage $V_{C1}$ when the composite voltage is at the first level, increases fast along the curve defined by the high voltage $V_{C1}+V_{S1}$ when the composite voltage is at the second level, and increases faster along the curve defined by the highest voltage $V_{C1}+V_{S2}$ when the composite voltage is at the third level.

The value by which the voltage Vb-c increases in accordance with the ON-selecting voltage $V_{C1}$ is proportional to the time of applying the voltage $V_{C1}$. Likewise, the value by which the voltage Vb-c increases in accordance with the high voltage $V_{C1}+V_{S1}$ is proportional to the time of applying the voltage $V_{C1}+V_{S1}$. Similarly, the value by which the voltage Vb-c increases in accordance with the highest voltage $V_{C1}+V_{S2}$ is proportional to the time of applying the voltage $V_{C1}+V_{S2}$. The peak value of the voltage Vb-c therefore changes in accordance with the ratio of the time of applying the ON-selecting voltage $V_{C1}$ to the time of applying the voltage $V_{C1}+V_{S1}$ or the voltage $V_{C1}+V_{S2}$ is proportional to the time of applying the voltage $V_{C1}+V_{S1}$.

Hence, the voltage Vb-c which the pixel capacitor $C_{LC}$ holds at the end of the selecting period $T_S$, or at the start of the non-selecting period $T_O$, is controlled by the data pulse superposed on the selecting voltage applied between the input of the active element 13 and the opposing electrode 15. (The voltage Vb-c is lower than the voltage applied during the period $T_S$ by a part of the decrease in the voltage Va-c corresponding to the pixel capacitance $V_{LC}$.)

If the selecting voltage is one superposed with no data pulse as is shown in FIG. 39A, the voltage Vb-c sustained in the pixel capacitor $C_{LC}$ will have the least value V0 as is shown in FIG. 39B. If the selecting voltage is one entirely superposed with a data pulse having the width equal to the selecting period $T_S$ as is shown in FIG. 42A, the voltage Vb-c will have the greatest value Vmax as is shown in FIG. 42B.

As is shown in FIG. 37, a data pulse is superposed on the the scan signal $S_{S7}$ during the last part of the selecting period $T_S$. Instead, the data pulse can be superposed on the scan signal $S_{S7}$ during the initial part of the period $T_S$, thereby generating a composite voltage having the waveform shown in FIG. 43A. Alternatively, the data pulse can be superposed on the scan signal $S_{S7}$ during the intermediate part of the period $T_S$, thereby generating a composite voltage having the waveform shown in FIG. 44A.

Figures 43A, 43B:
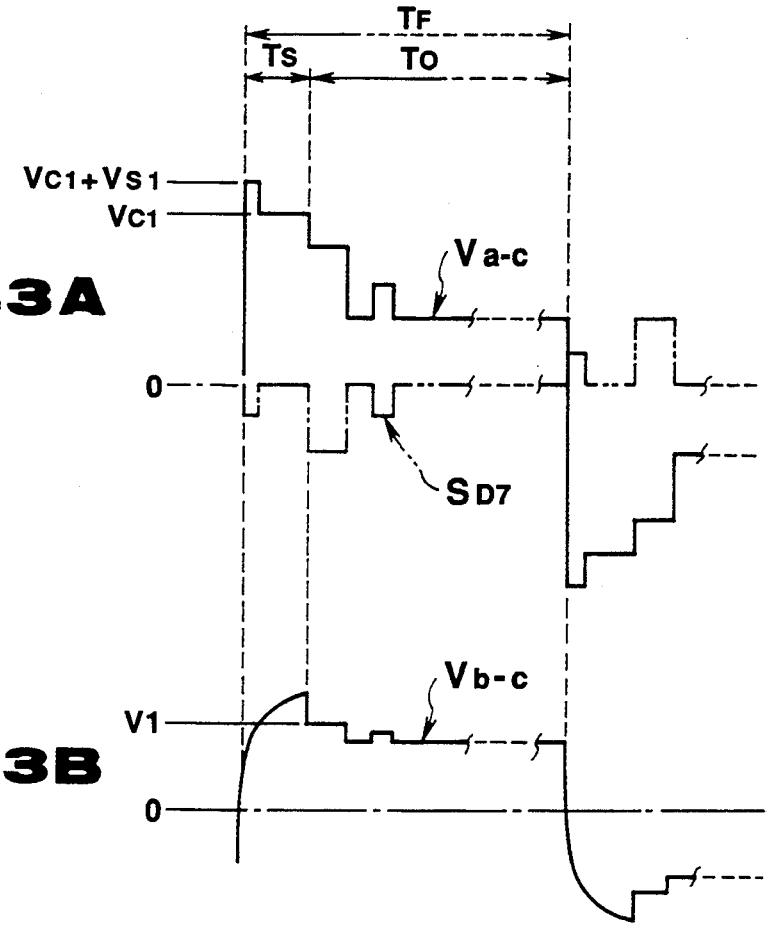
FIGS. 43A and 43B are diagrams showing the waveforms of two voltages applied between the input of the active element and the opposing electrode and between the pixel electrode and the opposing electrode, respectively, when the data signal is changed to control the gray-level of the pixel in the seventh method according to the invention.
Figures 44A, 44B:
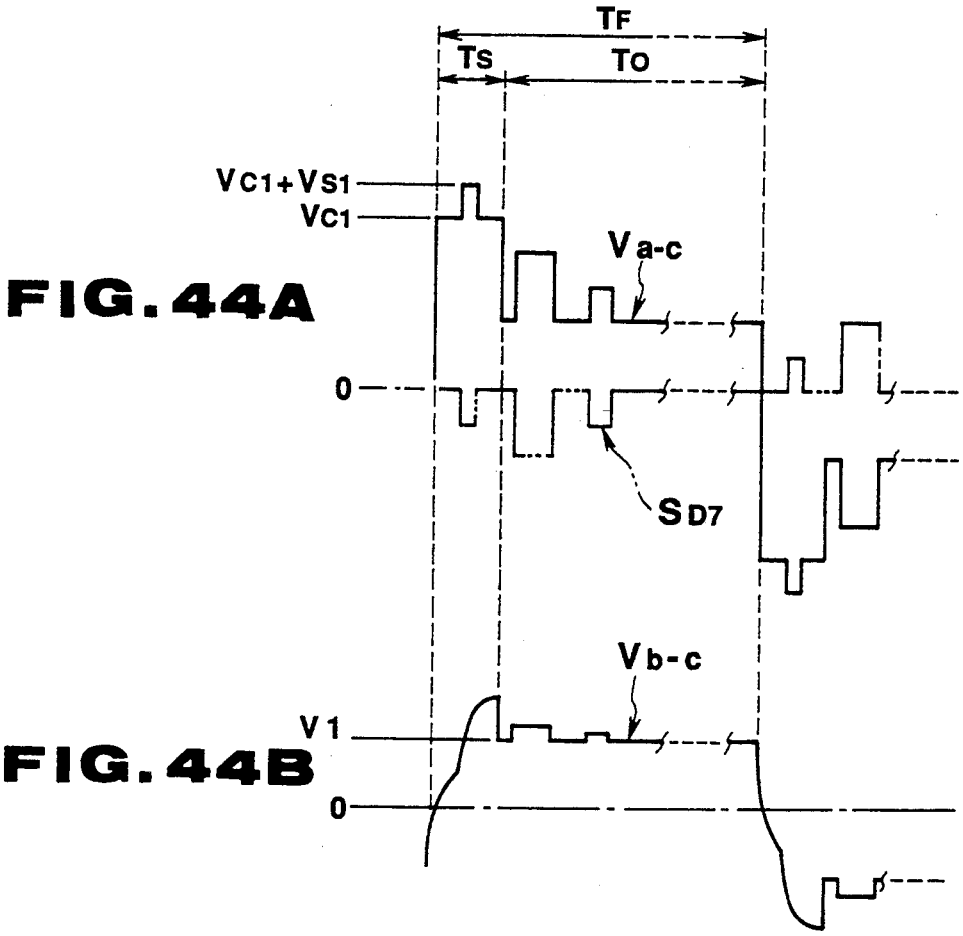
FIGS. 44A and 44B are diagrams showing the waveforms of two voltages applied between the input of the active element and the opposing electrode and between the pixel electrode and the opposing electrode, respectively, when the data signal is further changed to control the gray-level of the pixel in the seventh method according to the invention.

In each alternative case, too, as is shown in FIGS. 43B and 44B, the voltage Vb-c applied between the pixel electrode 12 and the opposing electrode 15 increases along the curve determined by the ON-selecting voltage $V_{C1}$ while the ON-selecting voltage $V_{C1}$ is being applied, and along the curve determined the high voltage $V_{C1}+V_{S1}$ while this high $V_{C1}+V_{S1}$ voltage is being applied. As a result, the voltage Vb-c held in the pixel capacitor $C_{LC}$ will have a value which corresponds to the data-pulse width and potential of the selecting voltage. The selecting voltages shown in FIGS. 43A and 44A have the same data-pulse width and the same potential as the selecting voltage having the waveform shown in FIG. 36C. Hence, when either of these selecting voltages is applied between the input of the active element 13 and the opposing electrode 15, a voltage Vb-c having the waveform shown in FIG. 36D will be applied between the pixel electrode 12 and the opposing electrode 15.

As has been described, in the seventh method of the present invention, not only the pulse-width of a data signal $S_{D7}$ is changed in accordance with the externally supplied image data, but also the potential of the signal $S_{D7}$ is changed in accordance with the image data from $V_{S1}$ to $V_{S2}$, or vice versa, in accordance with the image data. Therefore, it is possible to drive each active matrix LCD element, thereby to set the pixel of the LCD element at any desired gray-level.

Since the selecting voltage Va-c can have two different base values $V_{S1}$ and $V_{S2}$ in the seventh method, the voltage Vb-c applied between the pixel electrode 12 and the opposing electrode 15 can increase along two curves A and B, both illustrated in FIG. 38. Thus, it is possible to apply a voltage Vb-c having a value by applying a voltage Va-c having the first base value VS1 between the input of the active element 13 and the opposing electrode 15, and to apply a voltage Vb-c having a different value by applying a voltage Va-c having the second base value $V_{S2}$ between the input of the active element 13 and the opposing electrode 15, even if both selecting voltages Va-c have the same data-pulse width. Hence, twice as many voltages as the selecting voltages Va-c having different data-pulse widths can be held in each pixel capacitor $C_{LC}$, whereby the pixel can be set at twice as many gray-levels as the selecting voltages Va-c.

More specifically, as is illustrated in FIG. 37, the data-pulse width is varied in seven steps for the selecting voltage having the base value $V_{S1}$, and the data-pulse width is varied in seven steps also for the selecting voltage having the base value $V_{S2}$. Thus, fourteen different selecting voltages 1 to 7 and 7' to 13 can be applied between the input of the active element 13 and the opposing electrode 15. It suffices to use only the selecting voltage 7 or the selecting voltage 7'. This is because, as is evident from FIG. 38, the voltage Vb-c applied when the selecting voltage 7 is applied between the input of the element 13 and the opposing electrode 15 has the same value as the voltage Vb-c applied applied when the selecting voltage 7' is applied between the input of the element 13 and the opposing electrode 15. In the seventh method, another voltage Vb-c, which has no data pulses, can be applied between the pixel electrode 12 and the opposing electrode 15. Hence, the pixel of each active matrix LCD element can be set at 14 gray-levels.

Figure 45:
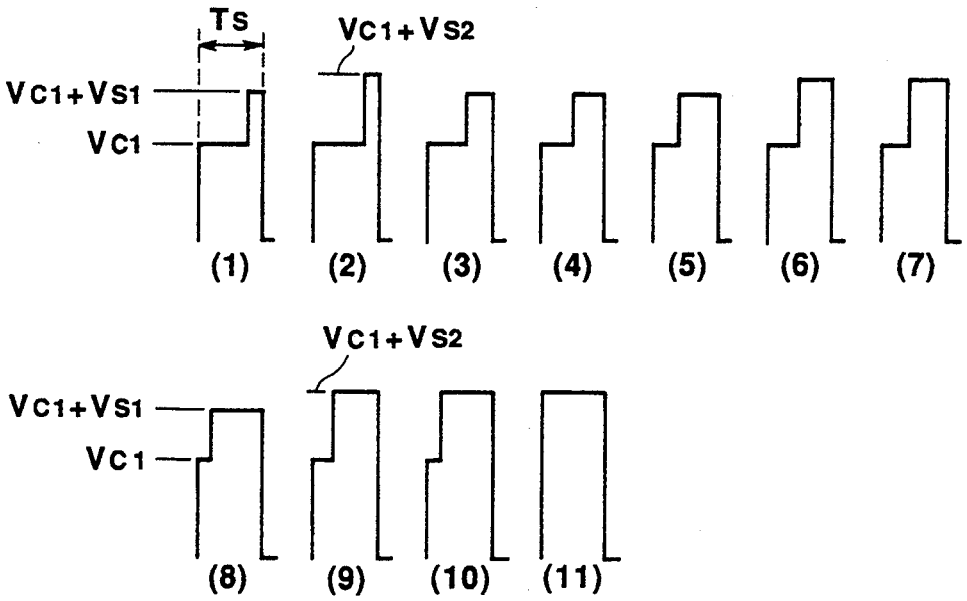
FIG. 45 is a diagram showing the waveforms of various selecting voltages, other than those shown in FIG. 37, used in the seventh method to set each pixel at various gray-levels.
Figure 46:
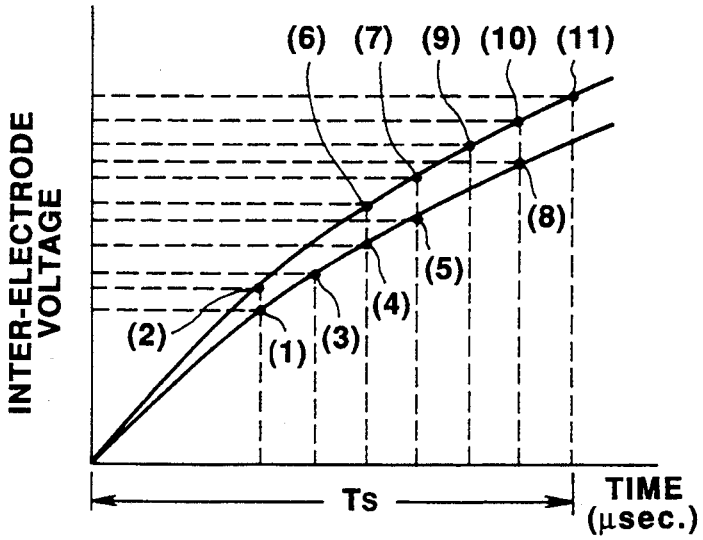
FIG. 46 is a graph illustrating how the inter-electrode voltage of each pixel changes when the selecting voltages having the waveforms shown in FIG. 45 are applied, one by one, between the input of the active element and the opposing electrode.

Instead of the selecting voltages 1 to 13 shown in FIGS. 37 and 38, the selecting voltages 1 to 11 shown in FIGS. 45 and 46 can be used in the seventh method of the present invention. In this case, too, another selecting voltage, which has no data pulses, can be applied between the pixel electrode 12 and the opposing electrode 15. Hence, the pixel of each active matrix LCD element can be set at 12 gray-levels.

Of the selecting voltages shown in FIG. 45, the ON-selecting voltage $V_{C1}$ and the voltage $V_{C1}+V_{S2}$ (i.e., the voltage obtained by superposing the second data-pulse voltage $V_{S2}$ on the ON-selecting voltage $V_{C1}$) are identical to the voltage $V_{C1}$ and the voltage $V_{C1}+V_{S2}$, both illustrated in FIG. 37. The second data-pulse voltage $V_{S1}$ is about $\frac{2}{3}$ of the second data-pulse voltage $V_{S2}$. It follows that the selecting voltage $V_{C1}+V_{S1}$ is slightly higher than the selecting voltage $V_{C1}+V_{S1}$ shown in FIG. 37.

Eighth Embodiment

The method according to an eighth embodiment of the invention (to be referred as "eighth method") will now be described, with reference to FIGS. 47A to 47D, FIGS. 48A and 48B, and FIGS. 49A to 49C. Some of the features of the fourth method are identical to those of the fourth method, and therefore will not be described.

The eighth method is designed to drive active matrix LCD elements of the liquid-crystal display shown in FIGS. 8 and 9, thereby to display a gray-scale image. The eighth method is characterized in that not only the number of pulses of a data signal, but also the potential thereof is changed in accordance with externally supplied image data.

Figures 47A, 47B, 47C, 47D:
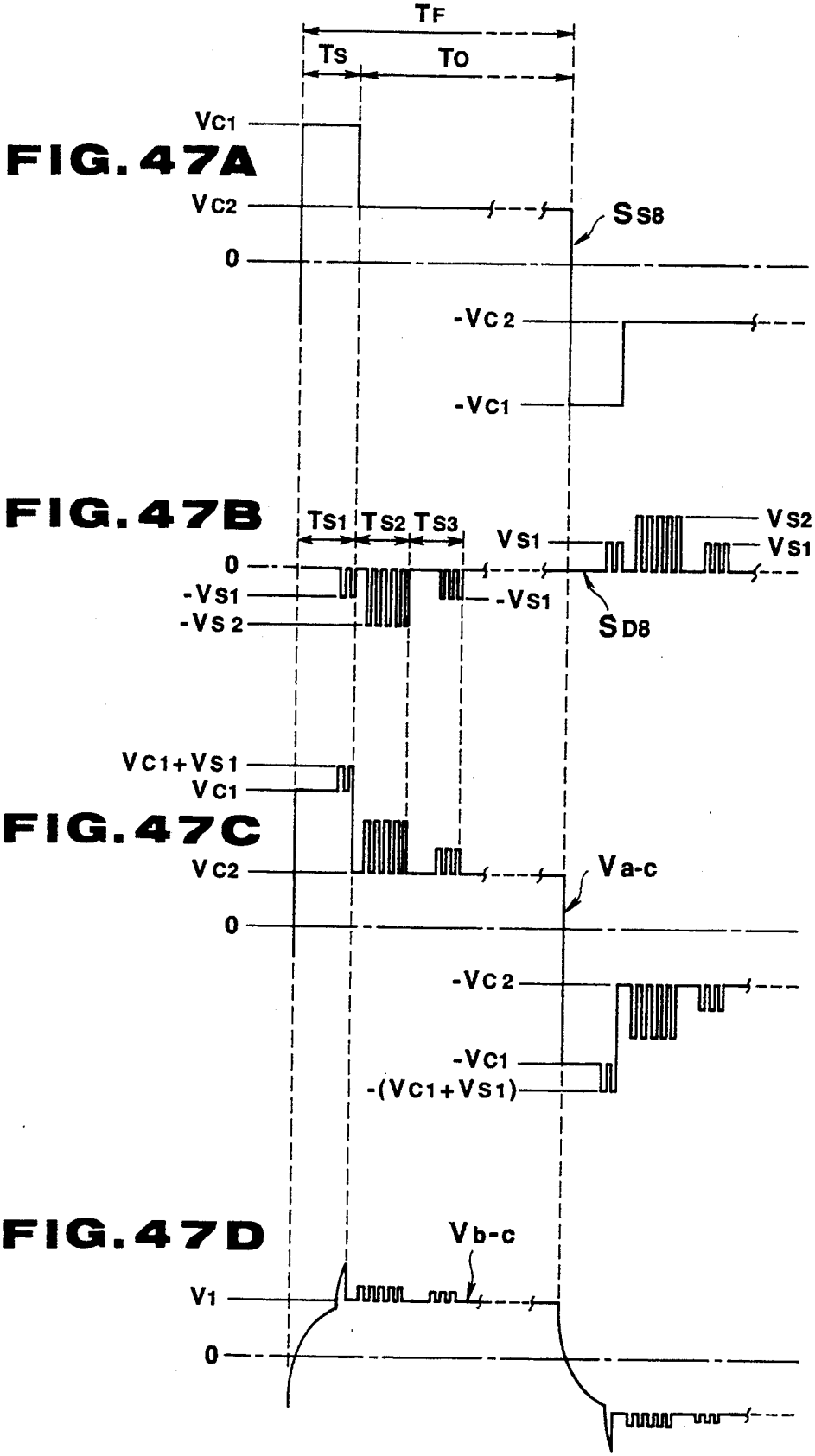
FIG. 47A is a diagram showing the waveform of the scan signal used in the eighth method according to the present invention.
FIG. 47B is a diagram showing the waveform of the data signal used in the eighth method of the invention.
FIG. 47C is a diagram illustrating the waveform of the voltage applied between the input of the active element and the opposing electrode when the scan signal and the data signal, shown in FIGS. 47A and 47B, are supplied to the opposing electrode and the signal line, respectively.
FIG. 47D is a diagram representing how the voltage applied between the pixel electrode and the opposing electrode changes when the voltage shown in FIG. 47C is applied between the input of the active element and the opposing electrode.

FIG. 47A is a diagram showing the waveform of a scan signal $S_{S8}$ supplied between the first opposing electrode 15 of the liquid-crystal display shown in FIGS. 8 and 9. FIG. 47B is a diagram illustrating a data signal $S_{D8}$ supplied to one of the signal lines 14 shown in FIG. 8. FIG. 47C is a diagram showing the waveform of a voltage Va-c applied between the opposing gate 15 and the input of the active element 13 connected to the signal line 14, or between points a and c in the equivalent circuit shown in FIG. 10. FIG. 47D is a diagram representing the waveform of a voltage Vb-c applied between the pixel electrode 12 connected to the active element 13 and the opposing electrode 15, or between points b and c in the equivalent circuit shown in FIG. 10.

As shown FIG. 47A, the scan signal $S_{S8}$ is identical to the scan signal $S_{S4}$ illustrated in FIG. 27A. The signal $S_{S8}$ remains at a selecting potential $V_{C1}$ during the selecting period $T_S$ and at a non-selecting potential $V_{C2}$ during a non-selecting period $T_O$. The scan signal $S_{S8}$ has its polarity altered at the end of every one-field period $T_F$.

As is evident from FIG. 47B, the data signal $S_{D8}$ has pulses which have the same width. The number of pulses the signal $S_{D8}$ has changes in accordance with the image data externally supplied. The polarity of these pulses alters at the end of every one-field period $T_F$. The pulses of the data signal $S_{D8}$ can have two different potentials $V_{S1}$ and $V_{S2}$. $V_{S1}=V_{S2}/2$. The signal $S_{D8}$ has the polarity which is opposite to that of the scan signal $S_{S8}$ supplied to the opposing electrode 15.

As is shown in FIG. 47B, the data signal $S_{D8}$ has 2 pulses during the selecting period $T_{S1}$ for the first opposing electrode 15, 5 pulses during the selecting period $T_{S2}$ for the second opposing electrode 15, and 3 pulses during the selecting period $T_{S3}$ for the third opposing electrode. The number of pulses which the signal $S_{D8}$ has during each of the selecting periods $T_{S1}$, $T_{S2}$, and $T_{S3}$ changes in accordance with the externally supplied image data, from 0 (no pulses) to n. Here, "n" is is greatest number of pulses that can be applied during the selecting period $T_S$, depending on the width of each pulse.

When the scan signal $S_{S8}$ and the data signal $S_{D8}$, which have the waveform shown in FIGS. 47A and 47B, are supplied to the opposing electrode 15 and the signal line 14, respectively, a voltage Va-c having the waveform shown in FIG. 47C is applied between the input of the active element 13 connected to the first signal line 14 and the opposing electrode 15. As can be understood from FIG. 47C, the voltage Va-c is a combination of the scan signal $S_{S8}$ and the data signal $S_{D8}$, and corresponds to the potential difference between these signals $S_{S8}$ and $S_{D8}$.

During the selecting period $T_S$, the voltage Va-c applied between the input of the active element 13 and the opposing electrode 15 first has value $V_{C1}$ and then has value $V_{C1}+V_{S1}$. During the non-selecting period $T_O$, the voltage Va-c first has value $V_{C2}$, then has value $V_{C2}+V_{S2}$, and finally value $V_{C2}+V_{S1}$, as in the seventh method according to the present invention.

To set the pixel of each LCD element at the second gray-level of the 2n-level gray scale, a data signal $S_{D8}$ having 2 pluses and a potential $V_{S1}$ is supplied to the input of the active element 13 during the selecting period $T_S$. Further, for this purpose, a composite voltage Va-c having the waveform of FIG. 47C is applied between the input of the element 13 and the opposing electrode 15. As a result, a voltage Vb-c having the waveform of FIG. 47D is applied between the pixel electrode 12 and the opposing electrode 15.

Figures 48A, 48B:
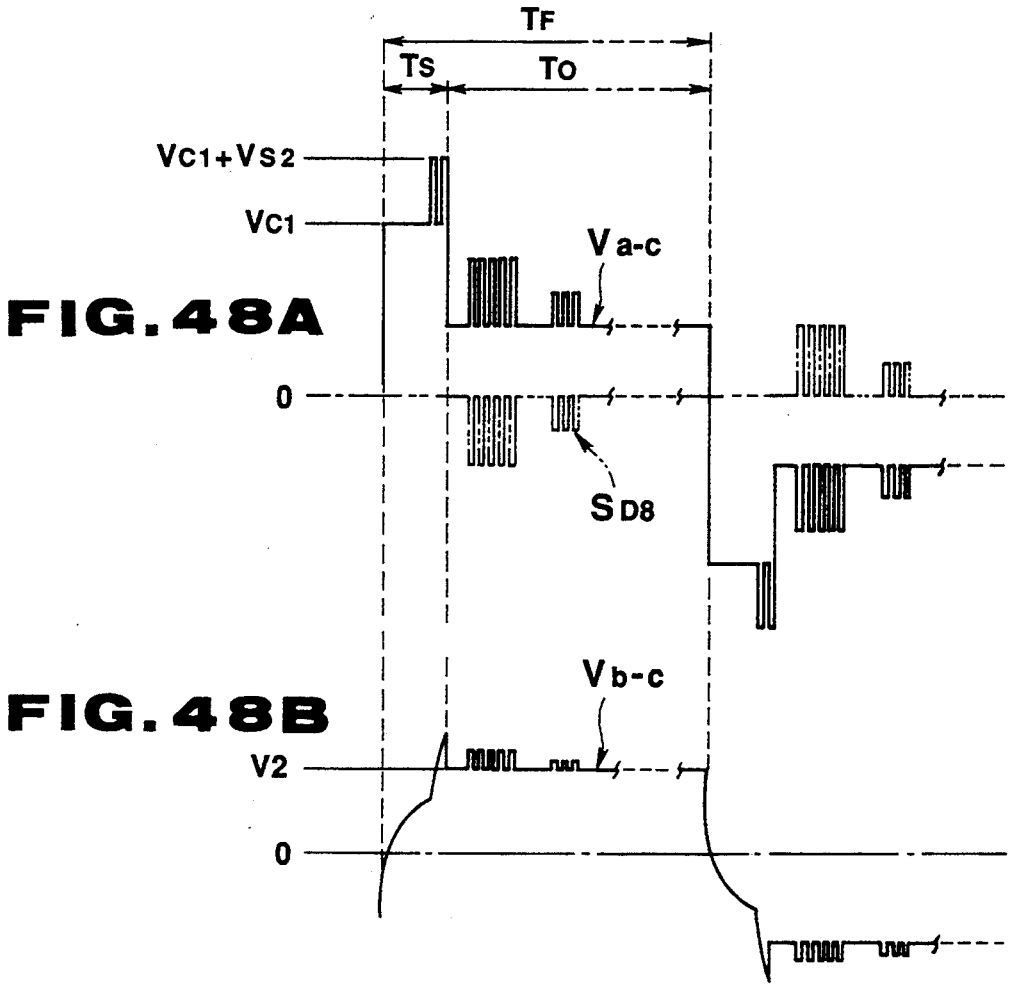
FIGS. 48A and 48B are diagrams showing the waveforms of two voltages applied between the input of the active element and the opposing electrode and between the pixel electrode and the opposing electrode, respectively, thereby to set the pixel at an intermediate gray-level in the eighth method according to the invention.

To set the pixel at any other gray-level of the 2n-level gray scale, except of the highest gray-level, a data signal $S_{D8}$ having the waveform shown in FIG. 48A is supplied to the input of the active element 13 during the selecting period $T_S$. This data signal $S_{D8}$ has 2 pluses during the selecting period $T_S$. Further, for this purpose, a composite voltage Va-c having the waveform of FIG. 48A is applied between the input of the element 13 and the opposing electrode 15, and a voltage Vb-c having the waveform of FIG. 48B is applied between the pixel electrode 12 and the opposing electrode 15.

Figures 49A, 49B:
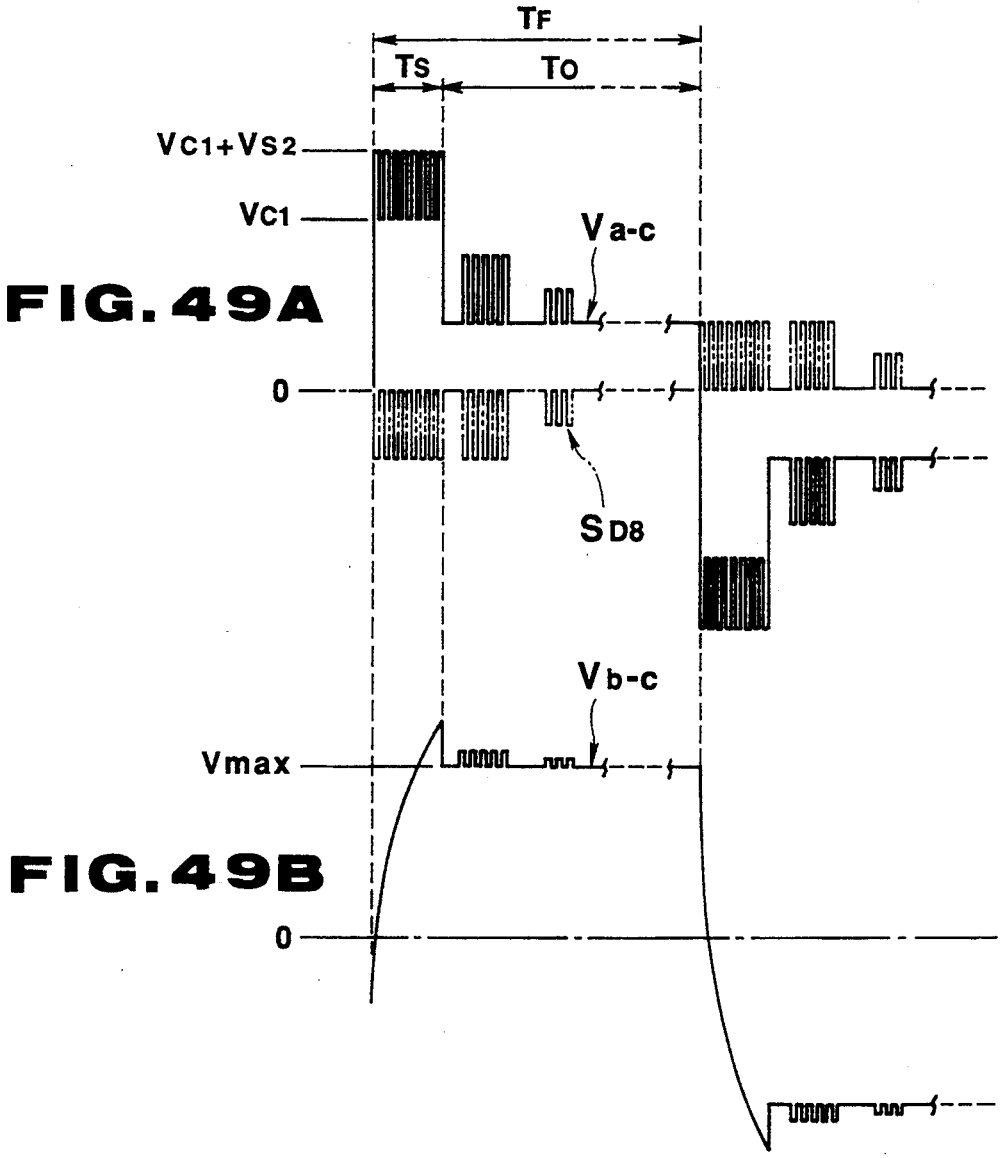
FIGS. 49A and 49B are diagrams showing the waveforms of two voltages applied between the input of the active element and the opposing electrode and between the pixel electrode and the opposing electrode, respectively, thereby to set the pixel at the highest gray-level in the eighth method according to the invention.

To set the pixel at 2n-th gray-level (i.e., the highest level) of the 2n-level gray scale, a data signal $S_{D8}$ having the waveform shown in FIG. 49A is supplied to the input of the active element 13 during the selecting period $T_S$. During the selecting period $T_S$, this data signal $S_{D8}$ has the greatest number of pulses which it can have during the selecting period $T_S$ during the selecting period $T_S$. Further, for this purpose, a composite voltage Va-c having the waveform of FIG. 49A is applied between the input of the element 13 and the opposing electrode 15, and a voltage Vb-c having the waveform of FIG. 49B is applied between the pixel electrode 12 and the opposing electrode 15.

To set the pixel at the 0-th gray-level of an 2n-level gray scale, a data signal $S_{D8}$ having no pluses is supplied to the input of the active element 13 during the selecting period $T_S$. Further, for this purpose, a composite voltage Va-c having the same waveform as is shown in FIG. 39A during the selecting period $T_S$ is applied between the input of the element 13 and the opposing electrode 15, and a voltage Vb-c having the same waveform as is shown in FIG. 39B during the selecting period $T_S$ is applied between the pixel electrode 12 and the opposing electrode 15. (The voltage Vb-c has a different waveform during the non-selecting period $T_O$.)

In the eighth method, too, the voltage Vb-c, which is applied between the pixel electrode 12 and the opposing electrode 15, gradually increases along the curve defined by the ON-selecting voltage $V_{C1}$ when the selecting voltage Va-c has the value of $V_{C1}$, and increases fast along the curve defined by the high voltage $V_{C1}+V_{S1}$ when the voltage Va-c has the value of $V_{C1}+V_{S1}$, and increases faster along the curve defined by the higher voltage $V_{C1}+V_{S2}$ when the voltage Va-c has the value of $V_{C1}+V_{S2}$. Since the number of data pulses of the the selecting voltage changes in accordance with the image data, the voltage Vb-c applied between the pixel electrode 12 and the the opposing electrode 15 increases in steps the number of which is equal to that of the data pulses.

Hence, the voltage Vb-c held in the pixel capacitor $C_{LC}$ upon lapse of the selecting period $T_S$, or at the start of the non-selecting period $T_O$ changes in accordance with the period during which the selecting voltage remains at the high value, which is determined by the value of the selecting voltage and the number of the data pulses contained in the selecting voltage. (The voltage Vb-c held in the capacitor $C_{LC}$ is lower than the voltage built up in the capacitor $C_{LC}$ during the period $T_S$, by that part of decrease in the voltage Va-c which corresponds to the pixel capacitance $C_{LC}$).

The voltages Va-c shown in FIGS. 47C and 48A contain data pulses superposed on the voltage $V_{C1}$ during the last part of the selecting period $T_S$. Instead, the data pulses can be superposed on the voltage $V_{C1}$, either during the initial part of the period $T_S$ or during the intermediate part thereof.

Thus, a selecting voltage having pulse the number of which corresponds to the data signal is applied between the input of the active element 13 and the opposing electrode 15 during the selecting period $T_S$. Also, a voltage determined by the potential of the selecting voltage and the number of the data pulses contained in the selecting voltage is applied between the pixel electrode 12 connected to the active element 13 and the opposing electrode 15. It is, therefore, possible to control the transmittance of the pixel. As a result, the liquid-crystal display can display a gray-scale image.

The number of gray-levels of the gray scale is determined by the number of different values which the voltage Vb-c sustained in the pixel capacitance $C_{LC}$ during the period $T_S$ can have. Since the active element 13 is a diode ring which has, as is shown in FIG. 25, a steep I-V characteristic curve and a good response, the voltage applied between the input of the active element 13 and the opposing electrode 15 can be changed greatly by changing the number of the pulses contained in the selecting voltage applied between the pixel electrode 12 and the opposing electrode 15.

The eighth method of the invention resides in driving active matrix LCD elements, each having a diode ring used as semiconductor active element 13, by changing the number of data pulses contained in the selecting voltage in accordance with the externally supplied image data. Thus, It is unnecessary to use multi-level drive signals to drive the LCD elements as is required in the conventional method in which voltage modulation is performed. The eighth method can, therefore, be performed by means of a relatively simple drive circuit to cause the LCD elements to display pixels at many different gray-levels.

In the seventh and eighth methods, described above, the selecting voltage can have two base values $V_{S1}$ and $V_{S2}$. According to the present invention, the selecting voltage can have three or more base values. The more base values the selecting voltage has, the more gray-levels each pixel can be set at, provided the data-pulse width or the number of data pulses is changed for each base value of the selecting voltage.

Ninth Embodiment

The method according to a ninth embodiment of the invention (to be referred as "ninth method") will be described, with reference to FIGS. 50A to 50D, FIG. 51, 52A and 52B, FIGS. 53A and 53B, FIGS. 54A and 54B, FIG. 56, and FIG. 57. Some of the features of the ninth method are identical to those of the seventh method, and therefore will not be described.

The ninth method is designed to drive active matrix LCD elements of the liquid-crystal display shown in FIGS. 8 and 9, thereby to display a gray-scale image. The ninth method is characterized in that the gray-level of each pixel is controlled, eliminating changes in the transmittance thereof which result from the influence of the condition in which the other pixels are driven.

Figures 50A, 50B, 50C, 50D:
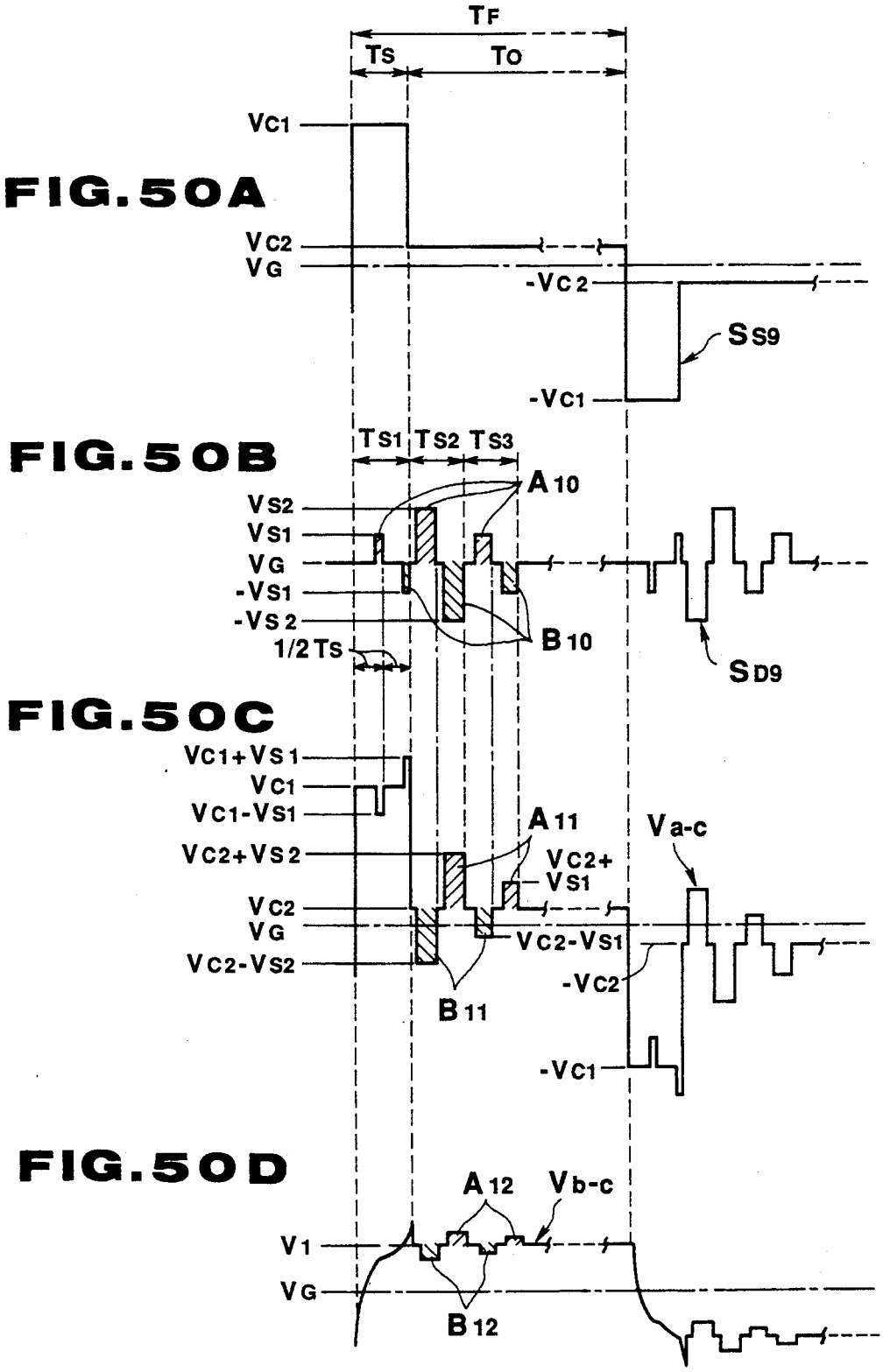
FIG. 50A is a diagram showing the waveform of the scan signal used in the ninth method according to the present invention.
FIG. 50B is a diagram showing the waveform of the data signal used in the ninth method of the invention.
FIG. 50C is a diagram illustrating the waveform of the voltage applied between the input of the active element and the opposing electrode when the scan signal and the data signal, shown in FIGS. 50A and 50B, are supplied to the opposing electrode and the signal line, respectively.
FIG. 50D is a diagram representing how the voltage applied between the pixel electrode and the opposing electrode changes when the voltage shown in FIG. 50C is applied between the input of the active element and the opposing electrode.

FIG. 50A is a diagram showing the waveform of a scan signal $S_{S9}$ supplied between the first signal line 14 of the liquid-crystal display shown in FIGS. 8 and 9. FIG. 50B is a diagram illustrating a data signal $S_{D9}$ supplied to one of the opposing electrodes 15 shown in FIG. 8. FIG. 50C is a diagram showing the waveform of a voltage Va-c applied between the opposing electrode 15 and the input of the active element 13 connected to the signal line 14. FIG. 50D is a diagram representing the waveform of a voltage Vb-c applied between the pixel electrode 12 connected to the active element 13 and the opposing electrode 15.

As shown FIG. 50A, the scan signal $S_{S9}$ is identical to the scan signal $S_{S7}$ used in the seventh method. The signal $S_{S9}$ remains at a selecting potential $V_{C1}$ during the selecting period $T_S$ and at a non-selecting potential $V_{C2}$ during a non-selecting period $T_O$. The scan signal $S_{S9}$ has its polarity altered at the end of every one-field period $T_F$.

As is evident from FIG. 50B, the data signal $S_{D9}$ is a rectangle-wave voltage signal whose potential changes in accordance with the image data externally supplied to the liquid-crystal display. The data signal $S_{D9}$ has its potential alternately changed between two values positive and negative with respect to a predetermined reference potential $V_G$, at intervals obtained by dividing the selecting period $T_S$ by an even number. More precisely, during each selecting period $T_{S1}$, $T_{S2}$, or $T_{S3}$, the data signal $SD_9$ has two pulses which are positive and negative with respect to the reference potential $V_G$. These two pulses have the same width, and their potentials are identical in absolute value. For example, the two pulses the data signal $S_{D9}$ has during the first selecting period $T_{S1}$ have the same width and potentials $V_S$ and $-V_S$, respectively.

The data signal $S_{D9}$ has such a waveform during each selecting period $T_S$ that the two components A10 and B10 positive and negative with respect to the reference potential $V_G$, respectively, have substantially the same area.

In the ninth method, each pulse of the data signal $S_{D9}$ can have two absolute potentials, i.e., $V_{S1}$ and $V_{S2}$ ($V_{S2}=2\cdot V_{S1}$). The value $V_{S1}$ or $V_{S2}$ is selected for each pulse in accordance with the image data.

As can be understood from FIG. 50B, the two pulses generated during the selecting period $T_{S1}$ for the pixels of the first row have a potential $V_{S1}$ and a width which is 1/10 of the selecting period $T_S$; the two pulses generated during the selecting period $T_{S2}$ for the pixels of the second row have a potential $V_{S2}$ and a width which is 4/10 of the period $T_S$; and the two pulses generated during the selecting period $T_{S3}$ for the pixels of the third row have a potential $V_{S1}$ and a width which is 3/10 of the period $T_S$. The width of the pulses generated in the selecting period $T_S$ for the pixels of any row changes over the range of 0/10 of the period $T_S$ (no pulses) to 5/10 of period $T_S$ (i.e., $\frac{1}{2}$ of the period $T_S$), in accordance with the image data and the pulse potential, $V_{S1}$ or $V_{S2}$, selected based on the image data.

when the scan signal $S_{S9}$ and the data signal $S_{D9}$ are supplied to the signal line 14 and the opposing electrode 15, respectively, a composite voltage Va-c (a combination of the signals $S_{S9}$ and $S_{D9}$) which has the waveform shown in FIG. 50C is applied between the opposing electrode 15 and the input terminal of the active element 13, that is, between points a and c in the equivalent circuit of FIG. 10.

The composite voltage Va-c has a positive or negative polarity during the selecting period $T_S$, and has a negative polarity and a positive polarity alternately during the non-selecting period $T_O$, each time during every half of the period $T_S$.

Of the composite voltage Va-c, the part applied during the selecting period $T_S$ is at the potential equal to the selecting potential $V_{C1}$ of the scan signal $S_{S9}$ when the data signal $S_{D9}$ is at a predetermined reference potential $V_G$. When the data signal $S_{D9}$ increases to the potential of the data pulse, the composite voltage Va-c changes to a potential $V_{C1}+V_{S1}$, a potential $V_{C1}-V_{S1}$, a potential $V_{C1}+V_{S2}$, or a potential $V_{C1}-V_{S2}$.

The voltage $V_{C1}$ (hereafter called "ON-selecting voltage), which is applied while the data signal $S_{S9}$ is at the reference potential, is higher than the threshold voltage of the thin-film diodes 23 and 24 forming the active element 13 (i.e., the diode ring). The selecting voltages $V_{C1}+V_{S1}$ and $V_{C1}+V_{S2}$, which are applied while the data signal $S_{D9}$ is at the data-pulse potential $V_{S1}$ and $V_{S2}$, respectively, are higher than the ON-selecting voltage $V_{C1}$. By contrast, the selecting voltages $V_{C1}-V_{S1}$ and $V_{C1}-V_{S2}$, which are applied while the data signal $S_{D9}$ is at the data-pulse potentials $-V_{S1}$ and $-V_{S2}$, respectively, are lower than the ON-selecting voltage $V_{C1}$.

The voltage (hereinafter referred to as "non-selecting voltage"), which is applied between the input of the active element 13 and the opposing electrode 15 during the non-selecting period $T_O$, is a combination of the data signal $S_{S9}$ and data pulses superposed on the signal $S_{S9}$ in accordance with the image data. The non-selecting voltage remains at the non-selecting potential $V_{C2}$ of the scan signal $S_{S9}$ as long as the data signal $S_{D9}$ is at the reference potential $V_G$. When the potential of the data signal $S_{D9}$ increases to that of the data pulse, however, the non-selecting voltage change to $V_{C2}+V_{S1}$, $V_{C2}-V_{S1}$, $V_{C2}+V_{S2}$, or $V_{C2}-V_{S2}$.

The voltages $V_{C2}+V_{S1}$, $V_{C2}-V_{S1}$, $V_{C2}+V_{S2}$, or $V_{C2}-V_{S2}$ are lower than the ON-selecting voltage $V_{C1}$ which is applied during the selecting period $T_S$. The voltage $V_{C2}+V_{S1}$ (i.e., a combination of the non-selecting potential $V_{C2}$ of the scan signal $S_{S9}$ and the data-pulse potential $V_{S1}$ which is positive with respect to the reference potential $V_G$) and the voltage $V_{C2}+V_{S2}$ (i.e., a combination of the non-selecting potential $V_{C2}$ of the scan signal $S_{S9}$ and the data-pulse potential $V_{S2}$ which is positive with respect to the reference potential $V_G$) are lower than the voltage $V_{C1}-V_{S1}$ (i.e., a combination of the selecting potential $V_{C1}$ of the scan signal $S_{S9}$ and the data-pulse potential $-V_{S1}$ which is negative with respect to the reference potential $V_G$) and the voltage $V_{C1}-V_{S2}$ (i.e., a combination of the selecting potential $V_{C1}$ of the scan signal $S_{S9}$ and the data-pulse potential $-V_{S2}$ which is negative with respect to the reference potential $V_G$).

The non-selecting voltage is a voltage on which are superposed the positive and negative data pulses for driving the other pixels of the same column. Nonetheless, it has components All positive with respect to the non-selecting potential $V_{C2}$ of the scan signal $S_{S9}$, and components B11 negative with respect to the non-selecting potential $V_{C2}$, the total area of which is substantially equal to that of the components A11. This is because the data signal $S_{D9}$ has, during each selecting period $T_S$, a positive component A10 and a negative component B10 which have substantially the same area.

In the ninth method, the non-selecting voltage applied between the input of the active element 13 and the opposing electrode 15 during the non-selecting period $T_O$ has such a waveform that the components $A_{11}$ positive with respect to the sustained reference voltage $V_{C2}$ have a total area substantially equal to that of the components $B_{11}$ negative with respect to the reference voltage $V_G$. Hence, the voltage Va-c changes, due to the image data for driving the other pixels, to substantially the same extent in both regions positive and negative, respectively, with respect to the non-selecting potential $V_{C2}$ of the scan signal $S_{S9}$. As a result, the voltage held in the pixel, which is the effective voltage applied during the non-selecting period $T_O$, remains unchanged.

In the ninth method, one of various selecting voltages 1 to 13 having the waveforms shown in FIG. 51 is applied between the input of the active element 13 and the opposing electrode 15 during the selecting period $T_S$, in order to drive each active matrix LCD element to set the pixel of the LCD element at a desired gray-level.

As is evident from FIG. 51, the selecting voltages 1 to 7 have different pulse widths W, and each has two different values $V_{C1}+V_{S1}$ and $V_{C1}-V_{S1}$, which are a combination of the selecting potential $V_{C1}$ and the data-pulse potential $V_{S1}$ of the data signal $D_{S9}$ and a combination of the selecting potential $V_{C1}$ and the data-pulse potential $-V_{S1}$ of the data signal $D_{S9}$. Similarly, the selecting voltages 7' to 13 have different pulse widths W, and each has two different values $V_{C1}+V_{S2}$ and $V_{C1}-V_{S2}$, which are a combination of the selecting potential $V_{C1}$ and the data-pulse potential $V_{S2}$ of the data signal $D_{S9}$ and a combination of the selecting potential $V_{C1}$ and the data-pulse potential $-V_{S2}$ of the data signal $D_{S9}$. The pulse widths of the voltages 7' to 13 are identical to those of the voltages 1 to 7, respectively. The selecting voltages 7 and 13 have a pulse width greater than that of any other selecting voltage; their pulse width is $\frac{1}{2}$ of the selecting period $T_S$.

It will now be described how the active matrix LCD elements are driven in the ninth method of the invention, in order to display an image in a multi-gray scale.

To drive the active matrix LCD element at 0-th gray-level of a 14-level gray scale, a data signal $S_{D9}$ having no data pulses during the selecting period $T_S$ is supplied to the active element 13. In this case, a composite voltage having the waveform shown in FIG. 52A is applied between the input of the active element 13 and the opposing electrode 15. The, as is shown in FIG. 52B, the voltage Vb-c applied between the pixel electrode 12 and the opposing electrode 15 gradually rises throughout the selecting period $T_S$ in accordance with the ON-selecting voltage $V_{C1}$.

Upon lapse of the selecting period $T_S$, or at the start of the non-selecting period $T_O$, the active element 13 is turned off. The voltage across the pixel capacitor $C_{LC}$ decreases from the voltage charged during the period $T_S$, to a voltage V0, by that part of the decrease in the voltage Va-c which is divided by the element capacitance $C_D$ and the pixel capacitance $C_{LC}$, and corresponds to the pixel capacitance $C_{LC}$. This voltage V0 is held between the pixel electrode 12 and the opposing electrode 15.

To drive the active matrix LCD element at the first gray-level of the 14-level gray scale, a data signal $S_{D9}$ having the waveform of FIG. 50B is supplied to the active element 13. This data signal $S_{D9}$ has a pulse during the selecting period $T_S$, whose width is 1/10 of the period $T_S$, and whose potentials are $V_{S1}$ and $-V_{S1}$. In this case, a selecting voltage having the waveform shown in FIG. 50C is applied between the input of the active element 13 and the opposing electrode 15.

This selecting voltage has a waveform identical to that of the selecting voltage 1 shown in FIG. 51. As is shown in FIG. 50B, the data signal $S_{D9}$ supplied to the opposing electrode 15 has, at the end of the first half of the selecting period $T_S$, a pulse which is at the potential $V_{S1}$ and which has the same polarity as the scan signal $S_{S9}$, and has, at the end of the selecting period $T_S$, a pulse which is at the potential $-V_{S1}$ and which has the polarity opposite to that of the scan signal $S_{S9}$. Hence, the selecting voltage applied between the input of the active element 13 and the opposing electrode 15 remains at the ON-selecting voltage $V_{C1}$ during the entire first half of the selecting period $T_S$, except the last part thereof. During the last part of the first half of the selecting period, the selecting voltage is at a pulse-superposed voltage $V_{C1}-V_{S1}$ which is lower than the ON-selecting voltage $V_{C1}$. During the entire latter half of the period $T_S$, except the last part thereof, the selecting voltage remains at the ON-selecting voltage $V_{C1}$. During the last part of the latter half of the period $T_S$, the selecting voltage is at the voltage pulse-superposed voltage $V_{C1}+V_{S1}$ which is higher than the ON-selecting voltage $V_{C1}$.

When the voltage Va-c having the waveform shown in FIG. 50C is applied between the input of the active element 13 and the opposing electrode 15, the voltage Vb-c applied between the pixel electrode 12 and the opposing electrode 15 changes as is shown in FIG. 50D. More specifically, the voltage Vb-c increases along the curve defined by the ON-selecting voltage $V_{C1}$ during the entire first half of the selecting period $T_S$, except the last part thereof. During the last part of the first half of the period $T_S$, the voltage Vb-c slowly increases along the curve defined by the low pulse-superposed voltage $V_{C1}-V_{S1}$. Then, during the entire latter half of the period $T_S$, except the last part thereof, the voltage Vb-c gradually increases along the curve defined by the ON-selecting voltage $V_{C1}$. During the last part of the latter half of the period $T_S$, the voltage Vb-c fast increases to a desired value, along the curve defined by the high pulse-superposed voltage $V_{C1}+V_{S1}$.

Upon lapse of the selecting period $T_S$, or at the start of the non-selecting period $T_O$, the voltage across the pixel capacitor $C_{LC}$ decreases by a certain value to a voltage V1. This voltage V1 is maintained between the pixel electrode 12 and the opposing electrode 15.

Figures 53A, 53B:
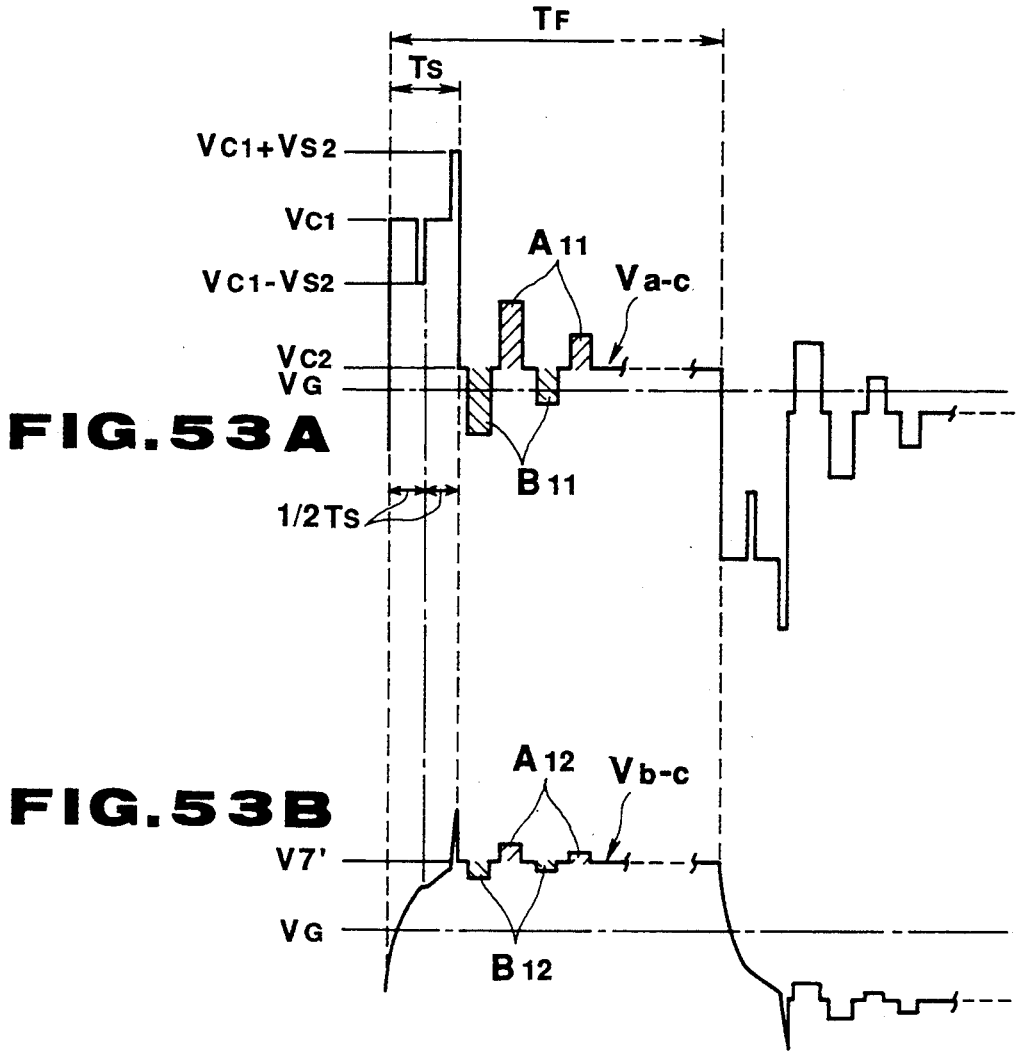
FIGS. 53A and 53B are diagrams showing the waveforms of two voltages applied between the input of the active element and the opposing electrode and between the pixel electrode and the opposing electrode, respectively, thereby to set the pixel at the seventh gray-level in the eighth method according to the invention.

To drive the active matrix LCD element at the seventh gray-level of the 14-level gray scale, a data signal $S_{D9}$ having a pulse whose width is 2/10 of the period $T_S$ and whose potentials are $V_{S2}$ and $-V_{S2}$. In this case, a selecting voltage having the waveform shown in FIG. 53A is applied between the input of the active element 13 and the opposing electrode 15.

The selecting voltage Va-c has a data-pulse width which is equal to that of the selecting voltage shown in FIG. 50C. Hence, a voltage Vb-c having the waveform shown in FIG. 53B is applied between the pixel electrode 12 and the opposing electrode 15. More specifically, the voltage Vb-c fast increases during the entire first half of the selecting period $T_S$, except the last par thereof, along the curve defined by the voltage $V_{C1}+V_{S2}$, faster than the voltage Vb-c shown in FIG. 50D since the voltage $V_{C1}+V_{S2}$ is higher than the voltage $V_{C1}+V_{S1}$ of the voltage Vb-c of FIG. 50D.

Upon lapse of the selecting period $T_S$, or at the start of the non-selecting period $T_O$, the voltage across the pixel capacitor $C_{LC}$ decreases by a certain value to a voltage V7'. This voltage V7' is sustained between the pixel electrode 12 and the opposing electrode 15.

Figures 54A, 54B:
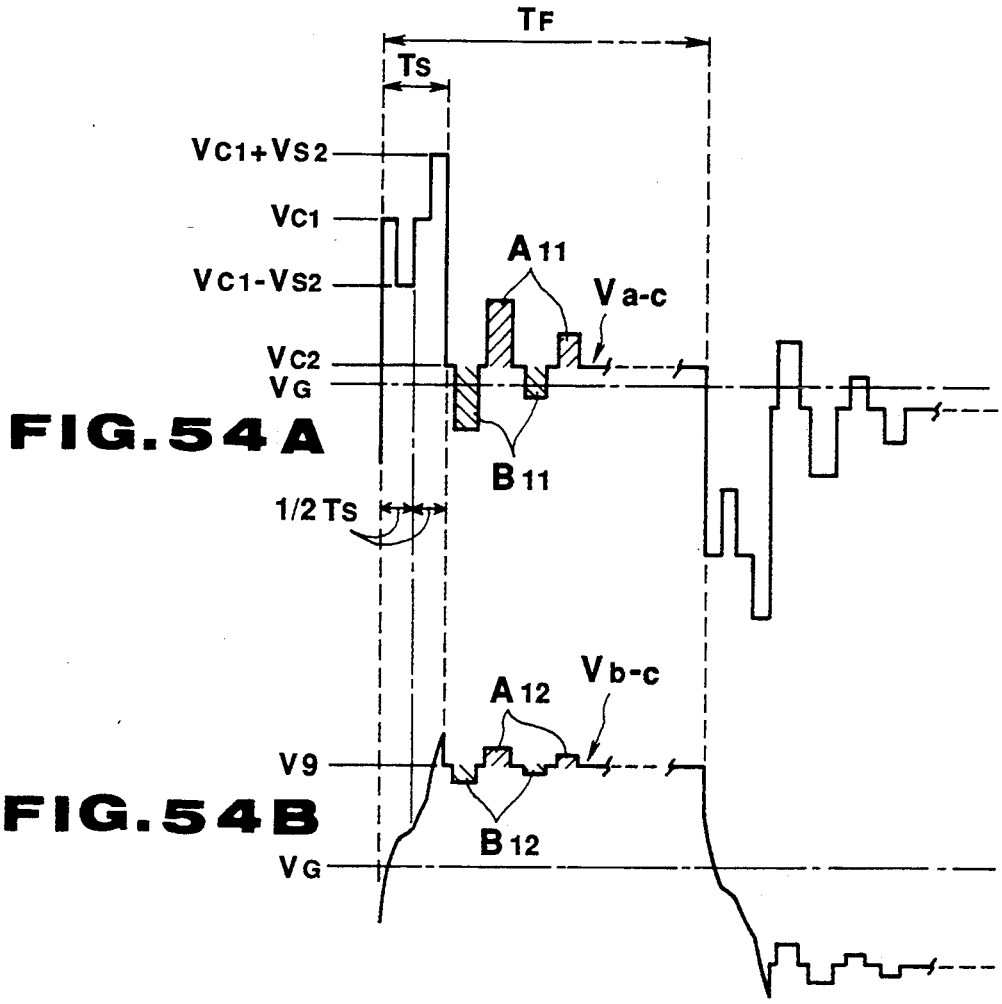
FIGS. 54A and 54B are diagrams showing the waveforms of two voltages applied between the input of the active element and the opposing electrode and between the pixel electrode and the opposing electrode, respectively, thereby to set the pixel at the ninth gray-level in the eighth method according to the invention.

To drive the active matrix LCD element at the ninth gray-level of the 14-level gray scale, a data signal $S_{D9}$ having a pulse during the selecting period $T_S$, whose width is 2.5/10 of the period $T_S$ and whose potentials are $V_{S2}$ and $-V_{S2}$. In this case, a selecting voltage Va-c having the waveform shown in FIG. 54A is applied between the input of the active element 13 and the opposing electrode 15. It should be noted that the waveform of this selecting voltage Va-c is identical to the waveform of the voltage 9 shown in FIG. 51.

When the selecting voltage Va-c having the waveform shown in FIG. 54A is applied between the input of the active element 13 and the opposing electrode 15, the voltage Vb-c applied between the pixel electrode 12 and the opposing electrode 15 changes as is shown in FIG. 54B. More specifically, during the first half of the selecting period $T_S$, this voltage Vb-c increases first along the curve defined by the ON-selecting voltage $V_{C1}$ and then along the curve defined by the pulse-superposed voltage $V_{C1}-V_{S2}$. During the latter half of the period $T_S$, the voltage Vb-c increases first along the curve defined by the ON-selecting voltage $V_{C1}$ and then along the curve defined by the high pulse-superposed voltage $V_{C1}+V_{S2}$. The selecting voltage Va-c has a peak value (i.e., $V_{C1}+V_{S2}$) which is equal to that of the selecting voltage shown in FIG. 53A. The curve along which the voltage Vb-c increases while the selecting voltage Va-c remains at $V_{C1}+V_{S2}$ is identical to the curve illustrated in FIG. 53B. Nonetheless, the pulse at $V_{C1}+V_{S2}$ has a width greater than that of the pulse at $V_{C1}+V_{S2}$ (FIG. 53A), and a pulse has been superposed on the ON-selecting voltage $V_{C1}$ longer than in the case shown in FIG. 53A. Hence, the voltage Vb-c increases to the value corresponding to the ninth gray-level.

Upon lapse of the selecting period $T_S$, or at the start of the non-selecting period $T_O$, the voltage across the pixel capacitor $C_{LC}$ decreases by a certain value to a voltage V9. This voltage V9 is sustained between the pixel electrode 12 and the opposing electrode 15.

Figures 55A, 55B:
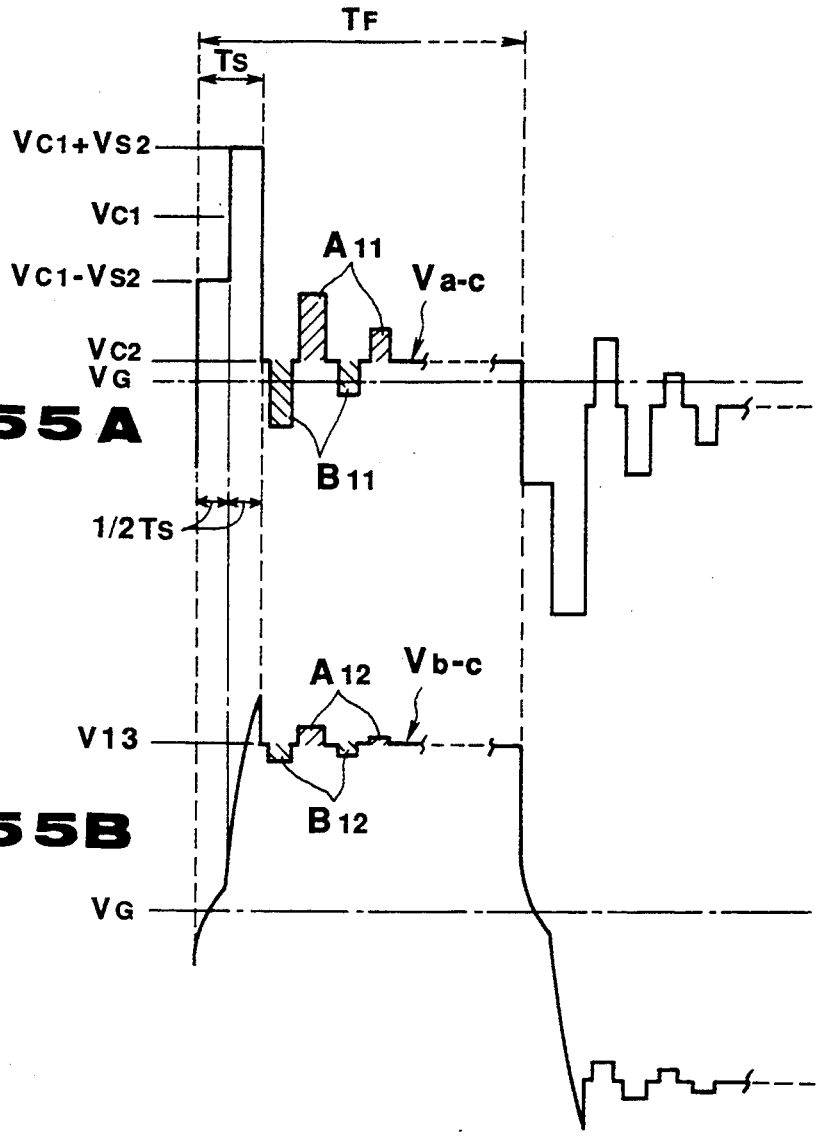
FIGS. 55A and 55B are diagrams showing the waveforms of two voltages applied between the input of the active element and the opposing electrode and between the pixel electrode and the opposing electrode, respectively, thereby to set the pixel at the highest gray-level in the ninth method according to the invention.

To drive the active matrix LCD element at the thirteenth gray-level (i.e., the highest level) of the 14-level gray scale, a data signal $S_{D9}$ having a pulse during the selecting period $T_S$, whose width is 5/10 of the period $T_S$ and whose potentials are $V_{S2}$ and $-V_{S2}$. In this case, a selecting voltage Va-c having the waveform shown in FIG. 55A is applied between the input of the active element 13 and the opposing electrode 15. It should be noted that the waveform of this selecting voltage Va-c is identical to the waveform of the voltage 13 shown in FIG. 51.

When the selecting voltage Va-c having the waveform shown in FIG. 55A is applied between the input of the active element 13 and the opposing electrode 15, the voltage Vb-c applied between the pixel electrode 12 and the opposing electrode 15 changes as is shown in FIG. 55B. More specifically, during the first half of the selecting period $T_S$, this voltage Vb-c increases first along the curve defined by the pulse-superposed voltage $V_{C1}-V_{S2}$ which is lower than the ON-selecting voltage $V_{C1}$. During the latter half of the selecting period $T_S$, the voltage Vb-c increases along the curve defined by the pulse-superposed voltage $V_{C1}+V_{S2}$ which is higher than the ON-selecting voltage $V_{C1}$. The selecting voltage Va-c has a peak value (i.e., $V_{C1}+V_{S2}$) which is equal to that of the selecting voltage shown in FIGS. 53A and 54A. The curve along which the voltage Vb-c increases while the selecting voltage Va-c remains at $V_{C1}+V_{S2}$ is identical to the curve illustrated in FIGS. 53B and 54B. Nonetheless, the pulse at $V_{C1}+V_{S2}$ has a width greater than that of the pulse at $V_{C1}+V_{S2}$ (FIG. 54A), and a pulse has been superposed on the ON-selecting voltage $V_{C1}$ longer than in the case shown in FIG. 54A. Hence, the voltage Vb-c increases to the value corresponding to the thirteenth gray-level.

Upon lapse of the selecting period $T_S$, or at the start of the non-selecting period $T_O$, the voltage across the pixel capacitor $C_{LC}$ decreases by a certain value to a voltage V13. This voltage V13 is held between the pixel electrode 12 and the opposing electrode 15.

As has been described, a selecting voltage Va-c having a voltage and a data-pulse width, both determined by the image data, is applied between the input of the active element 13 and the opposing electrode 15 during the selecting period $T_S$, and a voltage Vb-c which is determined by the voltage and data-pulse width of the selecting voltage Va-c is applied between the pixel electrode 12 and the opposing electrode 15 during the selecting period $T_S$. Therefore, it is possible to drive each active matrix LCD element, controlling the transmittance of the pixel thereof, thereby to display an image in a multi-gray scale.

The selecting voltages 1 to 7 and 7' to 13, all shown in FIG. 51, are obtained by superposing a data pulse on the ON-selecting voltage $V_{C1}$ during the last part of the first half of the selecting period $T_S$, and by superposing another pulse on the ON-selecting voltage $V_{C1}$ during the last part of the latter half of the selecting period $T_S$. Instead, these data pulses can be superposed on the voltage $V_{C1}$, either during the initial parts of the halves of the period $T_S$, respectively, or during the intermediate parts of the halves of the period $T_S$, respectively. In this case, too, the voltage Vb-c sustained in the pixel capacitor $C_{LC}$ has the value determined by the value and data-pulse width of the selecting voltage Va-c.

In the ninth method, as has been described with reference to FIGS. 50A to 50D, the scan signal $S_{S9}$ supplied to the signal line 14 is at either a potential $V_{C1}$ of a positive or negative polarity during each selecting period $T_S$, and at either a lower potential $V_{C2}$ of a positive or negative polarity during each non-selecting period $T_O$. The data signal $S_{D9}$ supplied to the opposing electrode 15 has its potential changed alternately between two values positive and negative with respect to a predetermined reference potential $V_G$, at intervals obtained by dividing the selecting period $T_S$ by 2. The data signal $S_{D9}$ has, during each selecting period $T_S$, a positive component A10 and a negative component B10 which have substantially the same area. Therefore, the voltage applied between the input of the active element 13 and the opposing electrode 15 during the non-selecting period $T_O$ has, as has been described, components A11 positive with respect to the non-selecting potential $V_{C2}$ of the scan signal $S_{S9}$, and components B11 negative with respect to the non-selecting potential $V_{C2}$, the total area of which is substantially equal to that of the components A11.

Thus, as is evident from FIGS. 50D, 52B, 35B, 54B, and 55B, the non-selecting voltage applied between the pixel electrode 12 and the opposing electrode 15 during the non-selecting period $T_O$ changes alternately to a positive value and a negative value from the voltage sustained in the pixel capacitor $C_{LC}$ at the end of the selecting period $T_S$, or the hold voltage V0 to V13. The positive and negative values to which the non-selecting voltage changes are identical in absolute value which is determined by the image data for driving the other pixels. Hence, the non-selecting voltage has positive components A12 and negative components B12, a total area of the components 12A being equal to that of the components B12.

Thus, the positive components A12 cancel out the negative components B12. The effective voltage applied between the pixel electrode 12 and the opposing electrode 15 during the non-selecting period $T_O$, i.e., the hold voltage, is maintained at one of the voltages V1 to V13 and scarcely changes.

Since the effective voltage applied between the pixel electrode 12 and the opposing electrode 15 scarcely changes during the non-selecting voltage $T_O$, the voltage-transmittance characteristic of the pixel little changes during the period $T_O$. The transmittance of the pixel scarcely changes during the non-selecting period $T_O$. This is because the transmittance depends on one of the voltages V0 to V13 sustained in the pixel capacitor $C_{LC}$ and determined by the pulse width of the selecting voltage applied during the selecting period $T_S$. Hence, it is possible to set the pixel at any desired gray-level.

Figure 56:
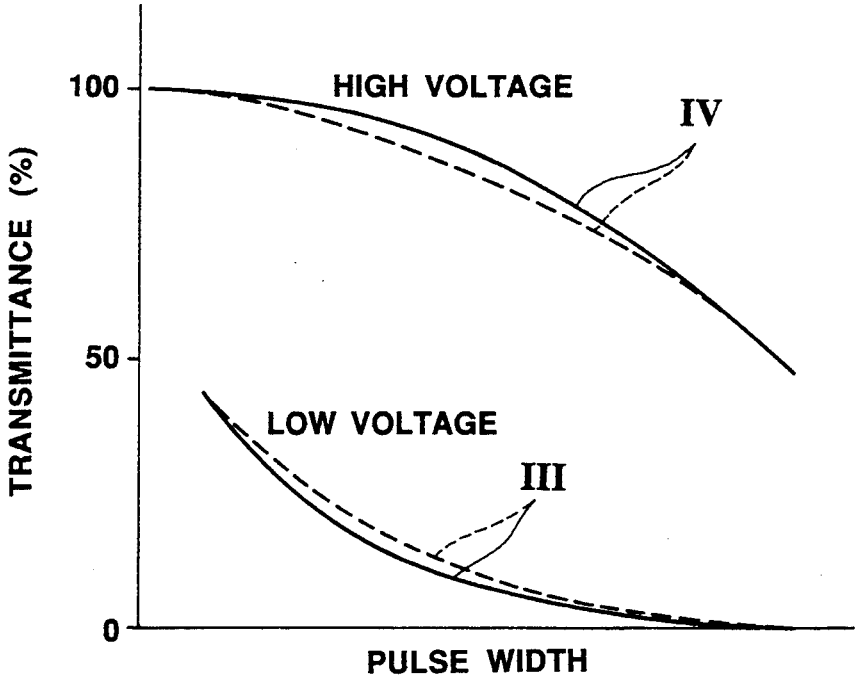
FIG. 56 is a graph representing the relationship between the transmittance of the pixel of each LCD element driven by the ninth method of the invention and the data-pulse width of the selecting voltage applied between the input of the active element of the LCD element.

FIG. 56 is a graph illustrating the relationship which the pulse width and the transmittance of the pixel have when the active matrix LCD elements is driven by the ninth method according to the invention. More precisely, the solid curves indicate the relationship observed when all pixels, but one, of the same column, which face one of the opposing electrodes 15, are set at the 0-th gray-level and thus made to transmit light. The broken-line curves indicate the relationship observed when all pixels, but one, of the same column, are set at the thirteenth gray-level and thus made to transmit no light.

In FIG. 56, the solid and broken-line curves, generally identified as curves III represent the relationships between the pulse width and the transmittance, which are observed when the low selecting-voltages 1 to 7 (FIG. 51) are applied to the pixel. The solid and broken-line curves III, generally identified as curves IV represent the relationships between the pulse width and the transmittance, which are observed when the high selecting-voltages 7' to 13 (FIG. 51) are applied to the pixel.

As can be understood from FIG. 56, the relationship observed when all other pixels of the same column are set at the 0-th gray-level and thus made to transmit light is very similar to relationship observed when all other pixels of the same column are set at the thirteenth gray-level and thus made to transmit no light, no matter whether it is the low selecting-voltages 1 to 7 or the high selecting-voltages 7' to 13 (FIG. 51) which are applied to the pixel. The change in the transmittance of each pixel, which results from the condition of driving the other pixels of the same column, is about 5% or less.

Hence, the relationship between the pulse width and the transmittance of the pixel is scarcely affected by the condition of driving the other pixels of the same column. The transmittance of each pixel can, therefore, be controlled correctly in accordance with the data-pulse width of the selecting voltage applied during the selecting period $T_S$.

Hence, the ninth method of the invention is advantageous over the conventional method in which the transmittance of each pixel changes greatly in accordance with the condition of driving the other pixels of the same column, as is evident from the graph of FIG. 7.

In the ninth method, the data signal $S_{D9}$ has two data pulses during each selecting period $T_S$, which are positive and negative with respect to the reference potential $V_G$, respectively, and the selecting voltage applied between the input of the active element 13 and the opposing electrode 15 during the selecting period $T_S$ is a pulse-superposed voltage which has a polarity either positive or negative with respect to the non-selecting potential $V_{C2}$ of the scan signal $S_{S9}$. Hence, during the selecting period $T_S$, a positive or negative electric charge is accumulated between the pixel electrode 13 and the opposing electrode 15.

In other words, the pixel is charged throughout each selecting period $T_S$, for a sufficiently long time. Hence, the inter-electrode voltage of the pixel can be adequately high, not restricted by the ability of the active element 13 associated with the pixel, i.e., the ability of flowing a current thereof.

In the conventional method, the V-T characteristic of each pixel is much influenced by the condition of during the other pixels. To minimize this change in the V-T characteristic, it is necessary to use an active element having a considerably small capacitance, thereby to reduce greatly that change in the voltage applied between the input of the active element and the opposing electrode, which corresponds to the pixel capacitance. To this end, use is made of a diode ring which comprises two diodes having a small area and which therefore has a small capacitance, or a diode ring which comprises more diodes orientated in the opposite directions and connected in series and which therefore has a small capacitance. To manufacture diodes having a small area, high-precision patterning is required, however. If more diodes are used, the resultant diode ring will occupy a larger area, inevitably decreasing the area allocated for the pixel electrode.

By contrast, in the ninth method of the present invention, it does not matter if the non-selecting voltage changes somewhat greatly. This is because the positive components of the non-selecting voltage cancel out the negative components thereof. It is therefore unnecessary to reduce very much that portion of the change in the voltage applied between the input of the active element 13 and the opposing electrode 15, which corresponds to the pixel capacitance $C_{LC}$. Thus, it suffices to set the ratio of the element capacitance $C_D$ to the pixel capacitance $C_{LC}$ at a value (e.g., about 1/10) great enough to limit the voltage drop which occurs when the capacitance divides the voltage at the start of the non-selecting period $T_O$.

Hence, the diodes of each diode ring 13 can be those having a large area, and can therefore be made, requiring no high-precision patterning process. Also is it possible to form each diode ring 13 of less diodes orientated in the opposite directions, thereby reducing the area occupied by the diode ring 13 and proportionally increasing the area of the pixel electrode 12, whereby the active matrix LCD element has a greater numerical aperture.

The data signal $S_{D9}$ used in the ninth embodiment has its potential changed from the reference potential $V_G$ to a positive value and then to a negative value, at intervals obtained by dividing the selecting period $T_S$ by 2. Alternatively, a data signal having any other waveform can be used, provided that its potential changes from the reference potential $V_G$, alternately to a positive value and a negative value, at intervals obtained by dividing the selecting period $T_S$ by a greater even number. In short, the data signal $S_{D5}$ can have any waveform, provided the voltage applied between the input of the active element 13 and the opposing electrode 15 meets two requirements. First, it has a positive or negative pulse, whose width is determined by the image data, during the selecting period $T_S$. Second, during the non-selecting period $T_O$, it changes at intervals shorter than the selecting period $T_S$, such that the components positive with respect to the non-selecting potential $V_{C2}$ of the scan signal $S_{S9}$ have a total area equal to that of the components negative with respect to the non-selecting potential $V_{C2}$.

Figure 57:
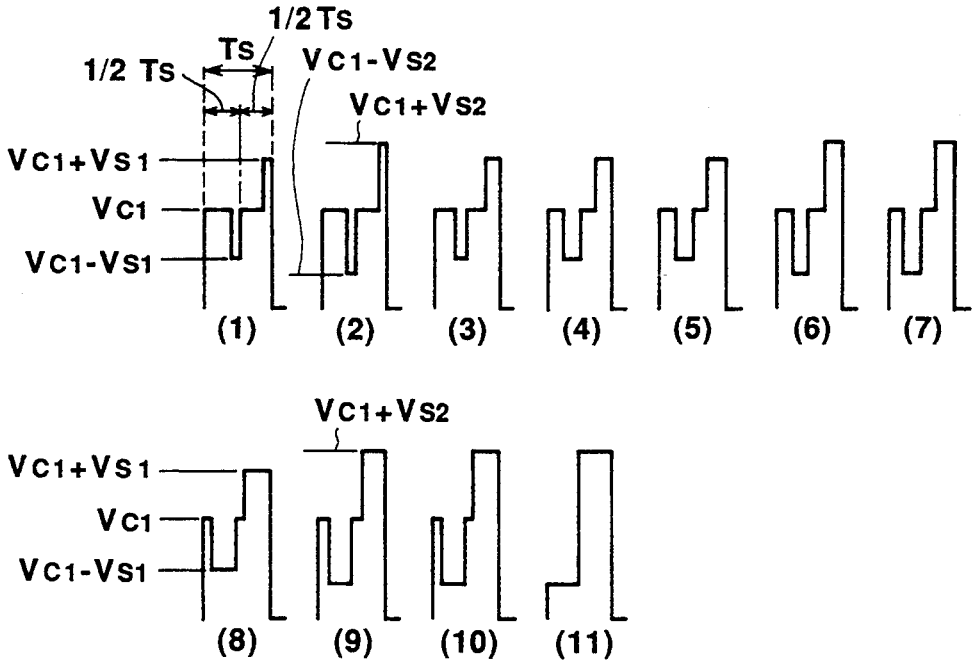
FIG. 57 is a diagram showing the waveforms of various selecting voltages, other than those shown in FIG. 51, used in the ninth method to set each pixel at various gray-levels.

Instead of the selecting voltages 1 to 13 shown in FIG. 51, the selecting voltages 1 to 11 shown in FIG. 57 can be used in the ninth method of the present invention. In this case, too, another selecting voltage, which has no data pulses, can be applied between the pixel electrode 12 and the opposing electrode 15. Hence, the pixel of each active matrix LC element can be set at 12 gray-levels.

The voltage applied between the input of the active element 13 and the opposing electrode 15 during the non-selecting period $T_O$ changes from the value applied across the pixel capacitance $C_{LC}$ at the end of the selecting period $T_S$, alternately to a positive value and a negative value to the same extent. Hence, the voltage sustained in the pixel, which is the effective voltage applied during the non-selecting period $T_O$, remains unchanged. As a result, it is possible to drive the active matrix LCD element such that each pixel thereof is set any desired gray-level.

Tenth Embodiment

The method according to a tenth embodiment of the invention (to be referred as "tenth method") will be described, with reference to FIGS. 58A to 58D, 59A and 59B, FIGS. 60A and 60B, FIGS. 61A and 61B, and FIG. 62A and 62B. Some of the features of the ninth method are identical to those of the seventh method, and therefore will not be described.

The tenth method is designed to drive active matrix LCD elements of the liquid-crystal display shown in FIGS. 8 and 9, thereby to display a gray-scale image. The ninth method is characterized in that the gray-level of each pixel is controlled, eliminating changes in the transmittance thereof which result from the influence of the condition in which the other pixels are driven.

Figures 58A, 58B, 58C, 58D:
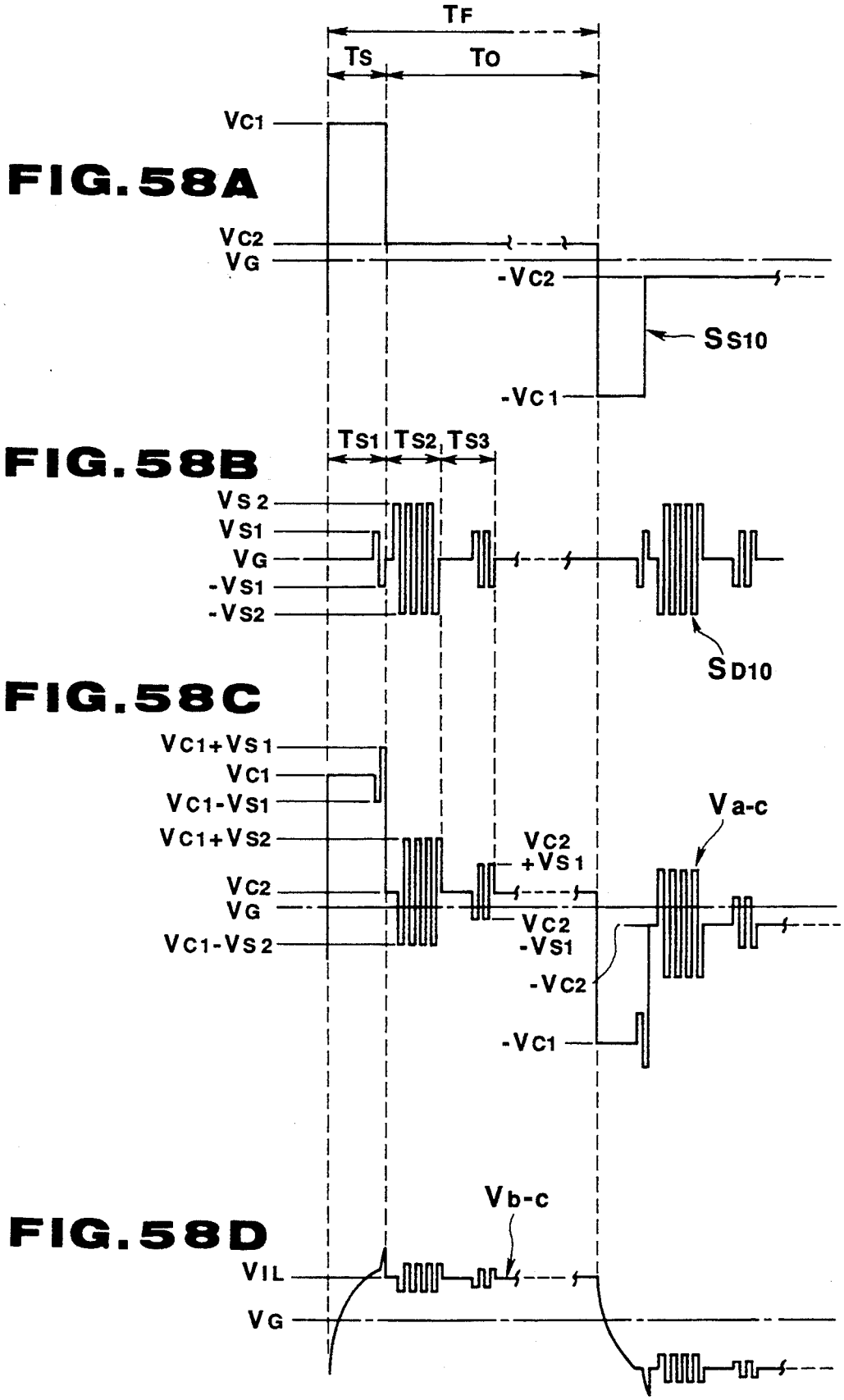
FIG. 58A is a diagram showing the waveform of the scan signal used in the tenth method according to the present invention.
FIG. 58B is a diagram showing the waveform of the data signal used in the tenth method of the invention.
FIG. 58C is a diagram illustrating the waveform of the voltage applied between the input of the active element and the opposing electrode when the scan signal and the data signal, shown in FIGS. 58A and 58B, are supplied to the opposing electrode and the signal line, respectively.
FIG. 58D is a diagram representing how the voltage applied between the pixel electrode and the opposing electrode changes when the voltage shown in FIG. 58C is applied between the input of the active element and the opposing electrode.

FIG. 58A is a diagram showing the waveform of a scan signal $S_{S10}$ supplied between the first signal line 14 of the liquid-crystal display shown in FIGS. 8 and 9. FIG. 58B is a diagram illustrating a data signal $S_{D10}$ supplied to one of the opposing electrodes 15 shown in FIG. 8. FIG. 58C is a diagram showing the waveform of a voltage Va-c applied between the opposing electrode 15 and the input of the active element 13 connected to the signal line 14. FIG. 58D is a diagram representing the waveform of a voltage Vb-c applied between the pixel electrode 12 connected to the active element 13 and the opposing electrode 15.

As shown FIG. 58A, the scan signal $S_{S10}$ is identical to the scan signal $S_{S8}$ used in the seventh method. The signal $S_{S9}$ remains at a selecting potential $V_{C1}$ during the selecting period $T_S$ and at a non-selecting potential $V_{C2}$ during a non-selecting period $T_O$. The scan signal $S_{S9}$ has its polarity altered at the end of every one-field period $T_F$.

As is shown in FIG. 58B, the data signal $S_{D10}$ has data pulses the potentials and number of which accord with the image data externally supplied during a period $T_S$ during which to selects the pixels of each row. The potential of the data signal $S_{D10}$ alters with respect to a reference voltage $V_G$ at regular intervals, the length of which is obtained by dividing each of the selecting periods $T_{S1}$, $T_{S2}$, $T_{S3}$, . . . any even numbers. Although the period $T_S$ is divided by 10, for simplicity and clarity, in FIG. 58B, it is divided by, for example, into tens of equal intervals in practice. The length of these intervals is equal to the width of each data pulse.

During each selecting period $T_S$, the data signal $S_{D10}$ has as many data pulses having a positive potential $V_S$ as data pulses having a negative potential $-V_S$. In other words, the signal $S_{D10}$ has positive data pulses and the same number of negative pulses—all data pulses are identical in both width and absolute potential value. Hence, as can be understood from FIG. 58B, the total area of the positive pulses the signal $S_{D10}$ has during each selecting period $T_S$ is substantially equal to that of the negative pulses the signal $S_{D10}$ has during the same selecting period $T_S$.

The data pulses can be set at two absolute values, i.e., $V_{S1}$ and $V_{S2}$, where $V_{S2}=2\cdot V_{S1}$. The value $V_{S1}$ or $V_{S2}$ is selected for each pulse in accordance with the image data.

More precisely, as is shown in FIG. 58B, the data signal $S_{D10}$ has one positive pulse and one negative pulse during the selecting period $T_{S1}$ for the first opposing electrode 15 during which to select the pixels of the first row. It has four positive pulses and four negative pulses during the second selecting period $T_{S2}$ during which to select the pixels of the second row, and two positive pulses and two negative pulses during the third selecting period $T_{S3}$ during which to select the pixels of the third row. The number of pulses which the signal $S_{D10}$ has during each of the selecting periods $T_{S1}$, $T_{S2}$, and $T_{S3}$ changes in accordance with the externally supplied image data, from 0 (no pulses) to n. Here, "n" is is greatest number of pulses that can be applied during the selecting period $T_S$, depending on the width of each pulse.

When the scan signal $S_{S10}$ and the data signal $S_{D10}$, which have the waveform shown in FIGS. 58A and 58B, are supplied to the opposing electrode 15 and the signal line 14, respectively, a voltage Va-c having the waveform shown in FIG. 58C is applied between the input of the active element 13 connected to the first signal line 14 and the opposing electrode 15. As can be understood from FIG. 58C, the voltage Va-c is a combination of the scan signal $S_{S10}$ and the data signal $S_{D10}$.

The voltage Va-c supplied between the input of the active element 13 and the opposing electrode 15 is a voltage on which the positive and negative data pules of the data signal $D_{S10}$ are superposed, like the voltage Va-c used in the ninth method. The voltage Va-c also has components positive with respect to the non-selecting potential $V_{C2}$ of the scan signal $S_{S10}$, and components negative with respect to the non-selecting potential $V_{C2}$. The total area of the positive components is equal to that of the negative components.

Figures 59A, 59B:
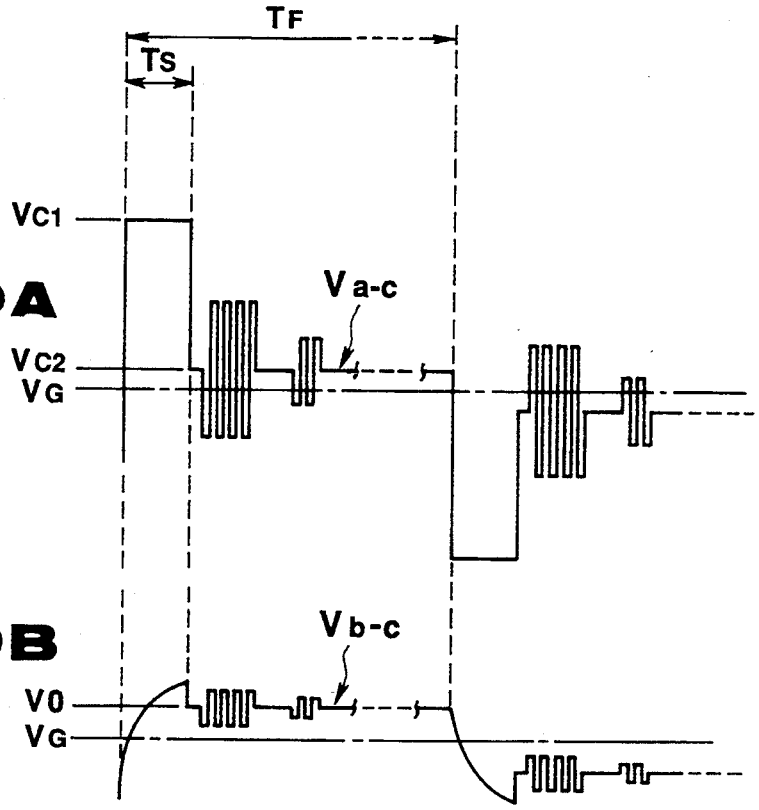
FIGS. 59A and 59B are diagrams showing the waveforms of two voltages applied between the input of the active element and the opposing electrode and between the pixel electrode and the opposing electrode, respectively, thereby to set the pixel at the 0-th gray-level in the tenth method according to the invention.

To set the pixel at the 0-th gray-level of an n-level gray scale, a data signal $S_{D10}$ having no pluses is supplied to the input of the active element 13 during the selecting period $T_S$. In this case, a composite voltage Va-c having the waveform of FIG. 59A is applied between the input of the element 13 and the opposing electrode 15, and a voltage Vb-c having the waveform of FIG. 59B is applied between the pixel electrode 12 and the opposing electrode 15.

To set the pixel at the first gray-level of the n-level gray scale, a data signal $S_{D10}$ having one positive data pulse and one negative data pulse is supplied to the input of the active element 13 during the selecting period $T_S$. Then, a composite voltage Va-c having the waveform of FIG. 58C is applied between the input of the element 13 and the opposing electrode 15, and a voltage Vb-c having the waveform of FIG. 58D is applied between the pixel electrode 12 and the opposing electrode 15.

Figures 60A, 60B:
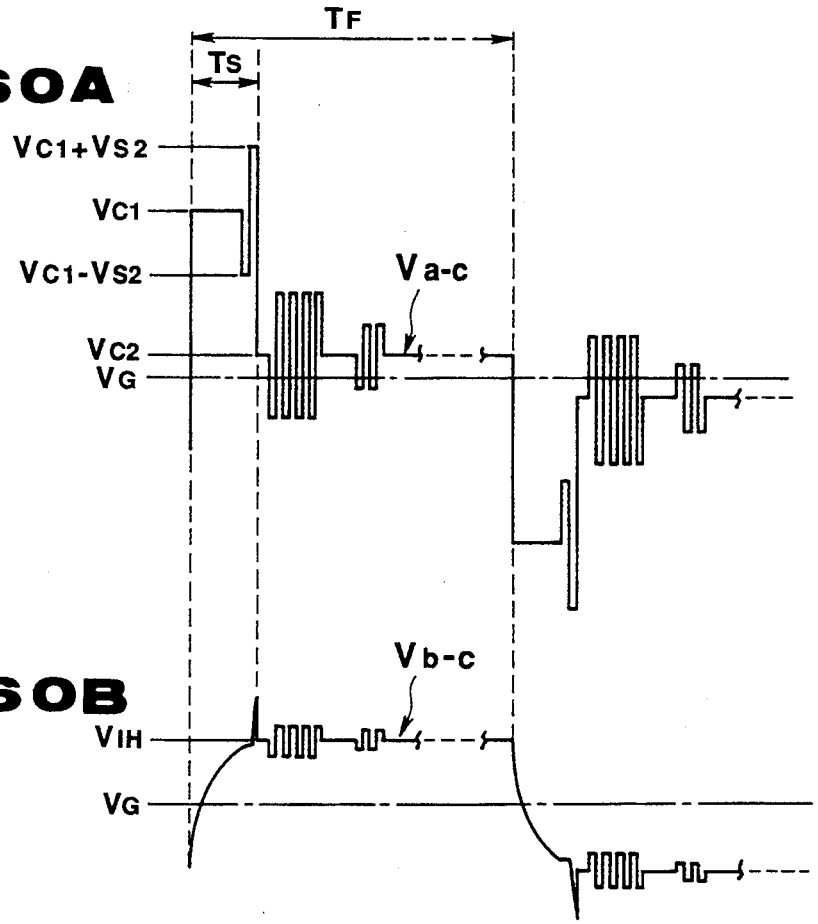
FIGS. 60A and 60B are diagrams showing the waveforms of two voltages applied between the input of the active element and the opposing electrode and between the pixel electrode and the opposing electrode, respectively, thereby to set the pixel at an intermediate gray-level in the tenth method according to the invention.

To set the pixel at another gray-level of the n-level gray scale, a data signal $S_{D10}$ having some positive pluses and the same number of negative pulses is supplied to the input of the active element 13 during the selecting period $T_S$. Then, a composite voltage Va-c having the waveform of FIG. 60A is applied between the input of the element 13 and the opposing electrode 15, and a voltage Vb-c having the waveform of FIG. 60B is applied between the pixel electrode 12 and the opposing electrode 15.

Figures 61A, 61B:
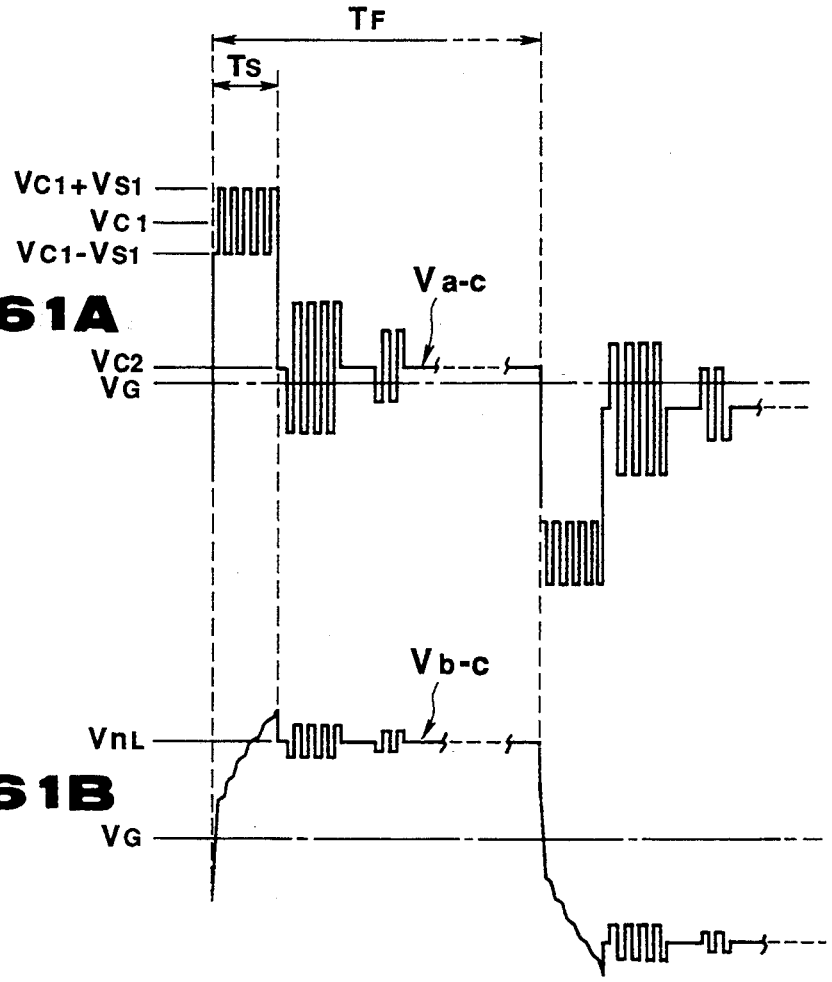
FIGS. 61A and 61B are diagrams showing the waveforms of two voltages applied between the input of the active element and the opposing electrode and between the pixel electrode and the opposing electrode, respectively, thereby to set the pixel at another intermediate gray-level in the tenth method according to the invention.

To set the pixel at still another gray-level of the n-level gray scale, a data signal $S_{D10}$ having some positive pluses and the same number of negative pulses is supplied to the input of the active element 13 during the selecting period $T_S$. In this case, a composite voltage Va-c having the waveform of FIG. 61A is applied between the input of the element 13 and the opposing electrode 15, and a voltage Vb-c having the waveform of FIG. 61B is applied between the pixel electrode 12 and the opposing electrode 15.

Figures 62A, 62B:
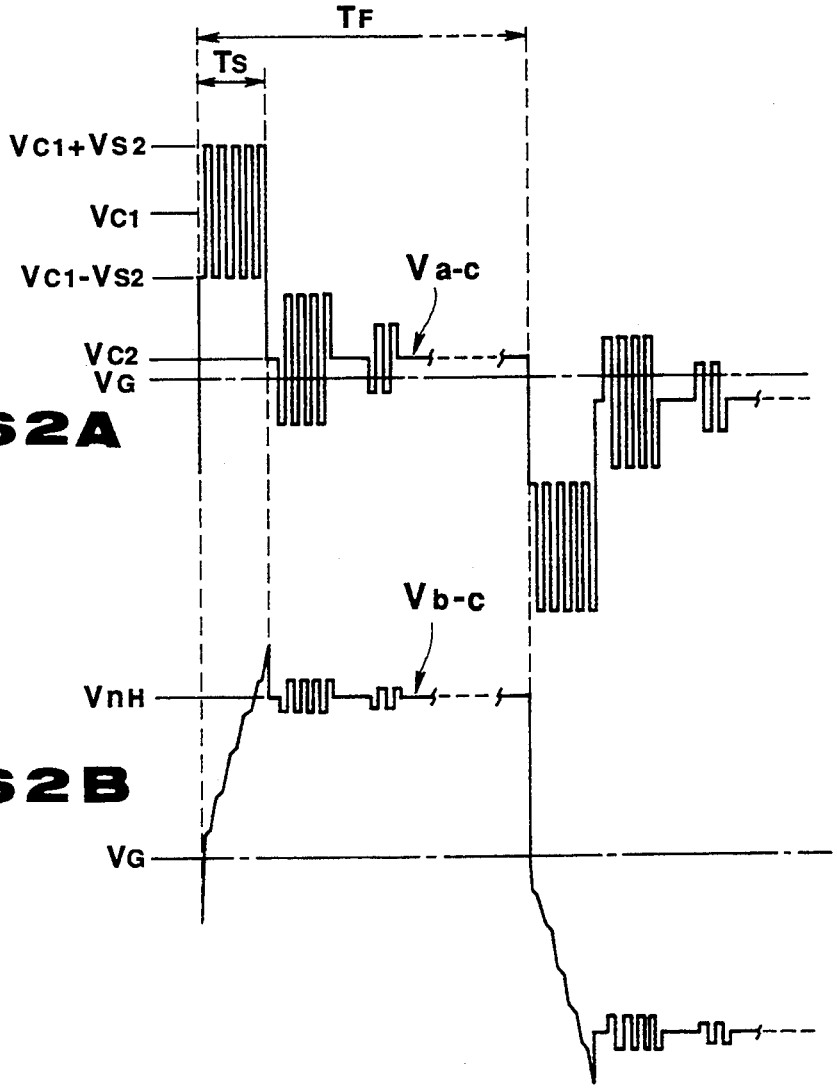
FIGS. 62A and 62B are diagrams showing the waveforms of two voltages applied between the input of the active element and the opposing electrode and between the pixel electrode and the opposing electrode, respectively, thereby to set the pixel at the highest gray-level in the ninth method according to the invention.

To set the pixel at the n-th gray-level (i.e., the highest level) of the n-level gray scale, a data signal $S_{D10}$ having positive pluses and the same number of negative pulses is supplied to the input of the active element 13 during the selecting period $T_S$. Further, for this purpose, a composite voltage Va-c having the waveform of FIG. 62A is applied between the input of the element 13 and the opposing electrode 15, and a voltage Vb-c having the waveform of FIG. 62B is applied between the pixel electrode 12 and the opposing electrode 15.

In the tenth method of the invention, a selecting voltage, which has the potential determined by the image data and data pulses the number of which is determined by the image data, is applied between the input of the active element 13 and the opposing electrode 15 during the selecting period $T_S$. As a result, a voltage, which has the potential determined by the value of the selecting voltage and the number of pulses thereof, is applied between the pixel electrode 12 and the opposing electrode 15 during the selecting period $T_S$. It is therefore possible to control the transmittance of each pixel, whereby the pixels of the active matrix LCD elements display the gray-scale image represented by the image data.

The selecting voltage (i.e., the voltage Va-c applied during the selecting period $T_S$) is a voltage obtained by superposing a data pulse on the ON-selecting voltage $V_{C1}$ during the last part of the selecting period $T_S$. Instead, the data pulse can be superposed on the voltage $V_{C1}$, either during the initial or intermediate part of the the period $T_S$.

In the tenth method, too, as has been described with reference to FIGS. 58A to 58D, the scan signal $S_{S10}$ supplied to the signal line 14 is at either a potential $V_{C1}$ of a positive or negative polarity during each selecting period $T_S$, and at either a lower potential $V_{C2}$ of a positive or negative polarity during each non-selecting period $T_O$. The data signal $S_{D10}$ supplied to the opposing electrode 15 has data pulses the number of which accords with the image data, and has a potential changed alternately between two values positive and negative with respect to a predetermined reference potential $V_G$ by the same value, at intervals obtained by dividing the selecting period $T_S$ by 2. The data signal $S_{D10}$ has positive components and negative components. Since the total area of these positive components is substantially equal to that of the negative components, the voltage applied between the input of the active element 13 and the opposing electrode 15 during the non-selecting period $T_O$ has components positive with respect to the non-selecting potential $V_{C2}$ of the scan signal $S_{S9}$, and components negative with respect to the non-selecting potential $V_{C2}$, the total area of which is substantially equal to that of the positive components.

Thus, as is evident from FIGS. 58D, 59B, 60B, 61B, and 62B, the non-selecting voltage applied between the pixel electrode 12 and the opposing electrode 15 during the non-selecting period $T_O$ changes alternately to a positive value and a negative value from the voltage held in the pixel capacitor $C_{LC}$ at the end of the selecting period $T_S$, or the hold voltage V0, V1L, V1H, . . . or VnH. The positive and negative values to which the non-selecting voltage changes are identical in absolute value. Hence, the non-selecting voltage has positive components and negative components, a total area of the positive components being substantially equal to that of the negative components.

Thus, the positive components of the non-selecting voltage cancel out the negative components. The effective voltage applied between the pixel electrode 12 and the opposing electrode 15 during the non-selecting period $T_O$, i.e., the hold voltage, is maintained at the voltage V0, V1L, V1H, . . . or VnH and scarcely changes.

In the ninth method, too, the transmittance of the pixel scarcely changes during the non-selecting period $T_O$. This is because the transmittance depends on the voltage V0, V1L, V1H, . . . or VnH held in the pixel capacitor $C_{LC}$ and determined by the number of pulses of the selecting voltage applied during the selecting period $T_S$. Hence, it is possible to set the pixel at any desired gray-level.

In the tenth embodiment described above, the selecting voltage can have two base values. According to the present invention, the selecting voltage can have three or more base values. The more base values the selecting voltage has, the more gray-levels each pixel can be set at, provided the data-pulse width or the number of data pulses is changed for each base value of the selecting voltage.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of multiplex-driving an active matrix liquid-crystal display device, said liquid crystal display device comprising first and second substrates spaced apart from each other and opposing each other; a liquid-crystal layer interposed between the first and second substrates; a plurality of pixel electrodes arranged in rows and columns on a surface of the first substrate; a plurality of semiconductor active elements formed on the surface of the first substrate and respectively connected to the pixel electrodes; a plurality of signal lines, arranged on the surface of the first substrate, for supplying drive signals to the semiconductor active elements; and a plurality of opposing electrodes arranged on a surface of the second substrate and extending parallel to the columns of pixel electrodes;

and wherein a pixel is formed by each pixel electrode, a respective portion of each opposing electrode which overlaps each pixel electrode, and a respective portion of the liquid-crystal layer which is sandwiched between each pixel electrode and said respective portion of each opposing electrode, said method of multiplex-driving said active matrix liquid-crystal display device comprising the steps of:

applying a selecting voltage between at least one of said pixel electrodes and the opposing electrode overlapping said at least one pixel electrode for a selecting period during which image data is supplied to a predetermined pixel, said selecting voltage being of either positive or negative polarity in accordance with the value of the image data; and applying a non-selecting voltage between said pixel electrode and said opposing electrode for a non-selecting period, following the selecting period, during which image data is supplied to pixels other than said predetermined pixel, said non-selecting voltage having a waveform such that when the voltage thereof is plotted on a graph with respect to time, positive components of said waveform which are positive with respect to a potential held between said pixel electrode and said opposing electrode, have an area substantially equal to an area of negative components of said waveform which are negative with respect to said potential between said pixel electrode to said opposing electrode, and wherein said positive component of said non-selecting voltage always has the same area as said negative component of said non-selecting voltage, irrespective of a display pattern.

2. The method according to claim 1, wherein said selecting voltage remains at a positive value or a negative value which accords with the image data, during each selecting period.

3. The method according to claim 1, wherein said non-selecting voltage comprises pairs of pulses, the pulses of each pair having the same width and being positive and negative with respect to said potential held between said pixel electrode and said opposing electrode during the non-selecting period following the selecting period.

4. The method according to claim 1, wherein said non-selecting voltage comprises pairs of pulses, the pulses of each pair having different widths and different amplitudes, and being positive and negative with respect to said potential held between said pixel electrode and said opposing electrode during the non-selecting period following the selecting period, and the product of the width and amplitude of one of the pulses of each pair is equal to the product of the width and amplitude of the other pulse of each pair.

5. The method according to claim 1, wherein said semiconductor active elements comprise thin-film active elements, each of which has characteristic of a diode.

6. The method according to claim 1, wherein said semiconductor active elements comprise diode ring which comprises diodes connected in parallel and positioned in opposite directions.

7. The method according to claim 5, wherein said semiconductor active elements include diodes which are connected in series and positioned in opposite directions.

8. A method of multiplex-driving an active matrix liquid-crystal display device, said liquid crystal display device comprising first and second substrates spaced apart from each other; a liquid-crystal layer interposed between the first and second substrates; a plurality of pixel electrodes arranged in rows and columns on a surface of the first substrate; a plurality of semiconductor active elements formed on the surface of the first substrate and respectively connected to the pixel electrodes; a plurality of signal lines, arranged on the surface of the first substrate, for supplying drive signals to the semiconductor active elements; and a plurality of opposing electrodes arranged on a surface of the second substrate and extending parallel to the columns of pixel electrodes; and wherein a pixel is formed by each pixel electrode, a respective portion of each opposing electrode which overlaps each pixel electrode, and a respective portion of the liquid-crystal layer which is sandwiched between each pixel electrode and said respective portion of each opposing electrode, said method of multiplexing driving an active matrix liquid crystal display device comprising the steps of:

supplying a scan signal to an input terminal of at least one of said semiconductor active elements or to at least one of said opposing electrodes; and supplying a data signal to the input terminal of said at least one of said semiconductor active elements when said scan signal is supplied to said at least one of said opposing electrodes, or to said at least one of said opposing electrodes when said scan signal is supplied to said at least one of said semiconductor active elements;

wherein a selecting voltage, having a positive or negative value according to the data signal, is applied between the input terminal of said at least one of said semiconductor active elements and said at least one of said opposing electrodes for a selecting period during which image data is supplied to a pixel; and wherein a non-selecting voltage, having a waveform such that when the voltage thereof is plotted on a graph with respect to time, at least two components of said waveform which are positive and negative with respect to a non-selecting potential of said scan signal always have substantially the same total area irrespective of a display pattern, is applied between the input terminal of said at least one of said semiconductor active elements and said at least one of said opposing electrodes for a non-selecting period.

9. The method according to claim 8, wherein said non-selecting voltage comprises pairs of pulses, the pulses of each pair having each a width and an amplitude, and being positive and negative with respect to said non-selecting potential, and the product of the width and amplitude of one of the pulses of each pair being equal to the product of the width and amplitude of the other pulse of each pair.

10. The method according to claim 8, wherein said scan signal is at a potential during said selecting period and a different potential during said non-selecting period, and has a polarity which remains unchanged during said selecting period, and wherein said data signal has a potential changed in accordance with the image data at intervals obtained by dividing said selecting period, and has a waveform such that components positive with respect to a predetermined reference potential have a total area substantially equal to that of components negative with respect to the predetermined reference potential.

11. The method according to claim 10, wherein said data signal has a potential which changes at intervals obtained by dividing said selection period by an even number.

12. The method according to claim 10, wherein said data signal has a potential which changes at regular intervals obtained by dividing said selecting period by an even number, and has such a waveform such that components positive with respect to said predetermined reference potential have substantially the same absolute value as components negative with respect to said predetermined reference potential.

13. The method according to claim 10, wherein said data signal has a potential which changes at irregular intervals obtained by dividing said selecting period by any number, and has a waveform such that components positive with respect to said non-selecting potential have substantially the same absolute value as components negative with respect to said non-selecting potential.

14. The method according to claim 10, wherein said data signal has an absolute potential which changes in accordance with the image data.

15. The method according to claim 10, wherein said data signal comprises at least one pulse during said selecting period, said at least one pulse having a width which accords with the image data.

16. The method according to claim 10, wherein said data signal comprises a number of pulses during said selecting period, said number of pulses being determined in accordance with the image data.

17. The method according to claim 10, wherein said data signal comprises at least one pulse during said selecting period, said at least one pulse having an absolute potential value and a width which change in accordance with the image data.

18. The method according to claim 10, wherein said data signal comprises pulses during said selecting period, the absolute potential values of said pulses and the number thereof changing in accordance with the image data.

19. The method according to claim 8, wherein said semiconductor active elements comprise thin-film active elements, each of which has characteristic of a diode.

20. The method according to claim 8, wherein said semiconductor active elements comprise diode rings, each of which comprises diodes connected in parallel and positioned in opposite directions.

21. The method according to claim 8, wherein said semiconductor active elements comprise diodes which are connected in series and positioned in opposite directions.

* * * * *